US008777692B2

(12) United States Patent
Jimenez et al.

(10) Patent No.: US 8,777,692 B2
(45) Date of Patent: Jul. 15, 2014

(54) BRASSIERE

(75) Inventors: Melfi Maria Jimenez, Secaucus, NJ (US); Jill Scott, Philadelphia, PA (US)

(73) Assignee: AS IP Holdings, Inc., Secaucus, NJ (US)

( * ) Notice: Subject to any disclaimer, the term of this patent is extended or adjusted under 35 U.S.C. 154(b) by 0 days.

(21) Appl. No.: 12/367,504

(22) Filed: Feb. 7, 2009

(65) Prior Publication Data

US 2010/0035513 A1 Feb. 11, 2010

Related U.S. Application Data

(63) Continuation of application No. 12/228,073, filed on Feb. 8, 2008, now abandoned.

(51) Int. Cl.
*A41C 3/00* (2006.01)

(52) U.S. Cl.
USPC ..... 450/30; 450/7; 450/8

(58) Field of Classification Search
USPC ..... 450/7, 8, 10, 11, 30, 86, 88, 41–45
See application file for complete search history.

(56) References Cited

U.S. PATENT DOCUMENTS

| | | | | |
|---|---|---|---|---|
| 2,255,720 | A * | 9/1941 | Lewis | 450/86 |
| 2,455,036 | A * | 11/1948 | Boylan | 450/86 |
| 3,008,468 | A * | 11/1961 | Williams | 450/2 |
| 3,027,898 | A * | 4/1962 | Williams | 450/86 |
| 3,071,140 | A * | 1/1963 | Adler | 450/86 |
| 3,157,182 | A * | 11/1964 | Fridolph | 450/5 |
| 3,213,462 | A | 10/1965 | Ramsell | |
| 3,320,959 | A * | 5/1967 | Fridolph | 450/27 |

FOREIGN PATENT DOCUMENTS

| | | |
|---|---|---|
| WO | 2008/004867 A1 | 1/2008 |
| WO | 2009/100407 A3 | 8/2009 |

OTHER PUBLICATIONS

Bra measurement card provided in conjunction with the manufactured product of the inventions of U.S. Appl. Nos. 12/228,073 and 12/367,504 (1 page), Ashley Stewart.
"Buy It Now", advertisement of the manufactured product of the inventions of U.S. Appl. Nos. 12/228,073 and 12/367,504 (1 page), Ashley Stewart.
"Experience the Butterfly Effect", marketing and advertising materials of the manufactured product of the inventions of U.S. Appl. Nos. 12/228,073 and 12/367,504 (11 pages), Ashley Stewart.
"I had a *fit*!", advertisement of the manufactured product of the inventions of U.S. Appl. Nos. 12/228,073 and 12/367,504 (3 pages), Ashley Stewart.
"If you don't see your size or color, please ask!", advertisement of the manufactured product of the inventions of U.S. Appl. Nos. 12/228,073 and 12/367,504 (1 page), Ashley Stewart.
"Sexy Starts Here", advertisements for on-line distribution of the manufactured product of the inventions of U.S. Appl. Nos. 12/228,073 and 12/367,504 (7 pages), Ashley Stewart.
"Sexy Starts Here", advertisements for publication of the manufactured product of the inventions of U.S. Appl. Nos. 12/228,073 and 12/367,504 (5 pages), Ashley Stewart.

(Continued)

*Primary Examiner* — Gloria Hale
(74) *Attorney, Agent, or Firm* — Cozen O'Connor

(57) ABSTRACT

The claimed invention is directed to brassieres that offer extra support for large women. The brassieres include an inner bra band and an outer bra band.

23 Claims, 81 Drawing Sheets

(56) References Cited

OTHER PUBLICATIONS

"Sexy Starts Here", sample advertisement for postal distribution of the manufactured product of the inventions of U.S. Appl. Nos. 12/228,073 and 12/367,504 (1 page), Ashley Stewart.
"The Butterfly Bra is here!", advertisement poster of the manufactured product of the inventions of U.S. Appl. Nos. 12/228,073 and 12/367,504 (1 page), Ashley Stewart.
"The Butterfly Bra", advertisement poster of the manufactured product of the inventions of U.S. Appl. Nos. 12/228,073 and 12/367,504 (1 page), Ashley Stewart.
"The Butterfly Marketing Collaterals", listing of items associated with the sale of the manufactured product of the inventions of U.S. Appl. Nos. 12/228,073 and 12/367,504 (2 pages), Ashley Stewart.
"The Secret Is Out", brochure discussing benefits of the manufactured product of the inventions of U.S. Appl. Nos. 12/228,073 and 12/367,504 (2 pages), Ashley Stewart.
"Try It On—Order Now", advertisement of the manufactured product of the inventions of U.S. Appl. Nos. 12/228,073 and 12/367,504 (2 pages), Ashley Stewart.
Anonymous, "An Actress' Bra Solution", Us Weekly, p. 79, Us Weekly (Jun. 2, 2008).
Anonymous, "Jill Spreads Her Wings . . . InStyle", online discussion, http://www.jillscott.com/buzz/2008/jill-spreads-her-wings-in-instyle-magazine.html (Jun. 5, 2008).
Foster, "Stella's Column", Chicago Sun-Times, p. 37, Digital Chicago, Inc. (May 27, 2008).
Gillespie, "Jill Scott launches the new Butterfly bra at Ashley Stewart", Chicago Defender, p. 15, Chicago Defender (Jun. 4, 2008).
Gumbrecht, "Creation 'not your Victoria's Secret bra'", The Atlanta Journal-Constitution (May 23, 2008).
Hunnicutt, "Jill Scott Designs Plus Size Bra Line", online article, AOL LLC (Mar. 6, 2008).
MacSweeney, "A mind of her own", Vogue, p. 326, The Condé Nast Publications Inc. (Apr. 1, 2008).
Monget, "Jill Scott's Butterfly Bra", WWDMONDAY, p. 11, Fairchild Fashion Group (Apr. 21, 2008).
Morgan, "busting *out*!", InStyle, p. 81, Time Inc. (2008).
Rush et al., "Surveillance", New York Daily News, p. 20, Daily News, L.P. (May 27, 2008).

* cited by examiner

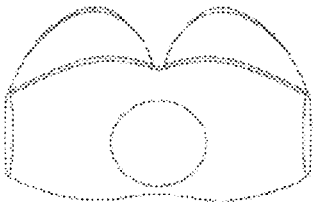
FIG. 5(aaa)
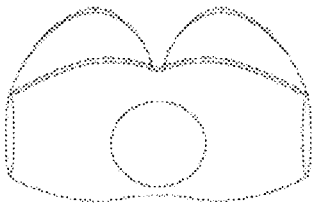
FIG. 5(bbb)

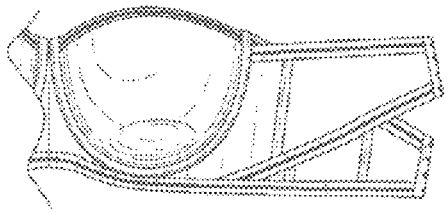
FIG. 5(ccc)
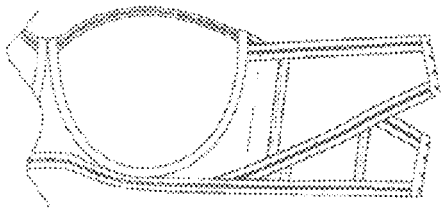
FIG. 5(ddd)
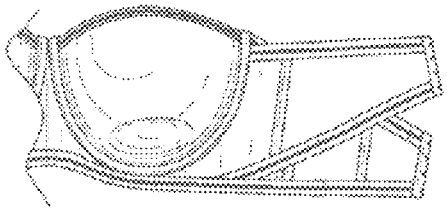
FIG. 5(eee)
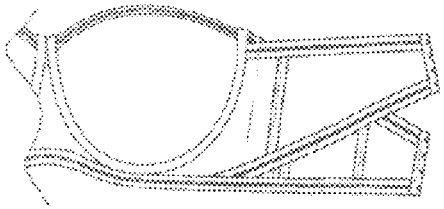
FIG. 5(fff)
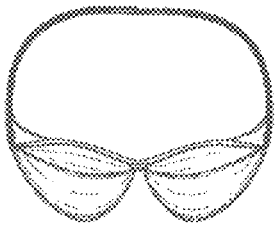
FIG. 5(ggg)
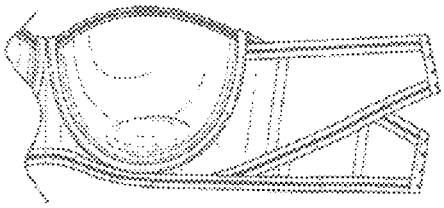
FIG. 5(hhh)

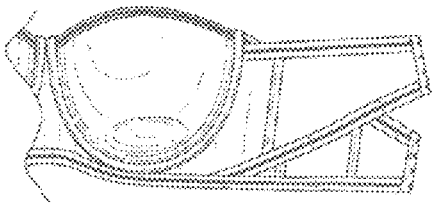
FIG. 5(iii)
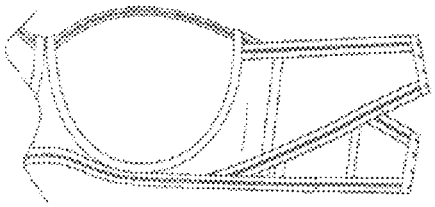
FIG. 5(jjj)
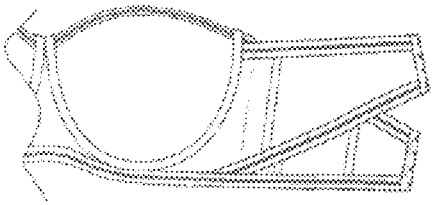
FIG. 5(kkk)
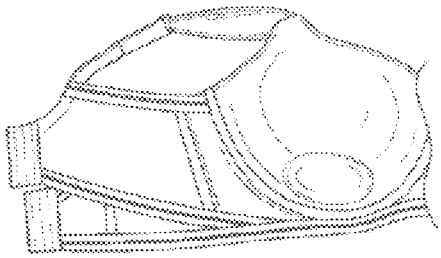
FIG. 5(lll)

BRASSIERE

CROSS-REFERENCE TO RELATED APPLICATIONS

This application is a continuation application of U.S. Nonprovisional patent application Ser No. 12/228,073, filed on Feb. 8, 2008 now abandoned as U.S. Provisional Application No. 61/007,000 and converted to U.S. Nonprovisional patent application No. 12/228,073 on Feb. 24, 2009 based on the request under 37 CFR 1.53(c)(3) filed Jan. 16, 2009. This application also claims priority under 35 U.S.C. §119 to European Community Design Registrations 000984505-0001 and 000984505-0002, registered Aug. 8, 2008, which claim priority to U.S. Nonprovisional Patent Application No. 12/228,073, filed as U.S. Provisional Application No. 61/007,000on Feb. 8, 2008. The entireties of U.S. Provisional Application No. 61/007,000, U.S. Nonprovisional patent application Ser. No. 12/228,073, and European Community Design Registration 000984505-0001 are incorporated herein by reference.

FIELD OF THE INVENTION

This invention is directed to brassieres. More particularly, this invention is directed to brassieres that offer extra support for large women.

BACKGROUND OF THE INVENTION

Brassieres, or bras, provide support and enhance the shape of the breasts. Bras and similar undergarments have long been known. While the details of construction of bras may vary, the basic structure is two cups which cover and hold the breasts, two bra bands, which are coupled to the sides of the cups and wrap around the wearer, and a closure, which attaches the two bands to each other in the middle of the back along the spine. Many bras also have shoulder straps, under wires, a center gore, and a frame.

There are several problems with the construction of the basic bra, especially for larger sized wearers. Often, the weight of the breasts causes the shoulder strap to move forward, which pulls the bra band up higher on the back of the wearer than intended. This may be uncomfortable for the wearer, may cause the breasts to sit lower than desired, and may prevent much of the support that the bra was intended to provide.

Another problem caused by the basic construction is that the bra band applies so much pressure on the area under the wearer's arm that flesh and fat are displaced and bulge out from the band. This can be uncomfortable for the wearer and the effects can often be seen through clothing, provide an undesirable look and feeling of embarrassment for the wearer.

Thus, there is a need in the art for a bra, especially for larger women, that provides adequate support, stays in place, and is comfortable for the wearer.

SUMMARY OF THE INVENTION

The present invention is related to brassieres having an inner bra band and an outer bra band.

BRIEF DESCRIPTION OF THE DRAWINGS

In the accompanying drawings that form a part of the specification and are to be read in conjunction therewith, the present invention is illustrated by way of example and not limitation, with like reference numerals referring to like elements, wherein.

DETAILED DESCRIPTION OF THE INVENTION

Figure 1A:
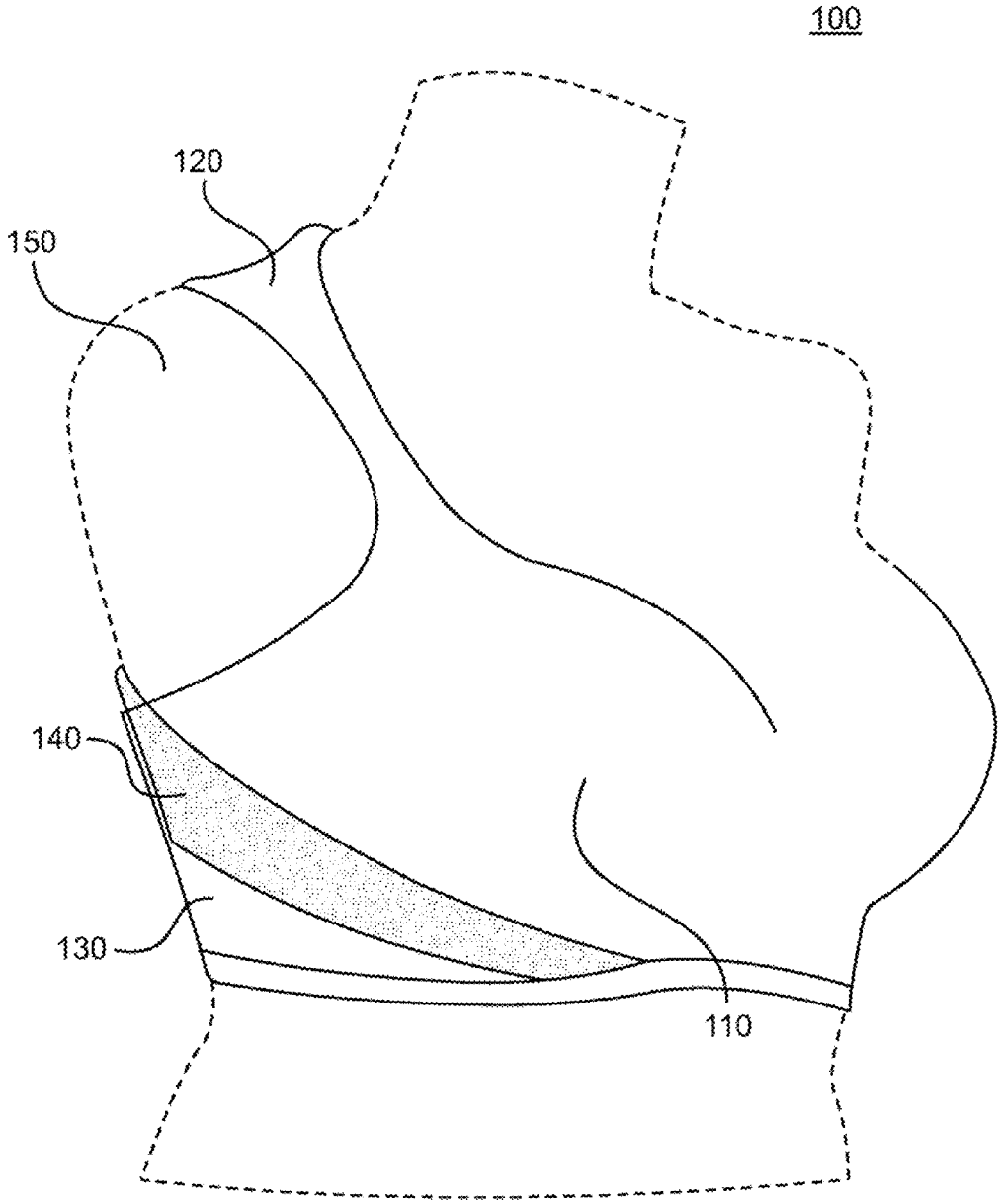
FIGS. 1(*a*)-1(*cc*) illustrate an exemplary embodiment of the invention.
Figure 1B:
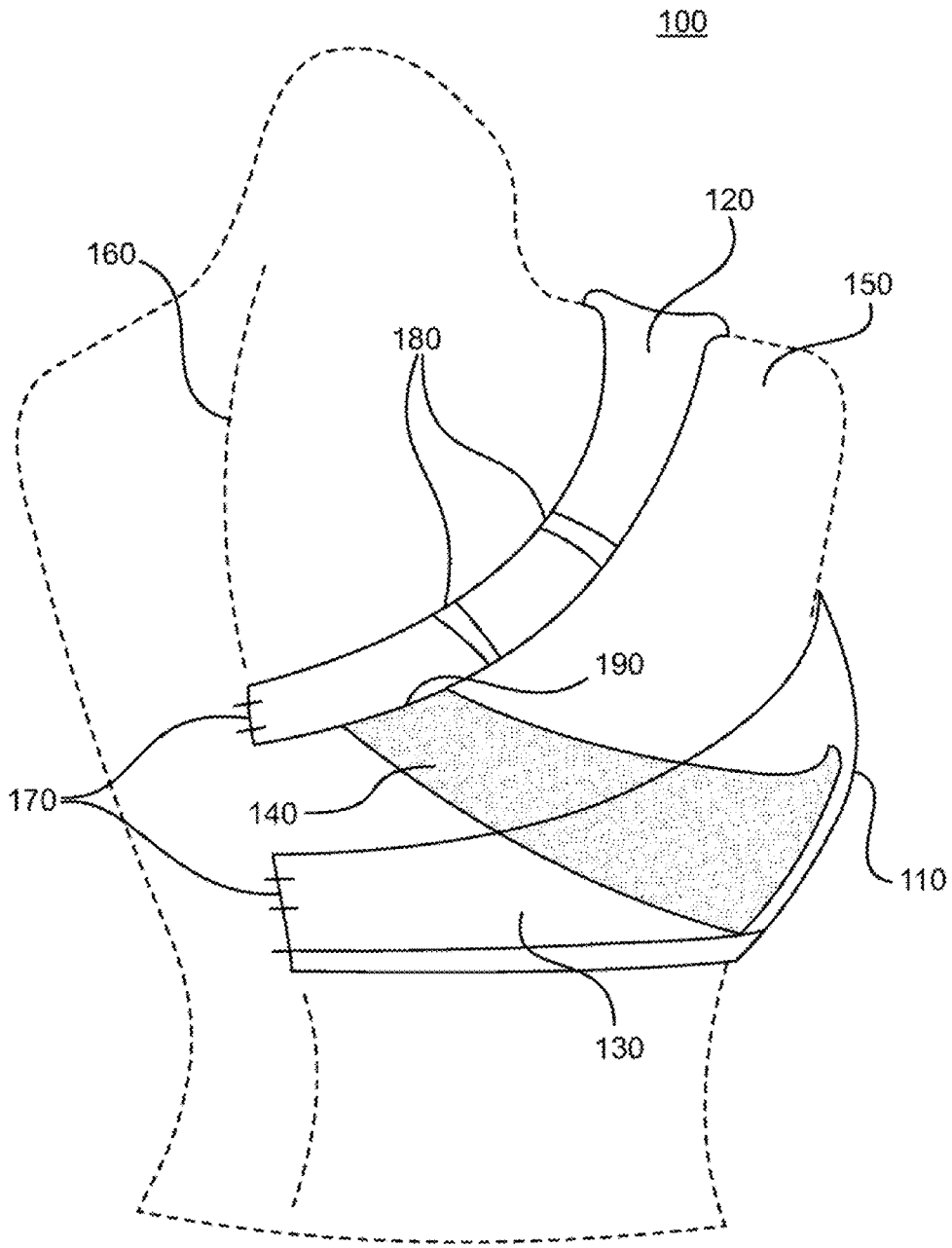
Figure 1C:
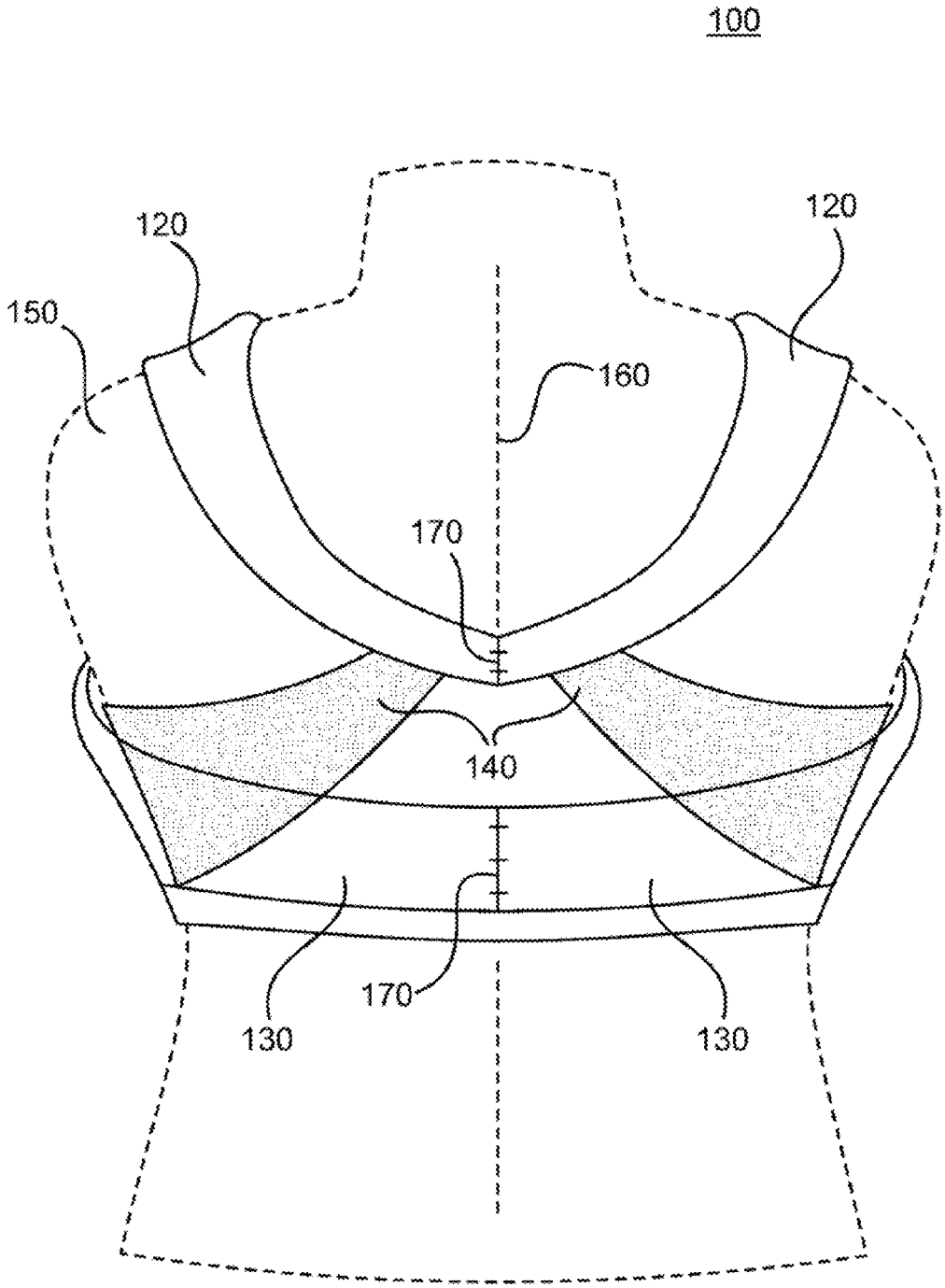
Figure 1D:
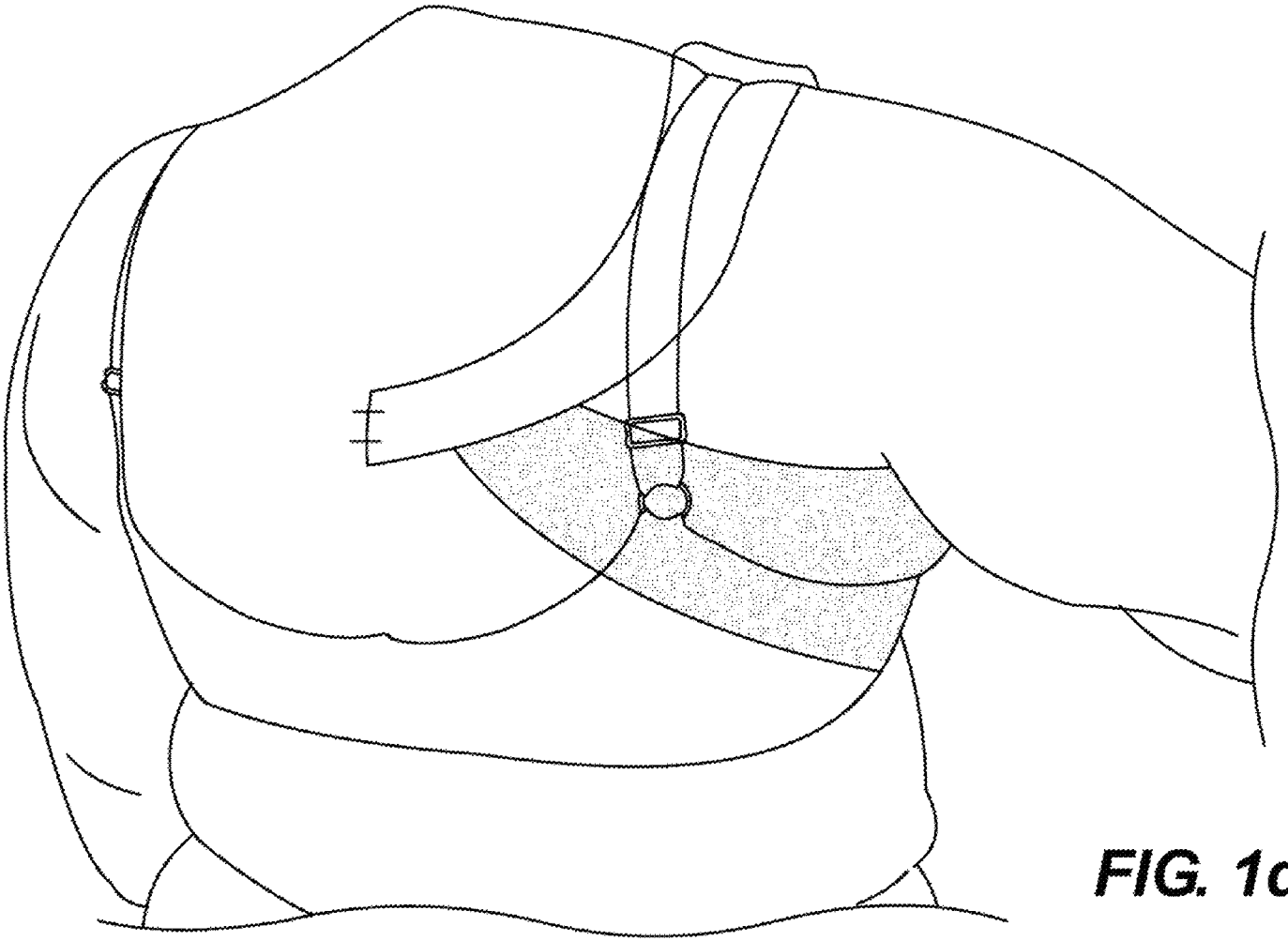
Figure 1E:
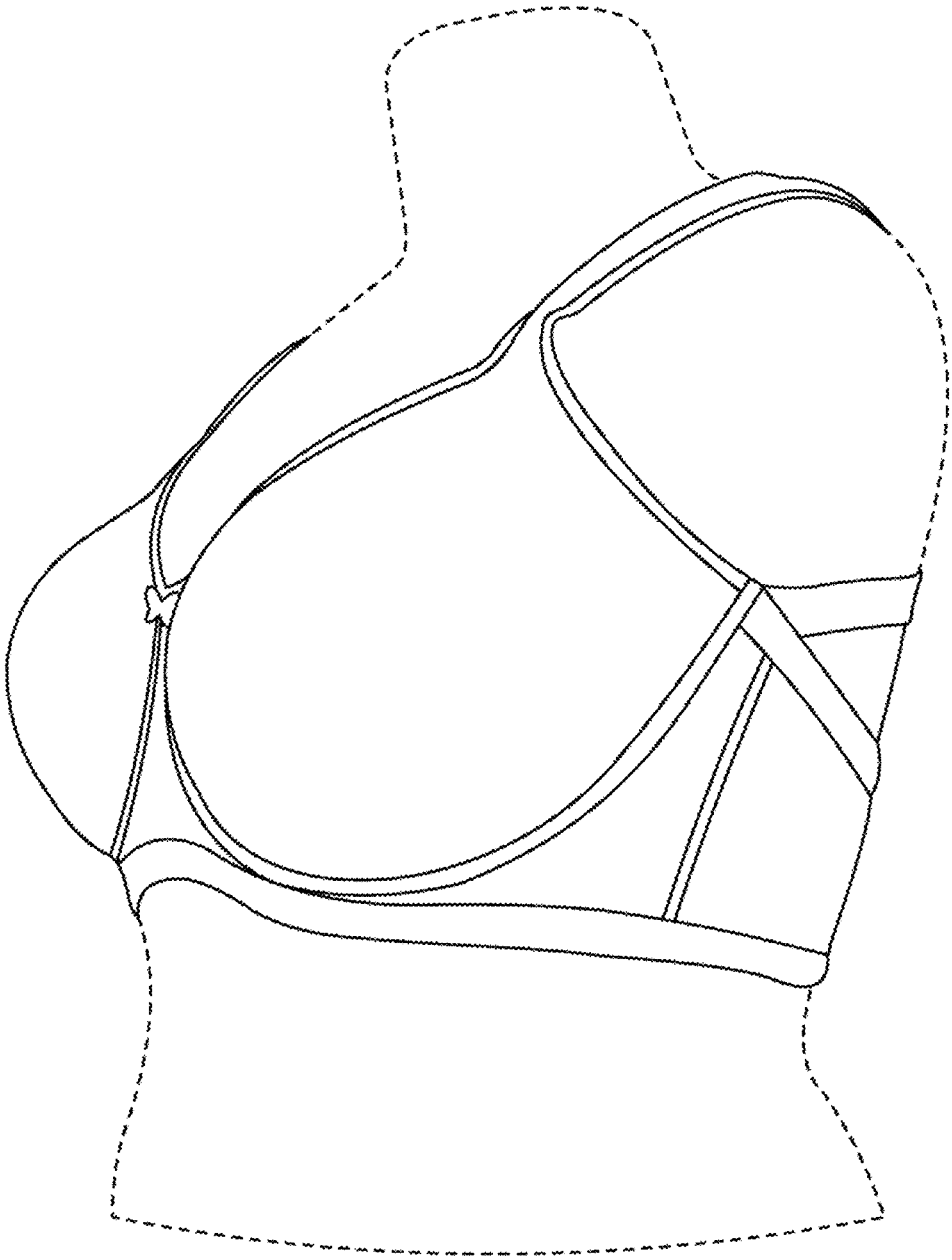
Figure 1F:
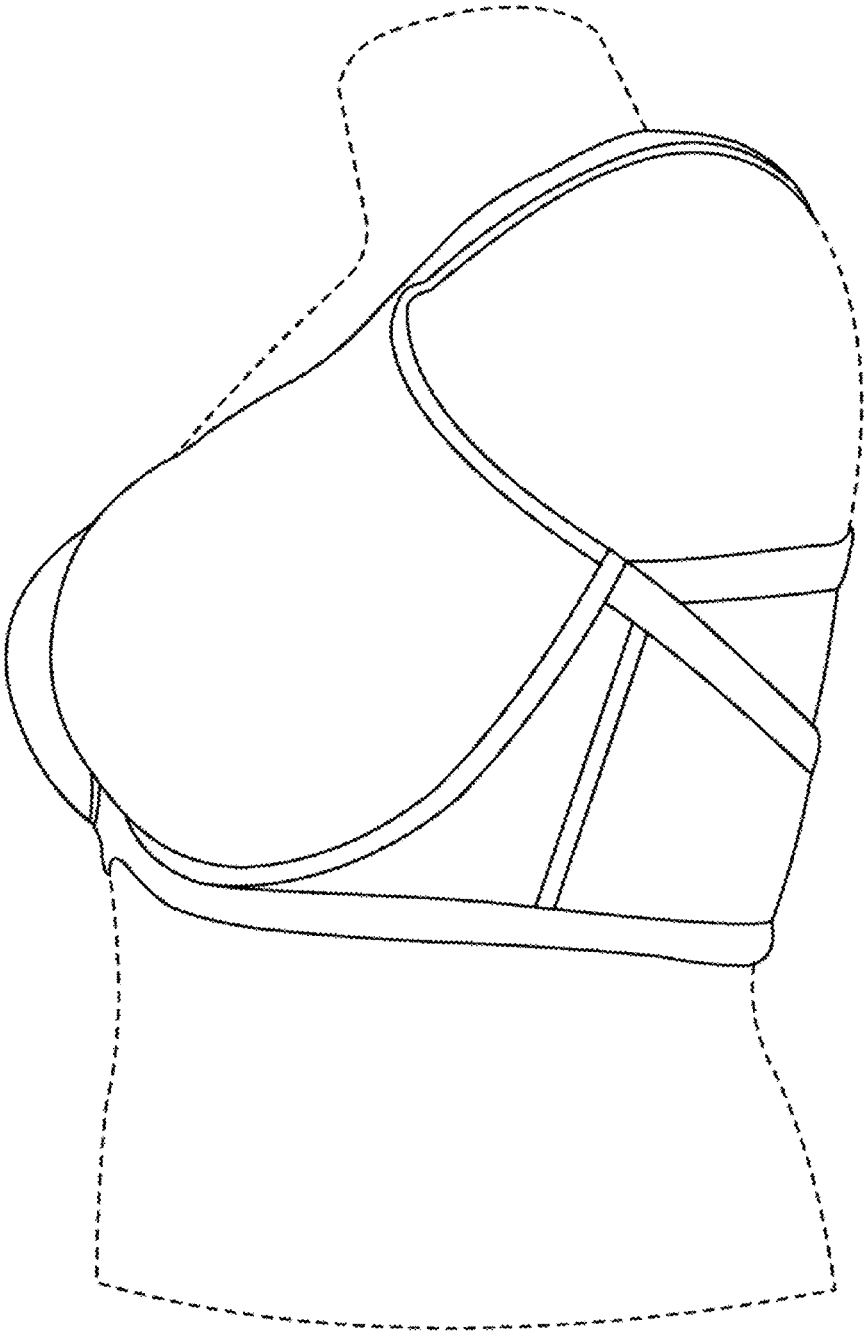
Figure 1G:
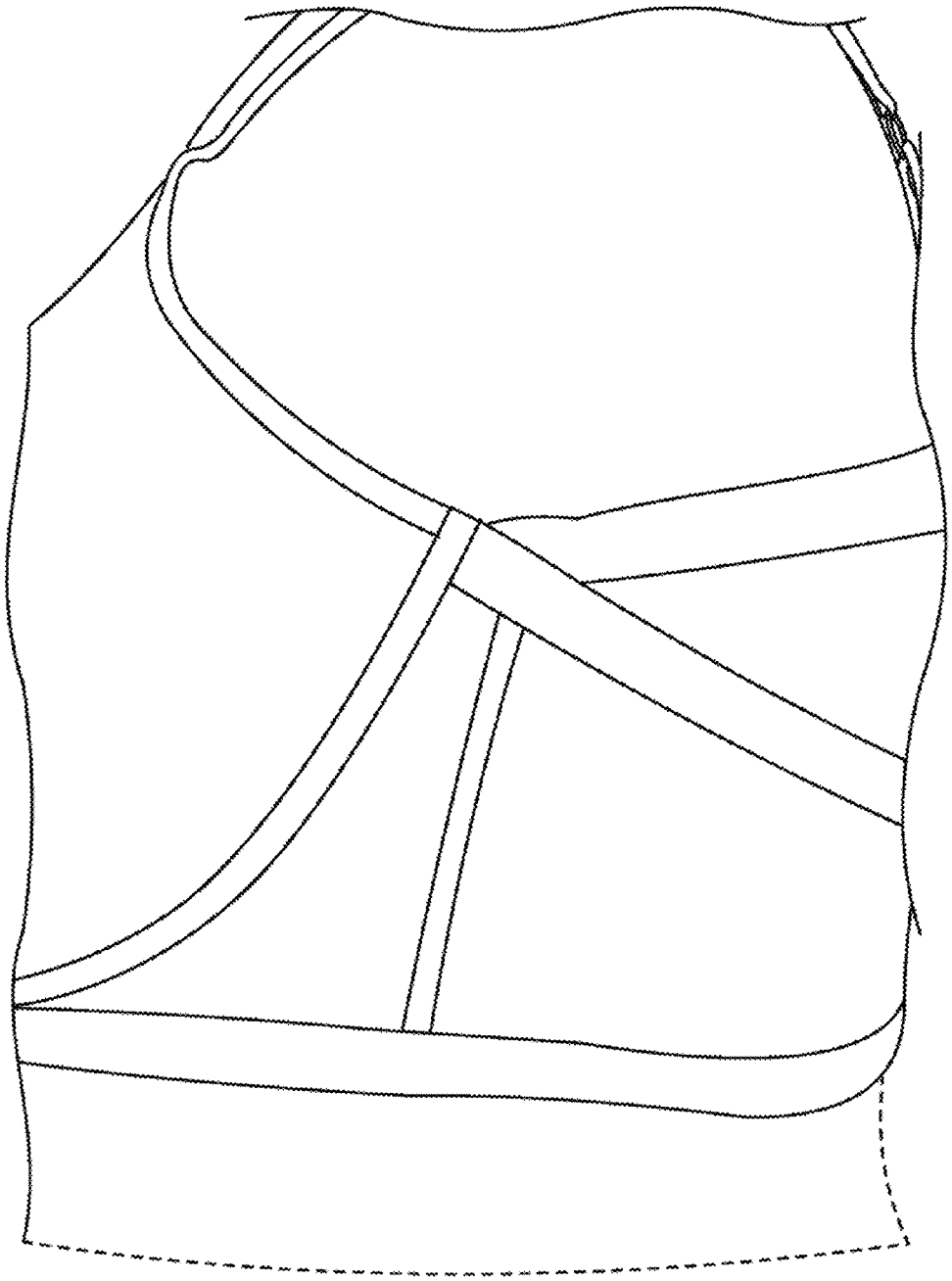
Figure 1H:
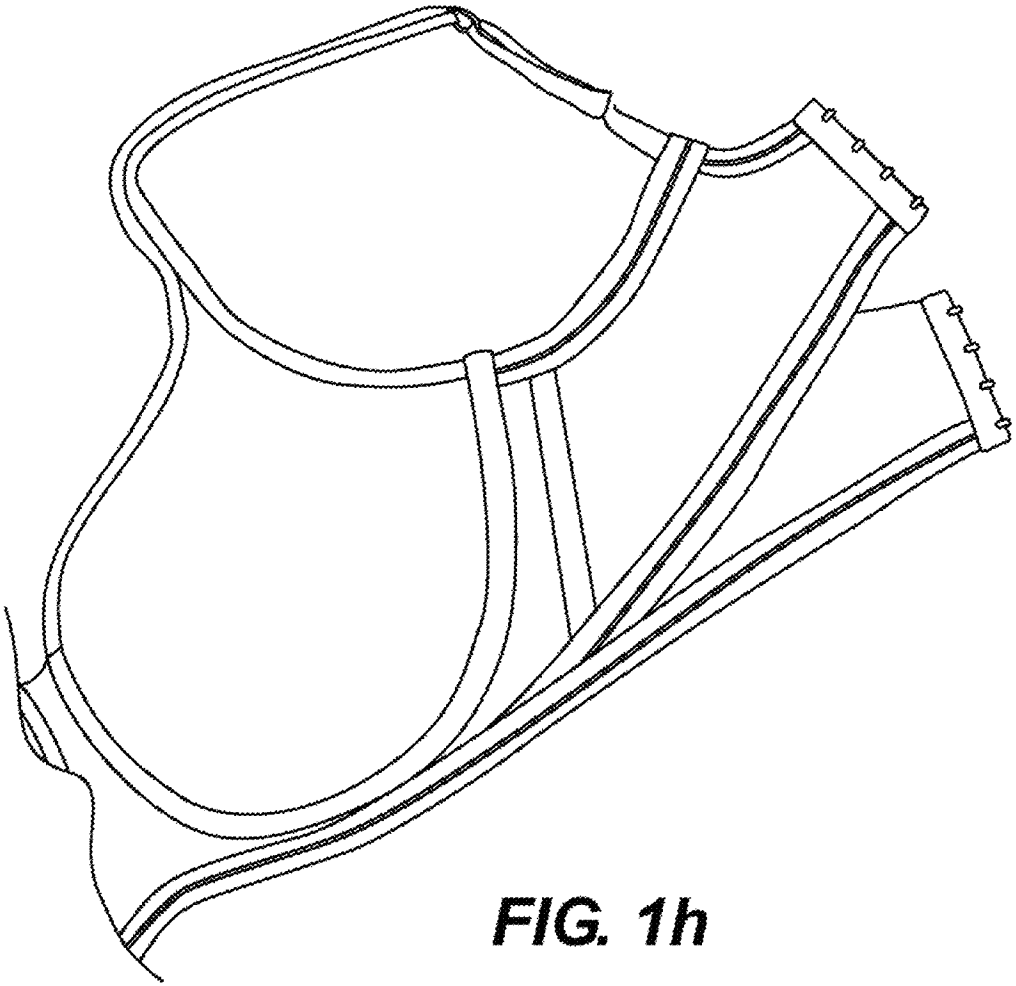
Figure 1I:
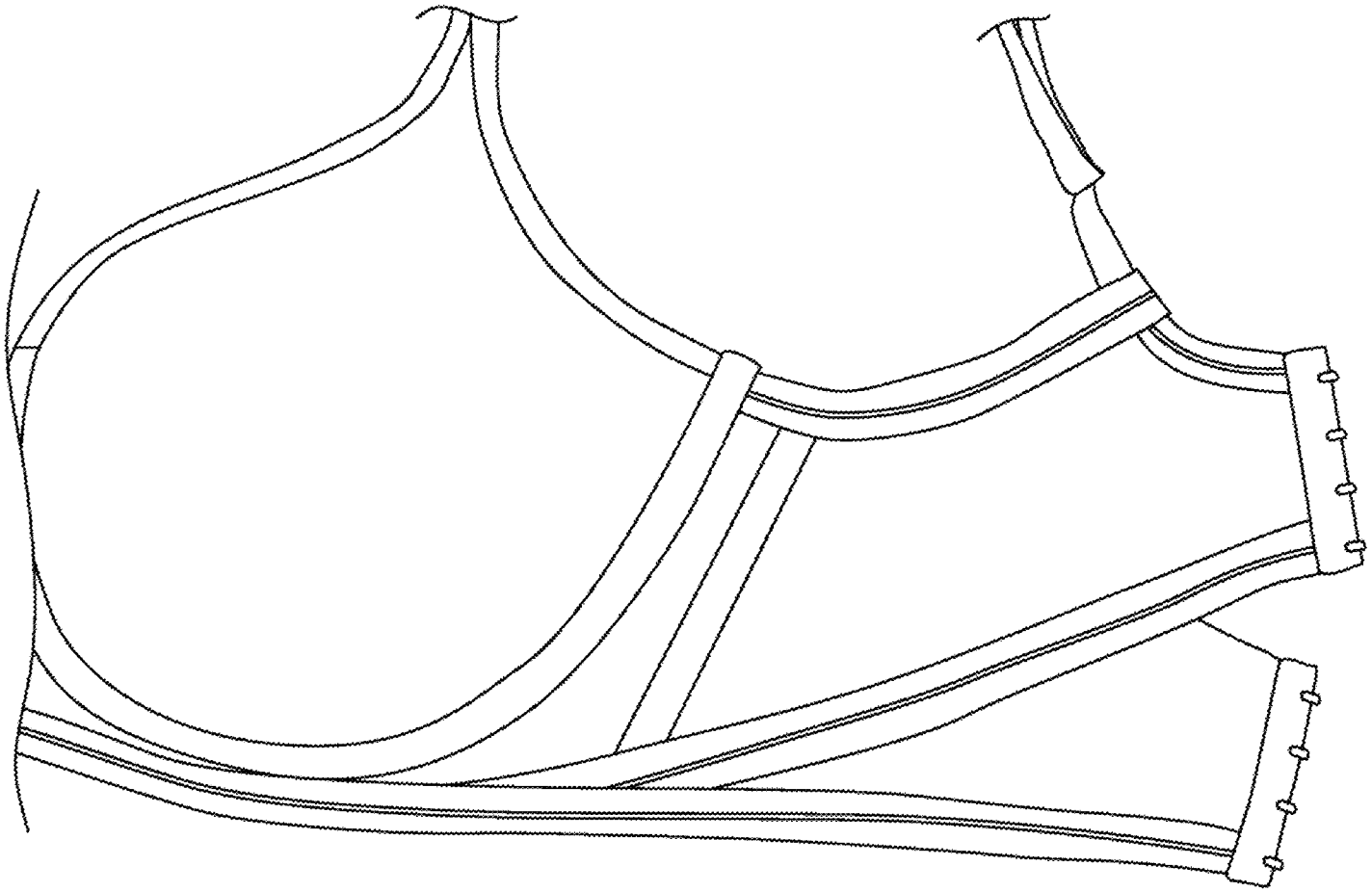
Figure 1J:
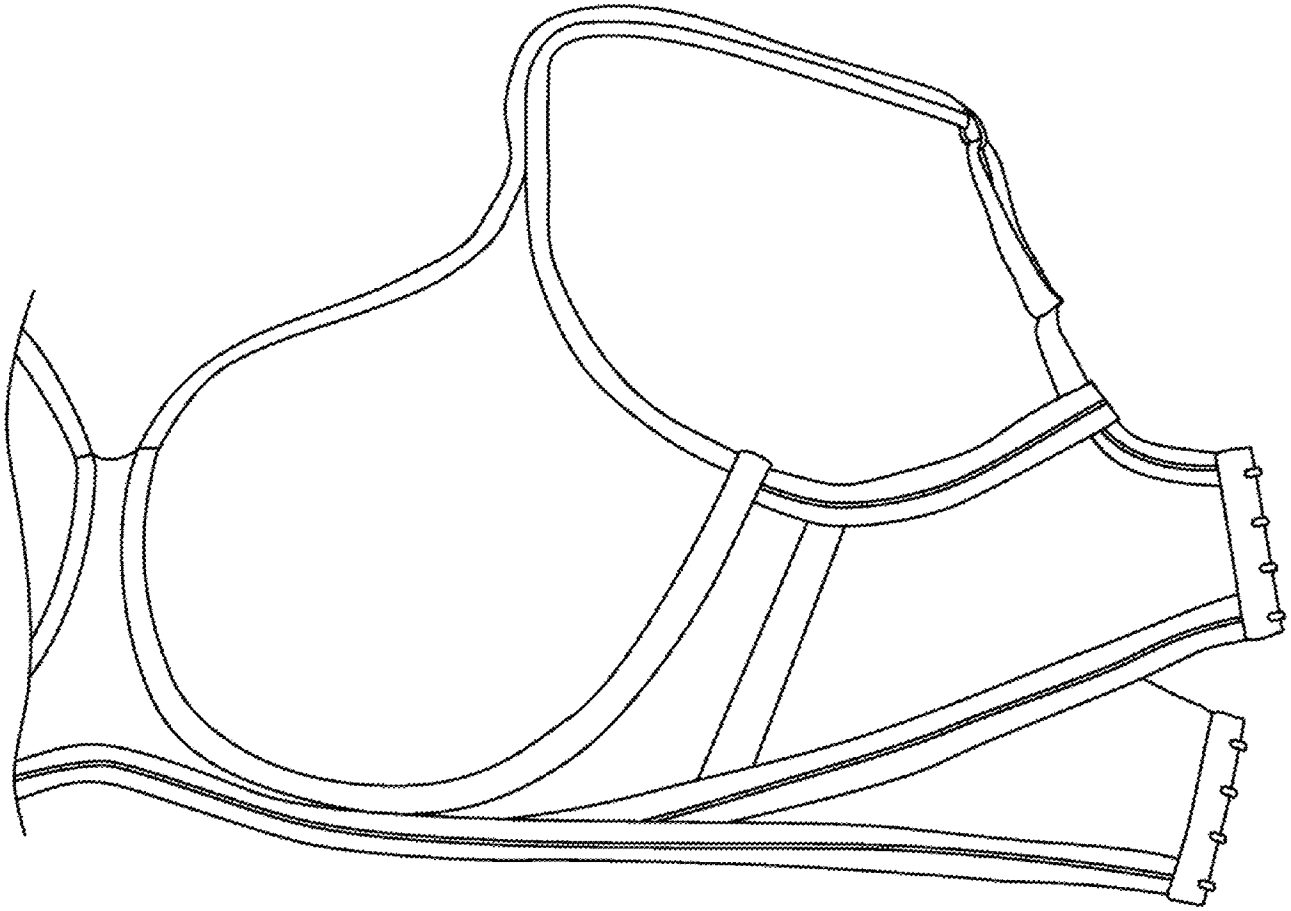
Figure 1K:
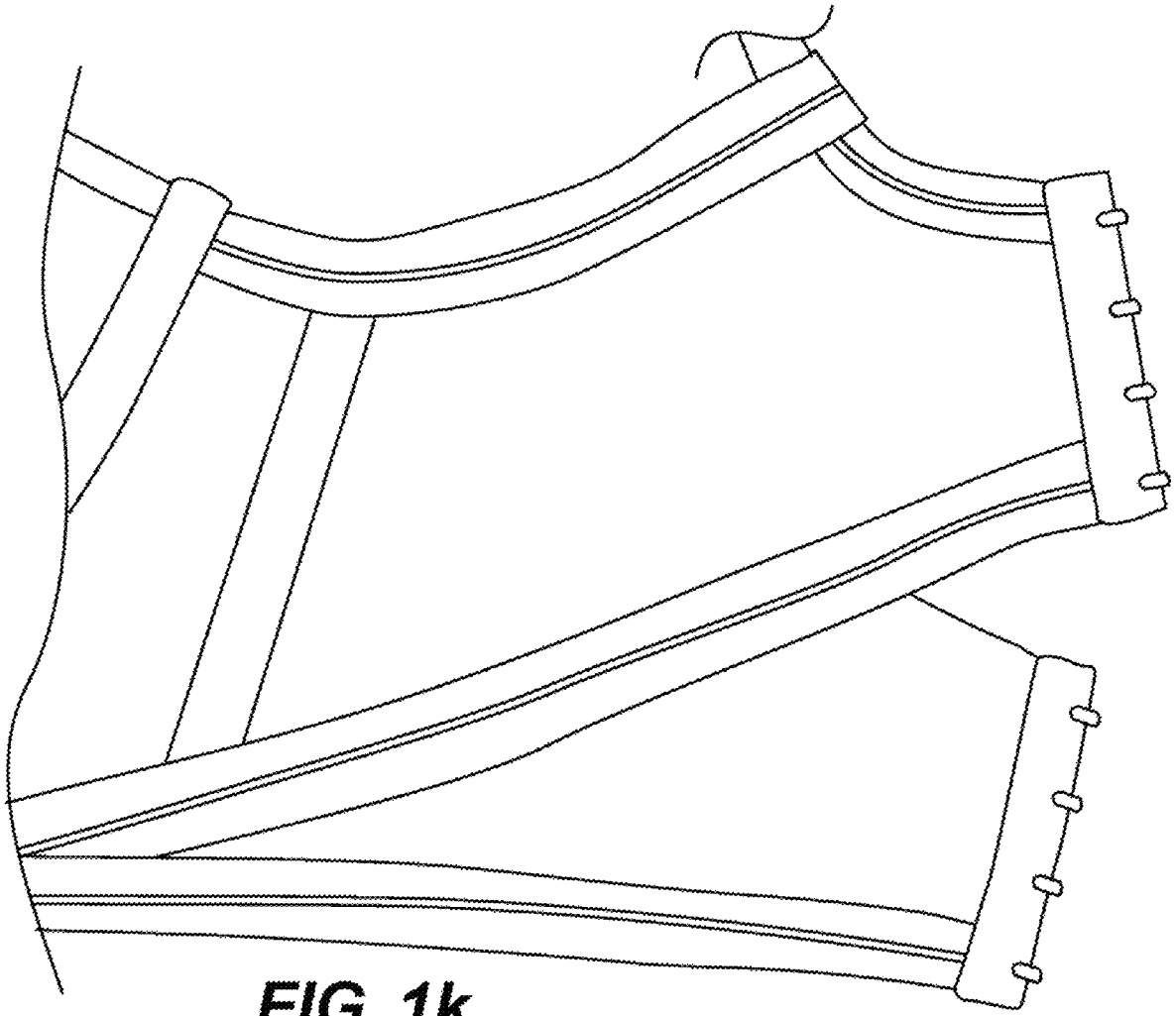
Figure 1I:
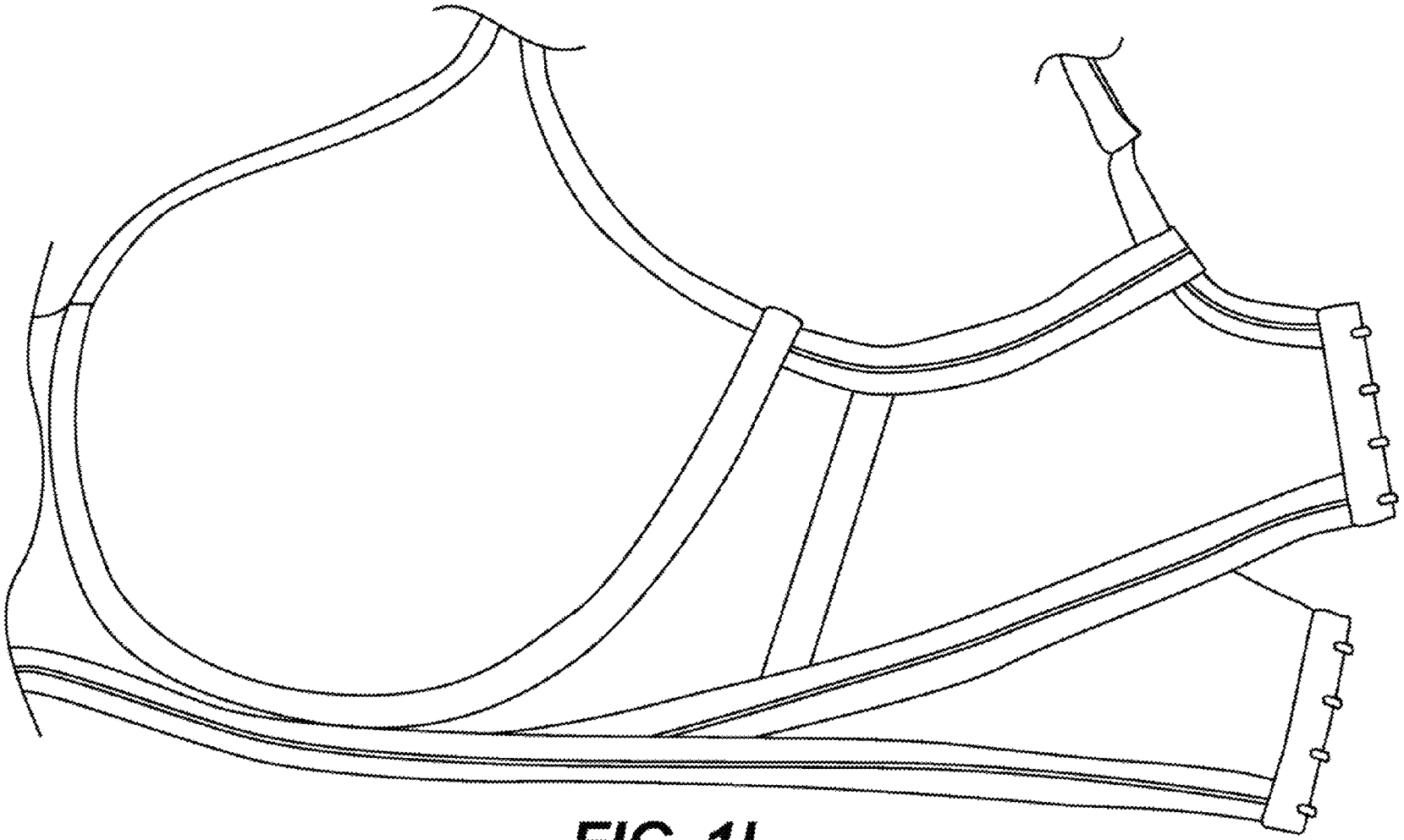
Figure 1M:
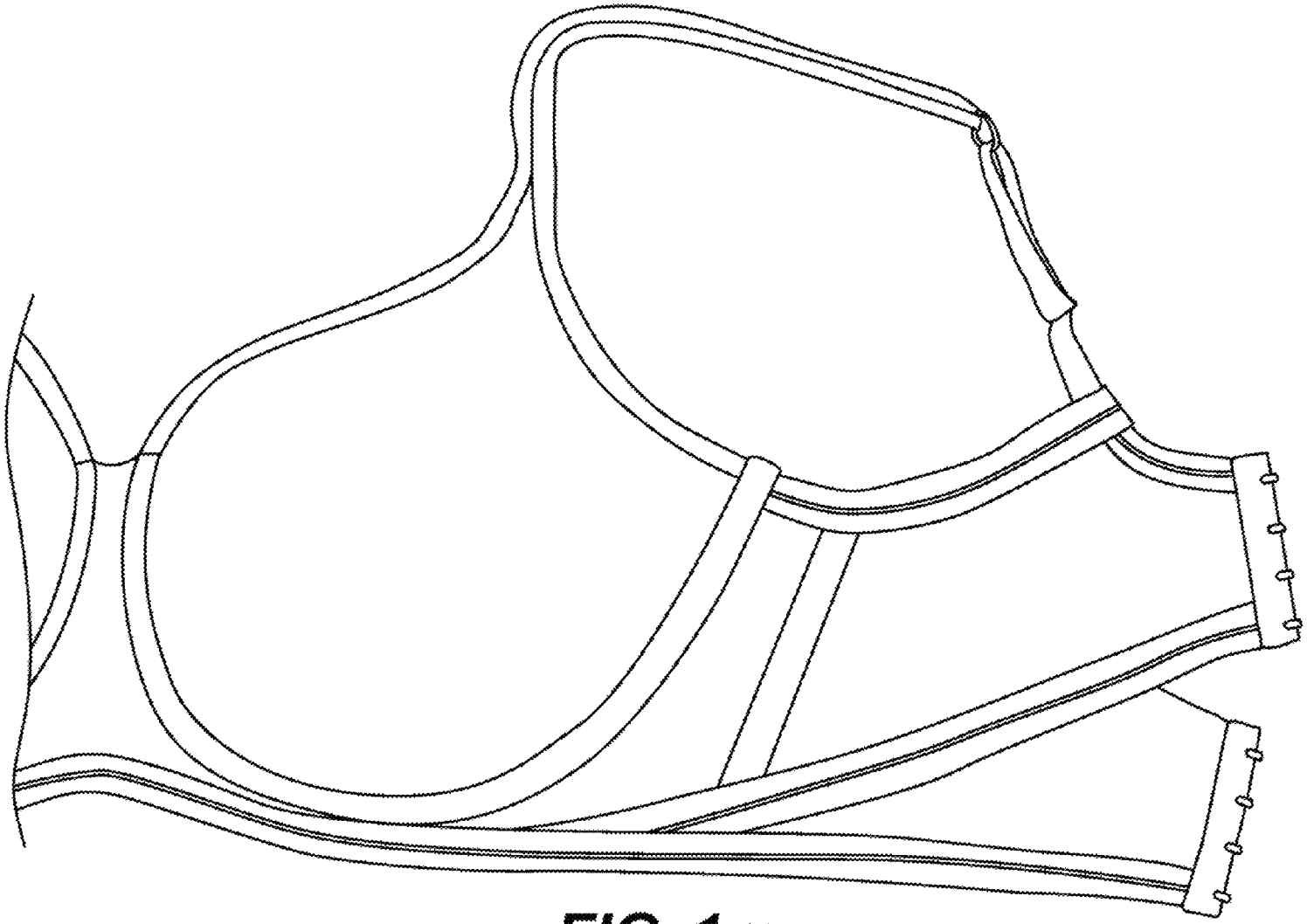
Figure 1N:
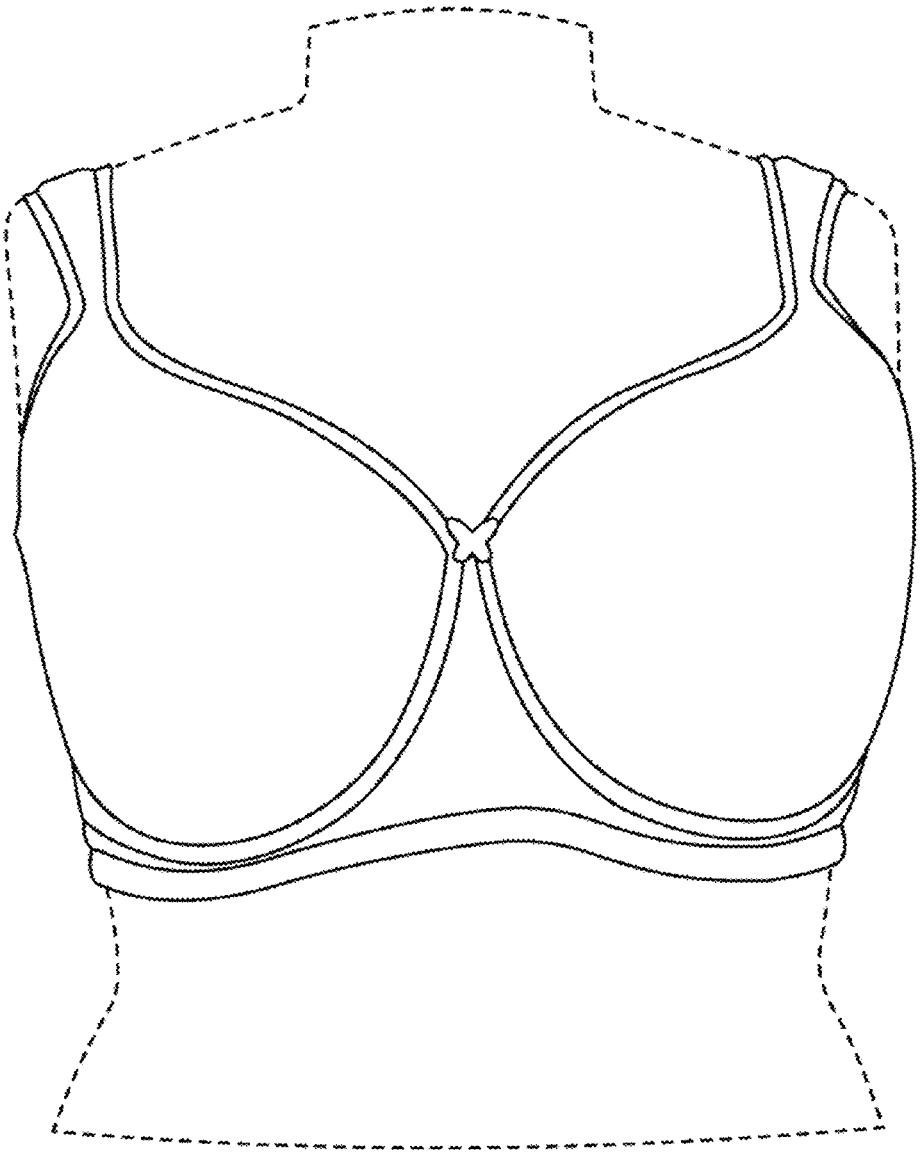
Figure 1O:
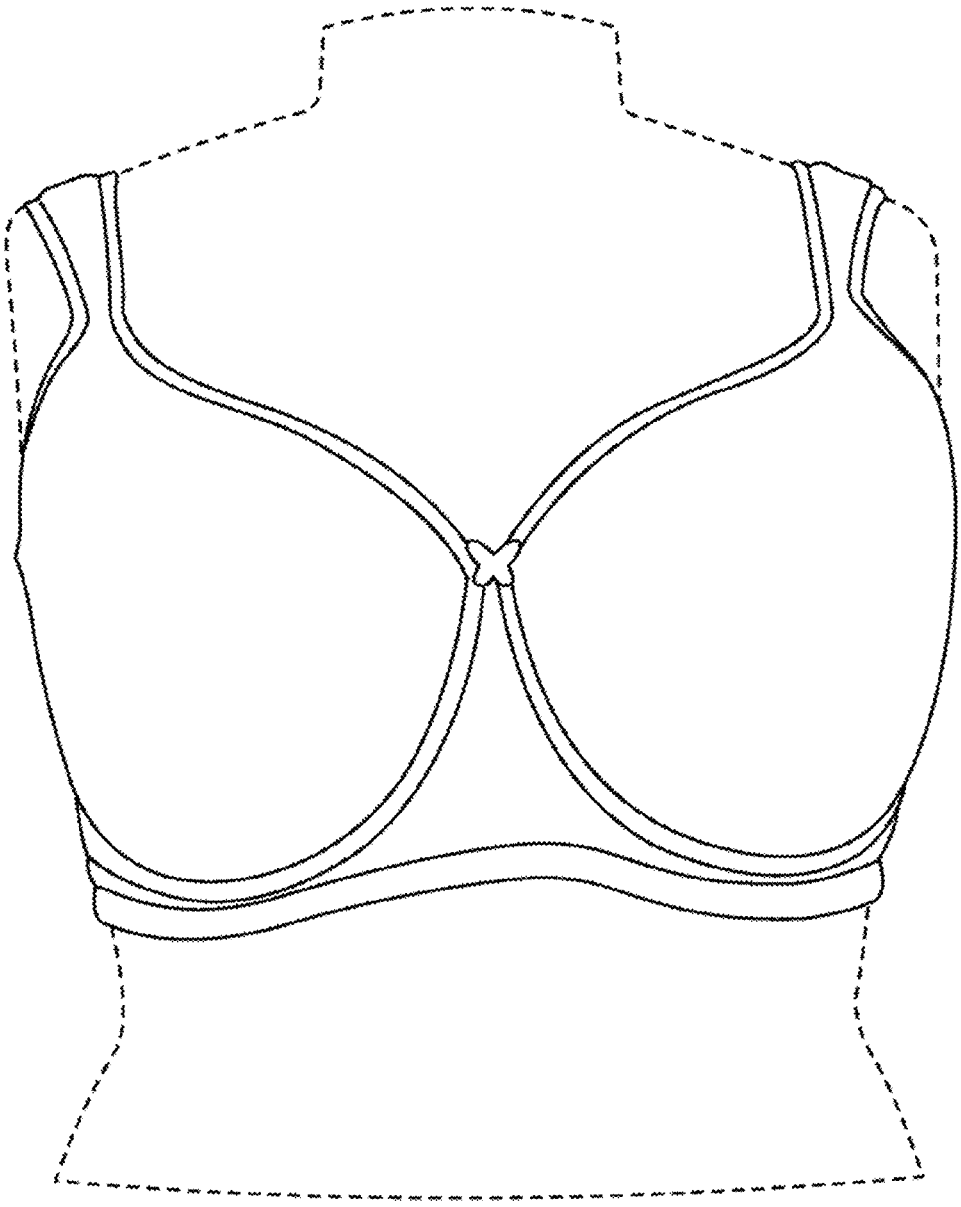
Figure 1P:
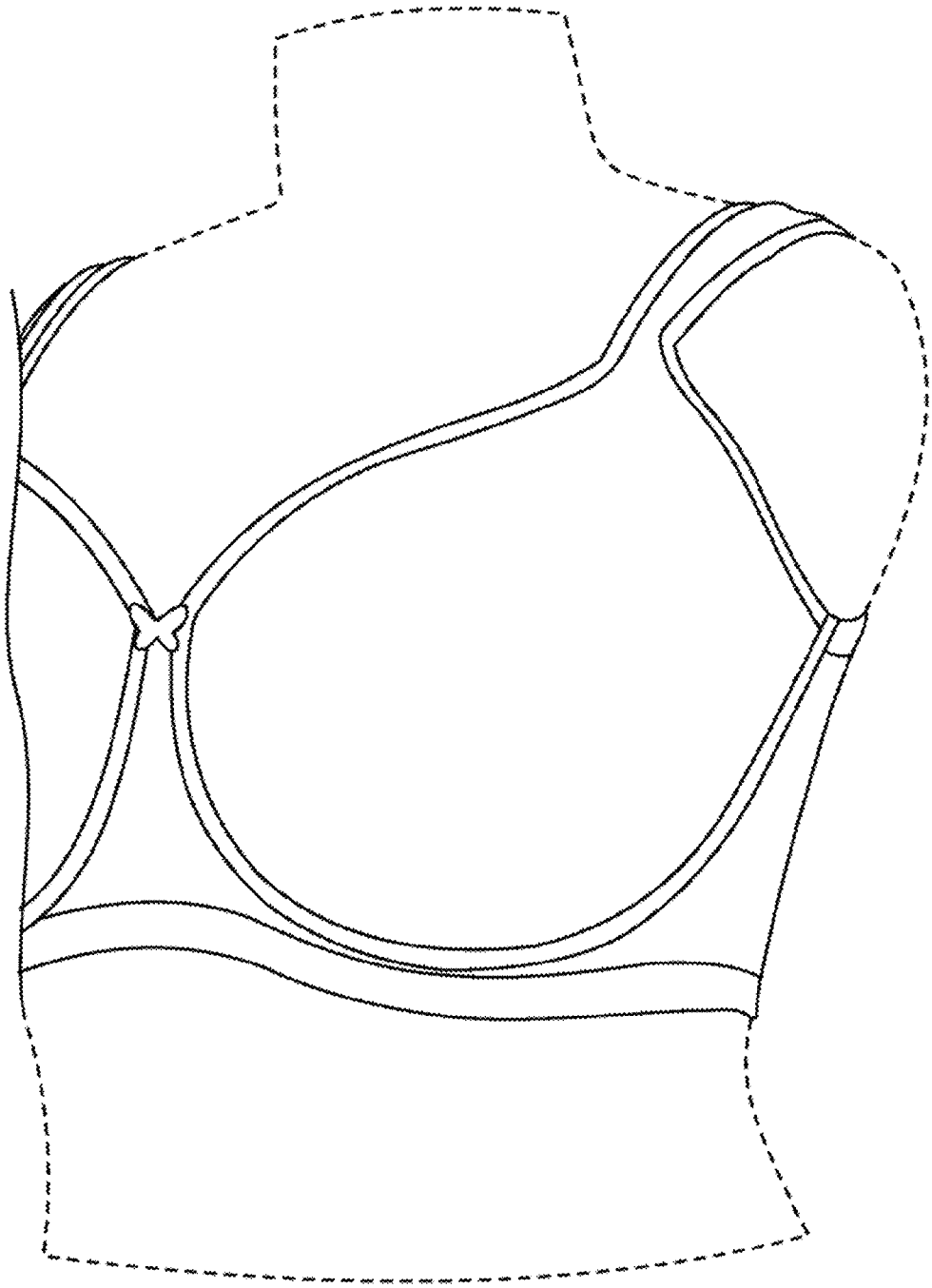
Figure 1Q:
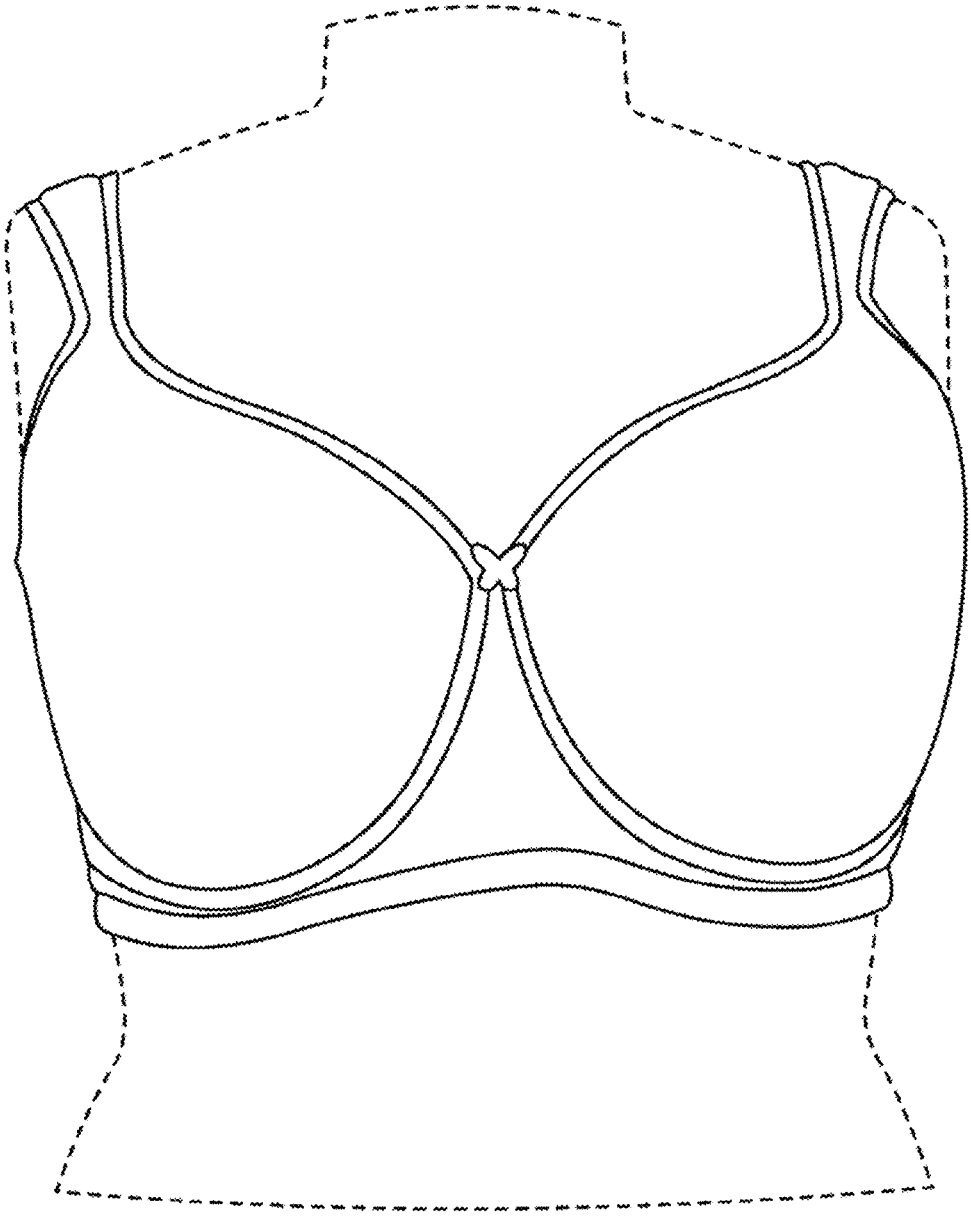
Figure 1R:
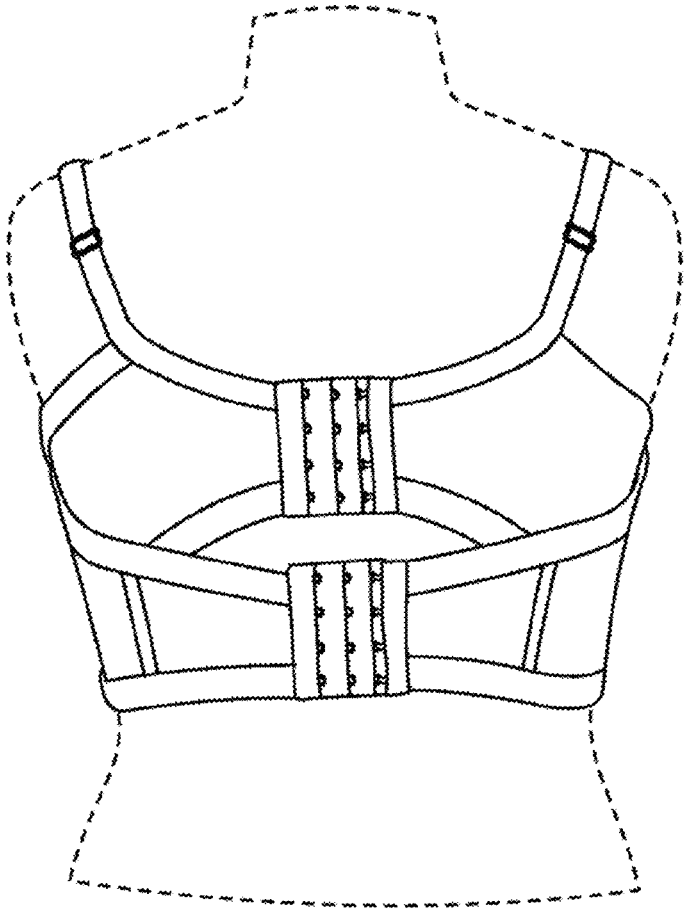
Figure 1S:
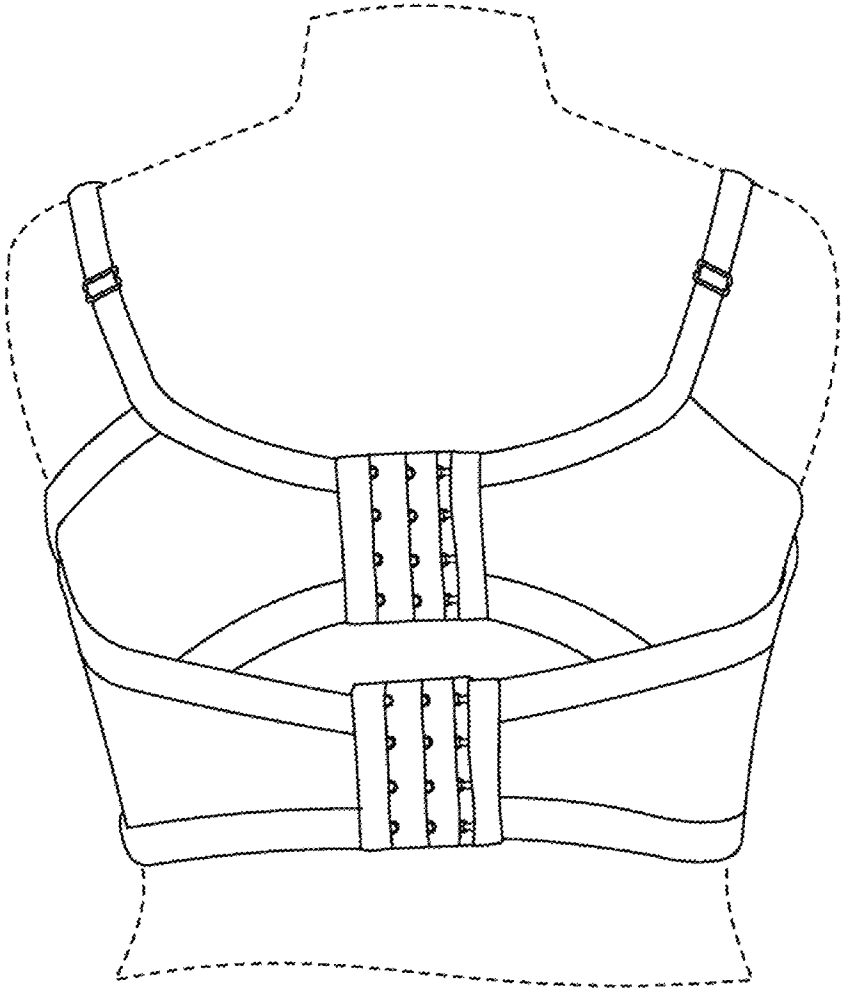
Figure 1T:
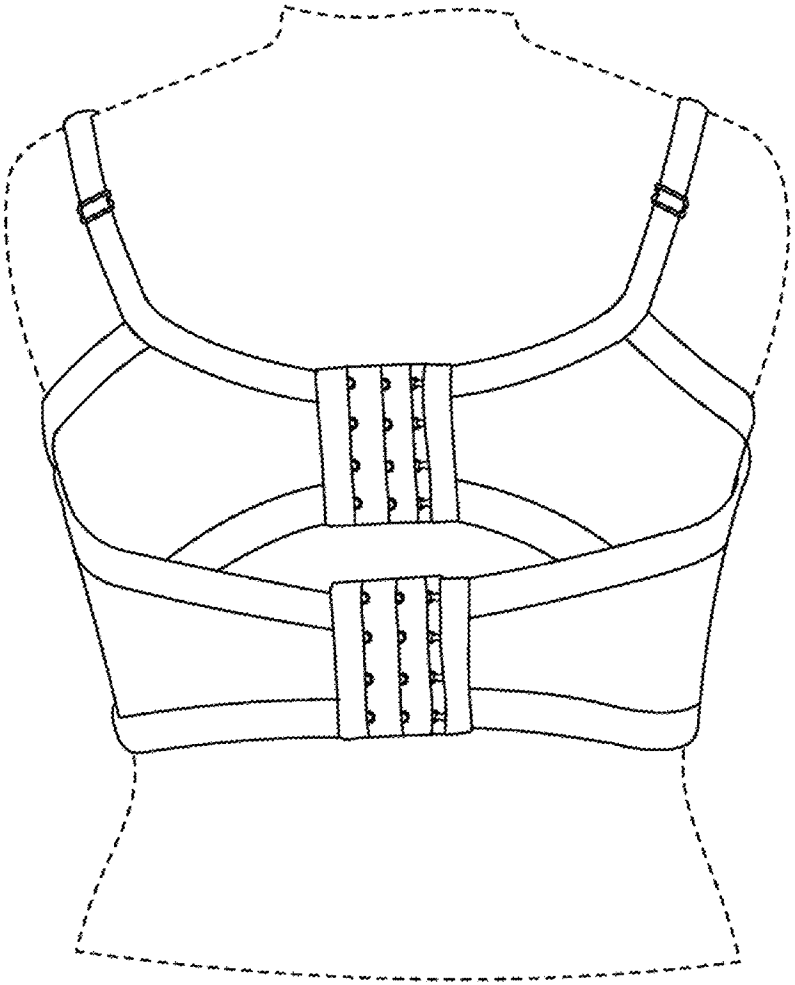
Figure 1U:
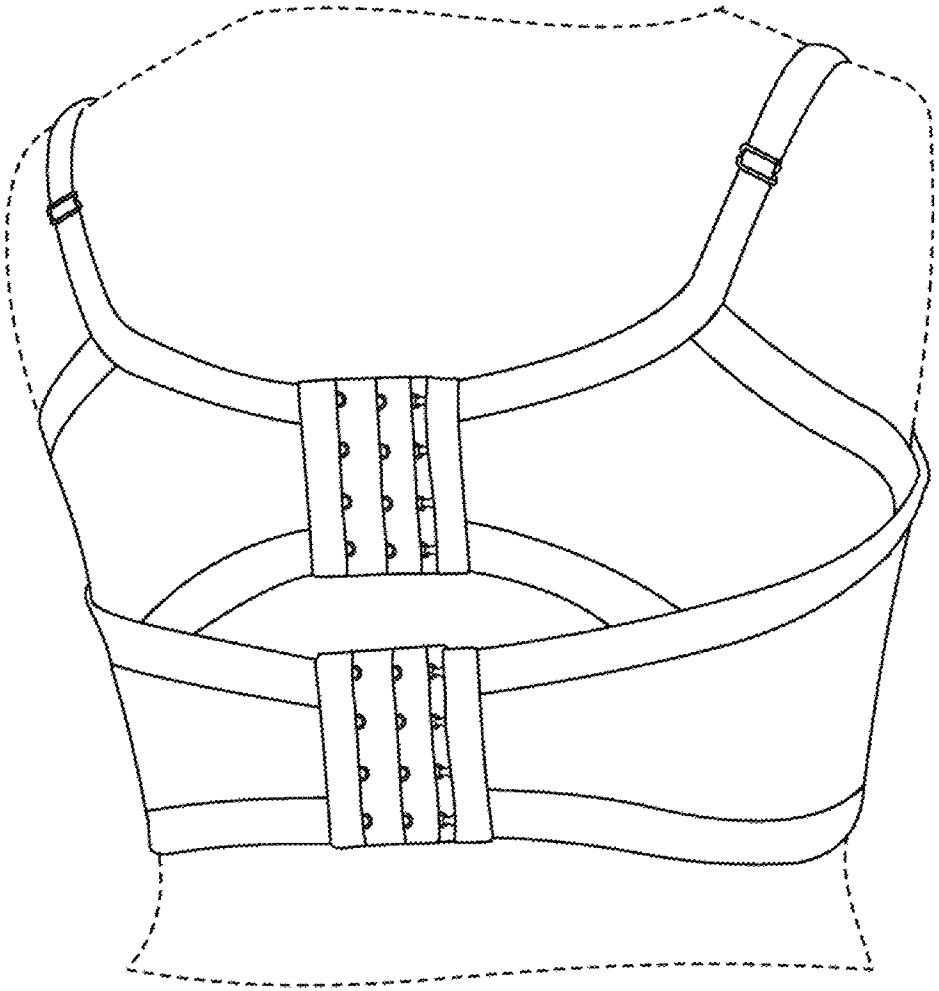
Figure 1V:
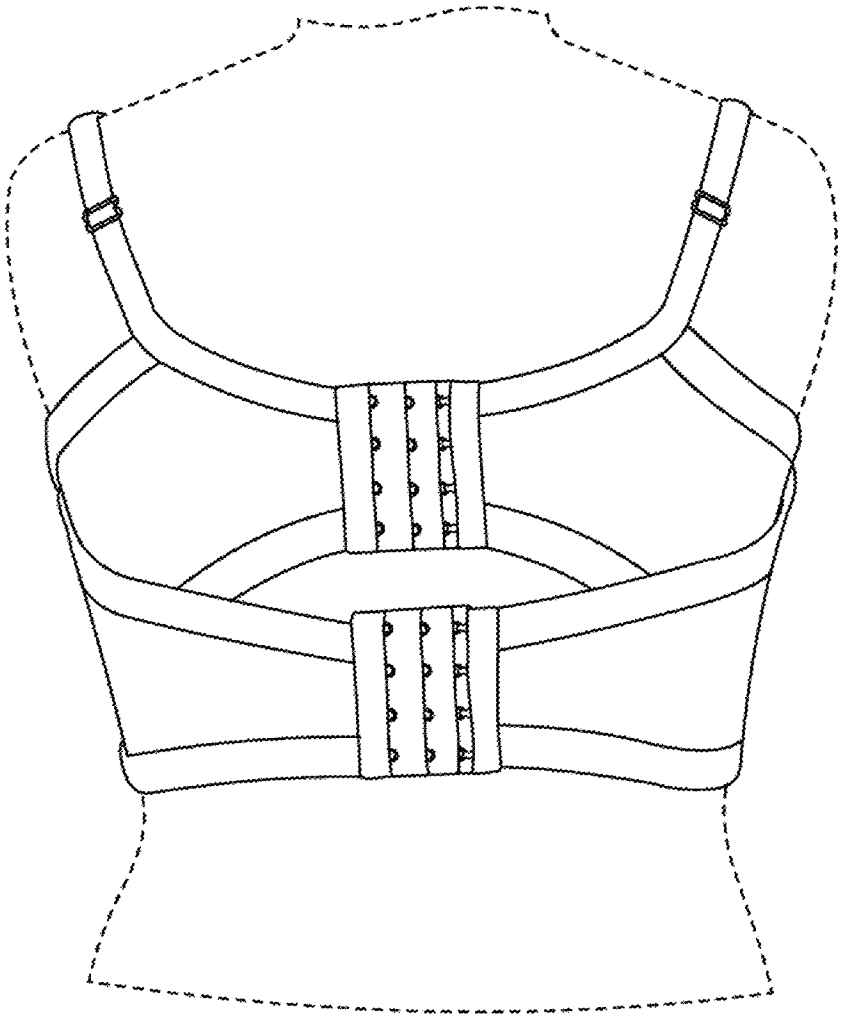
Figure 1W:
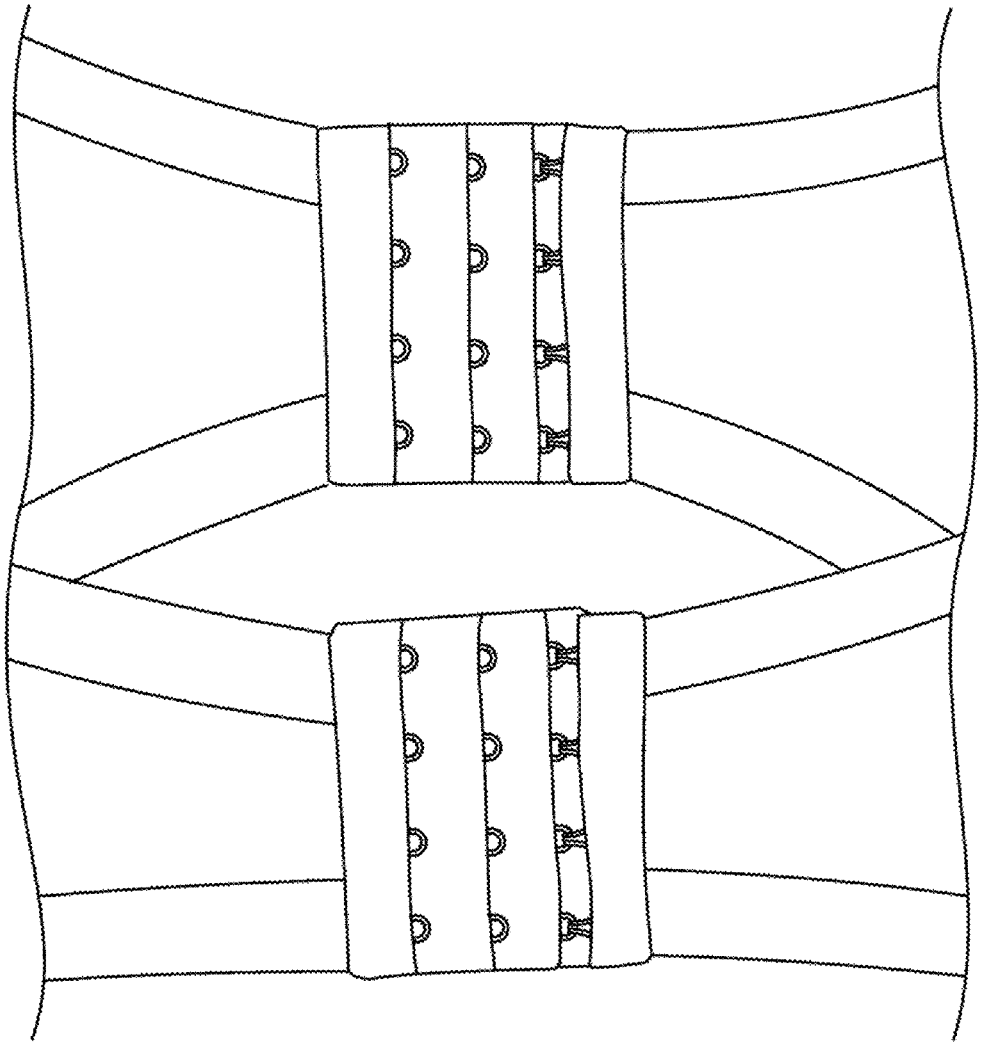
Figure 1X:
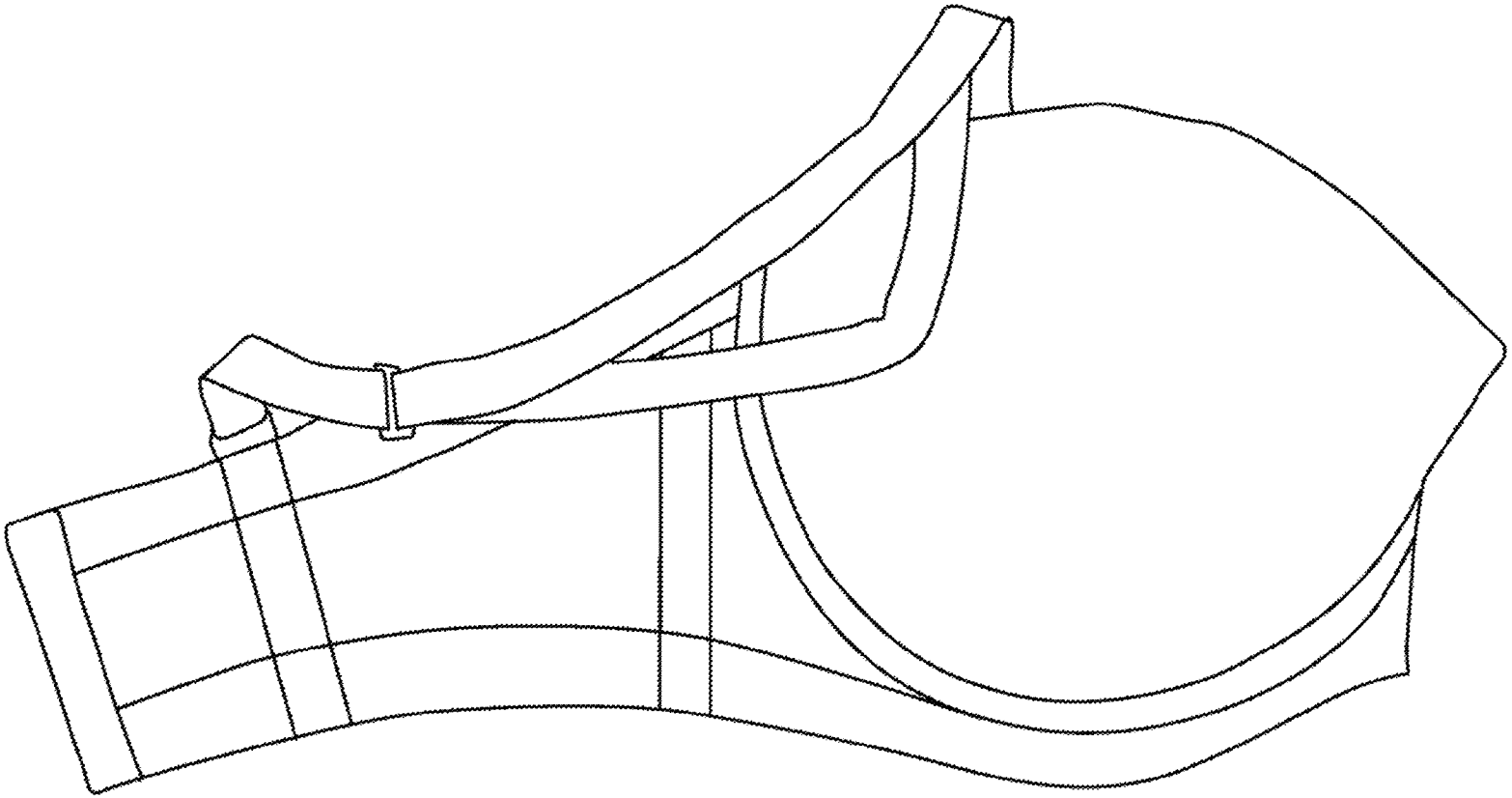
Figure 1Y:
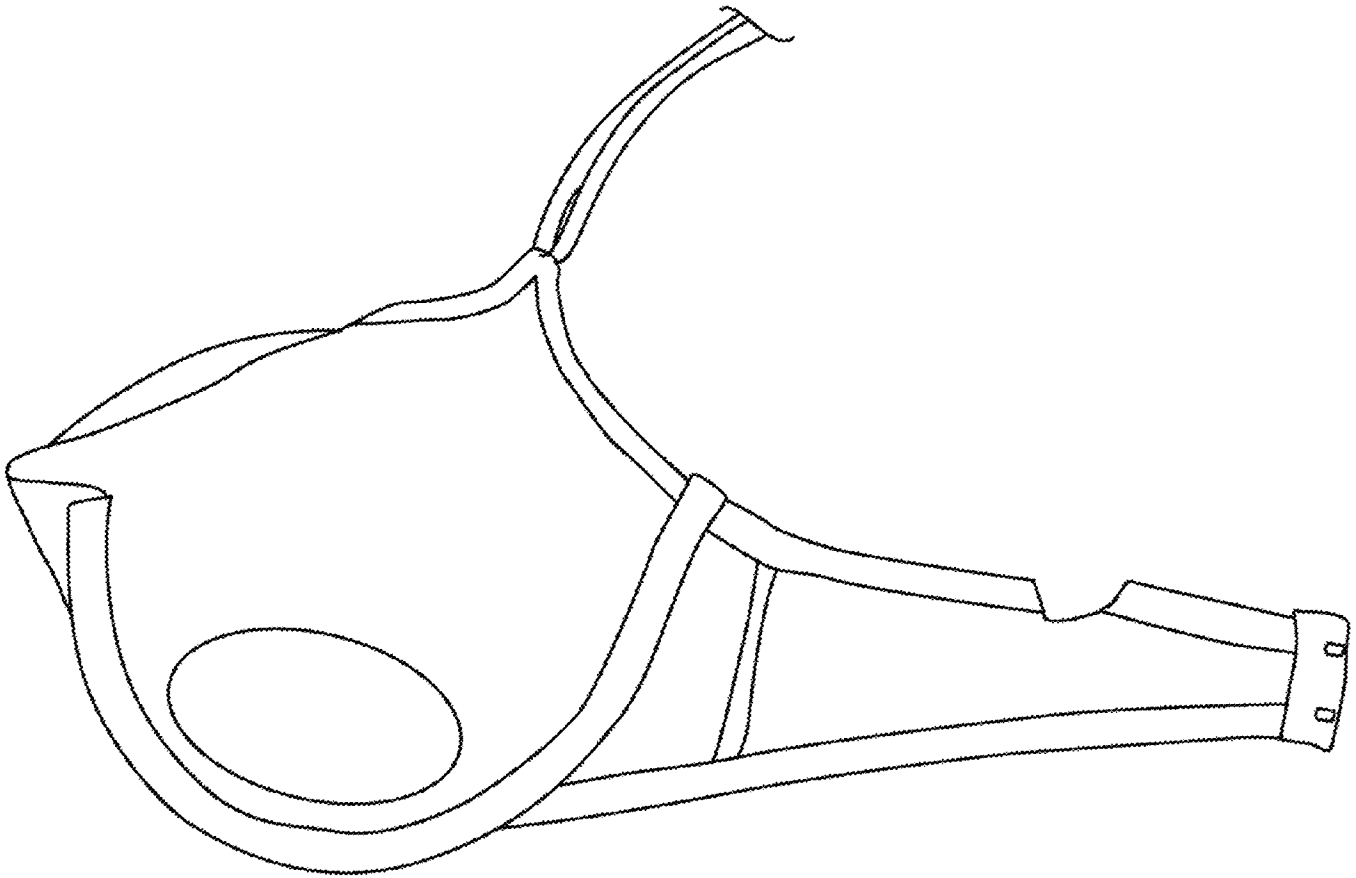
Figure 1Z:
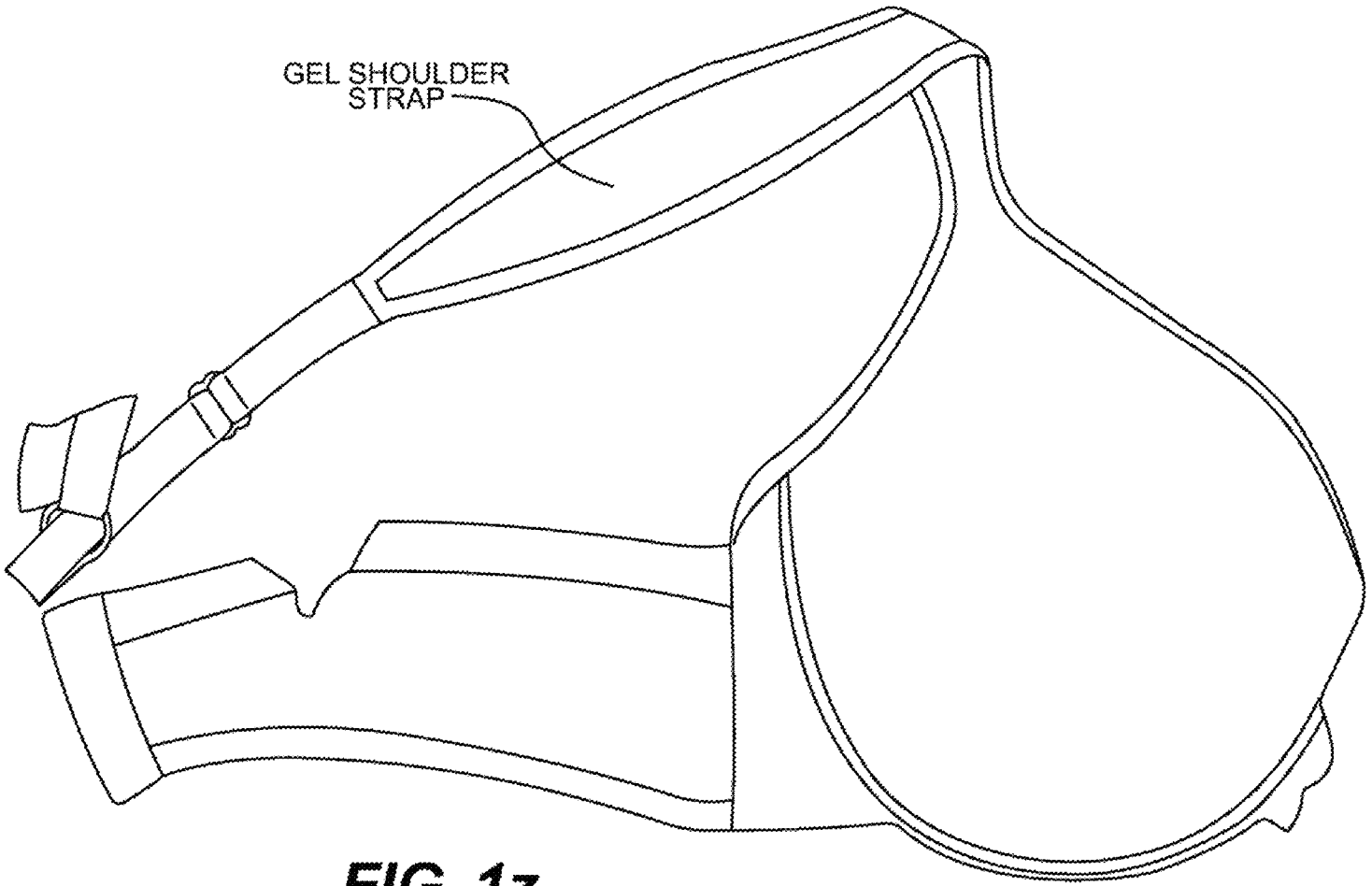
Figure 1A:
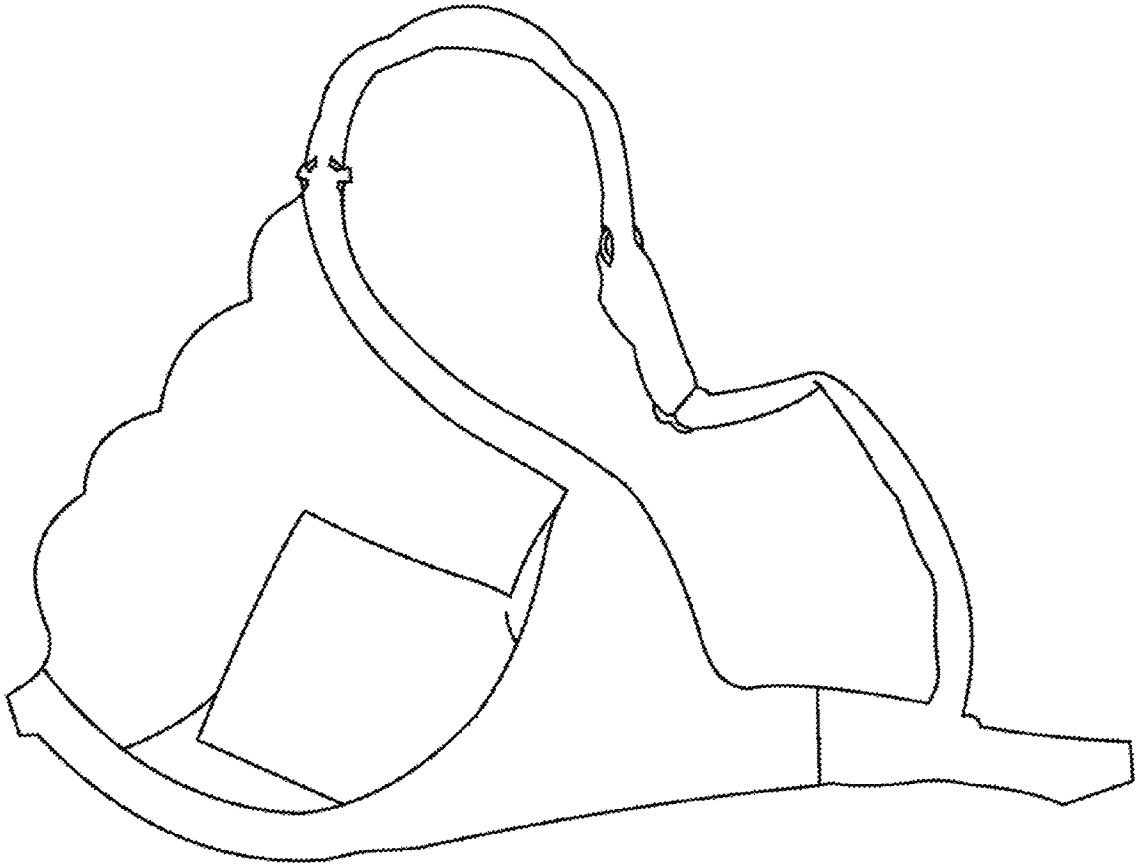
Figure 1B:
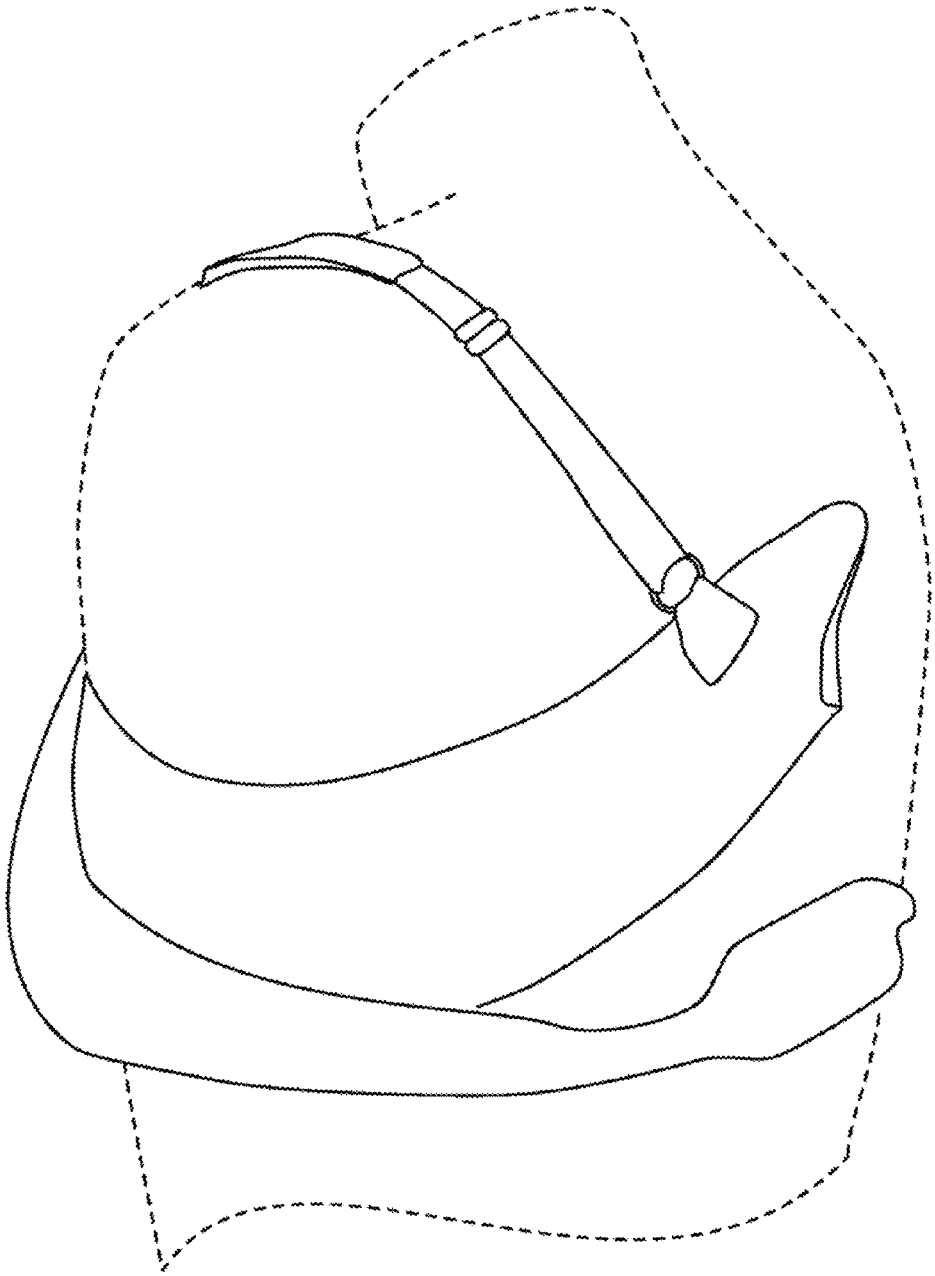
Figure 1C:
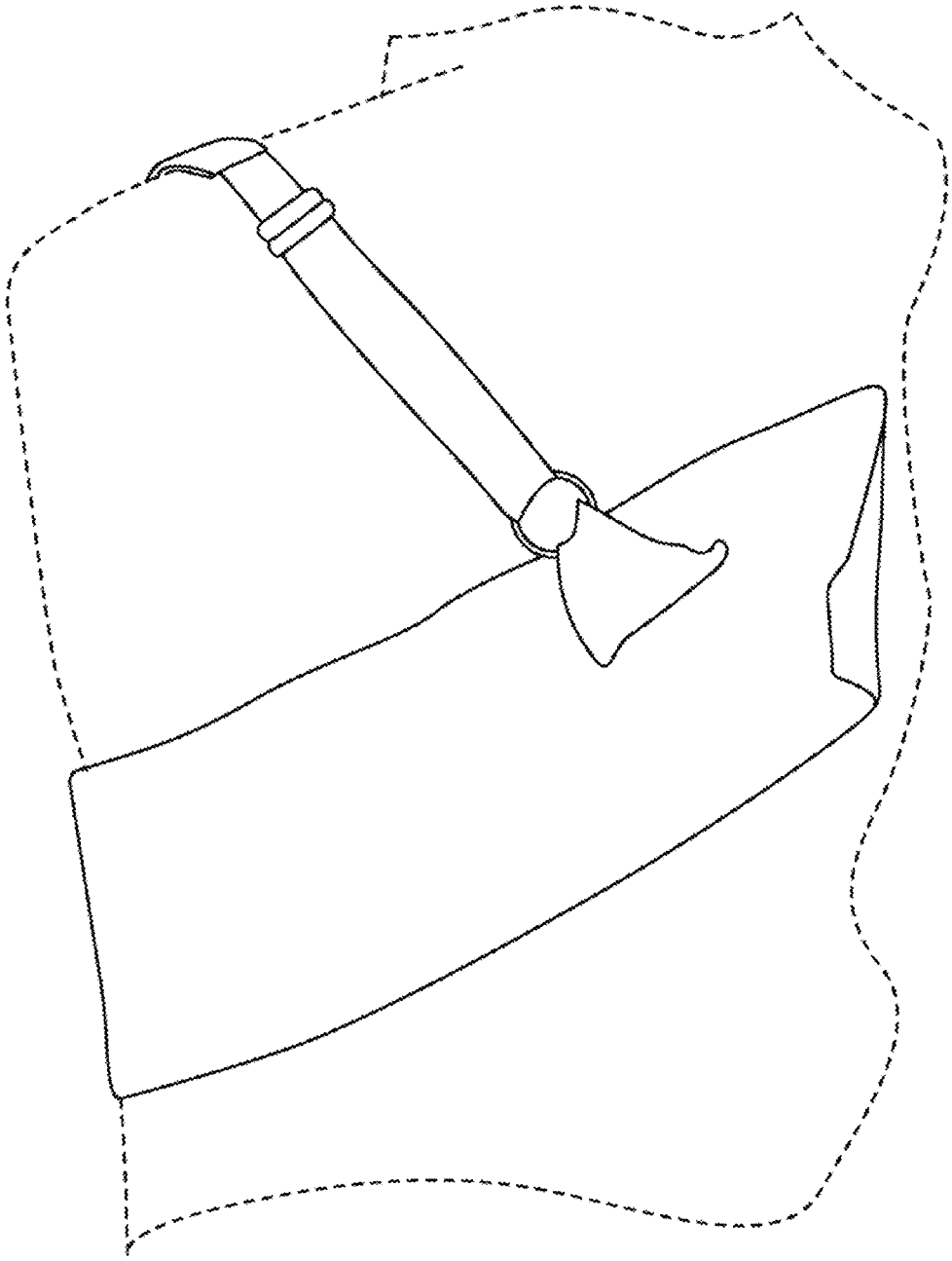
Figure 2A:
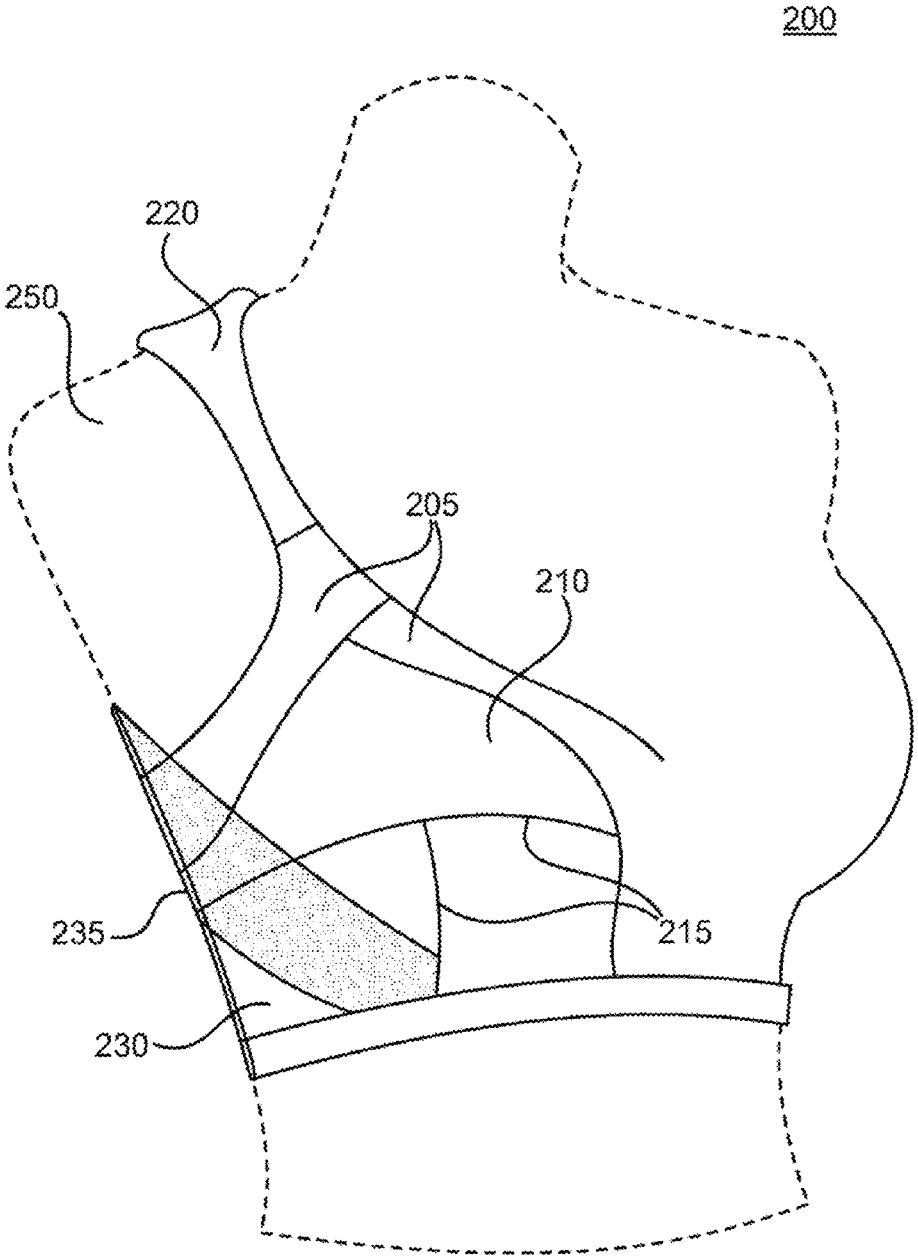
FIGS. 2(*a*)-2(*q*) illustrate another exemplary embodiment of the invention.
Figure 2B:
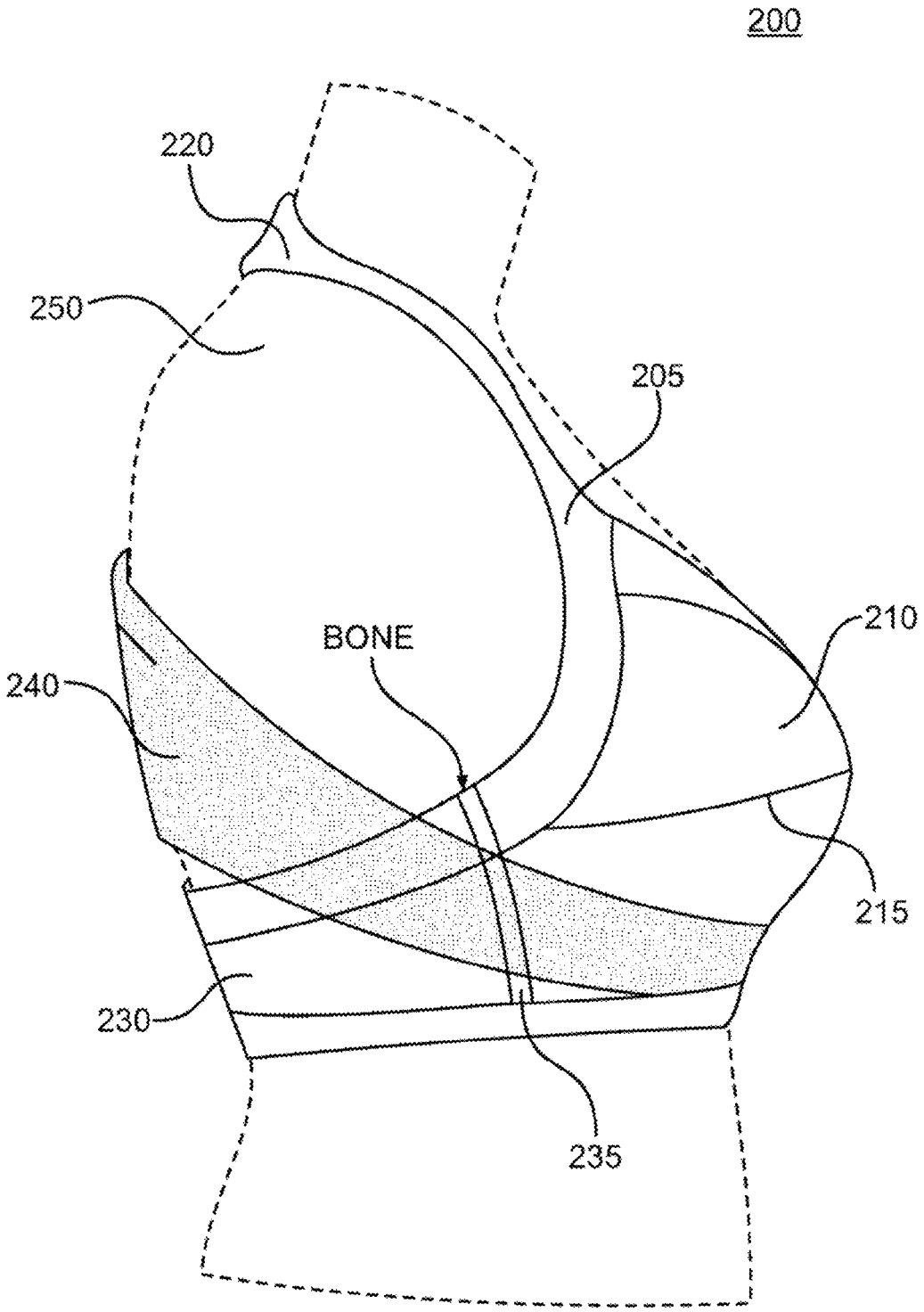
Figure 2C:
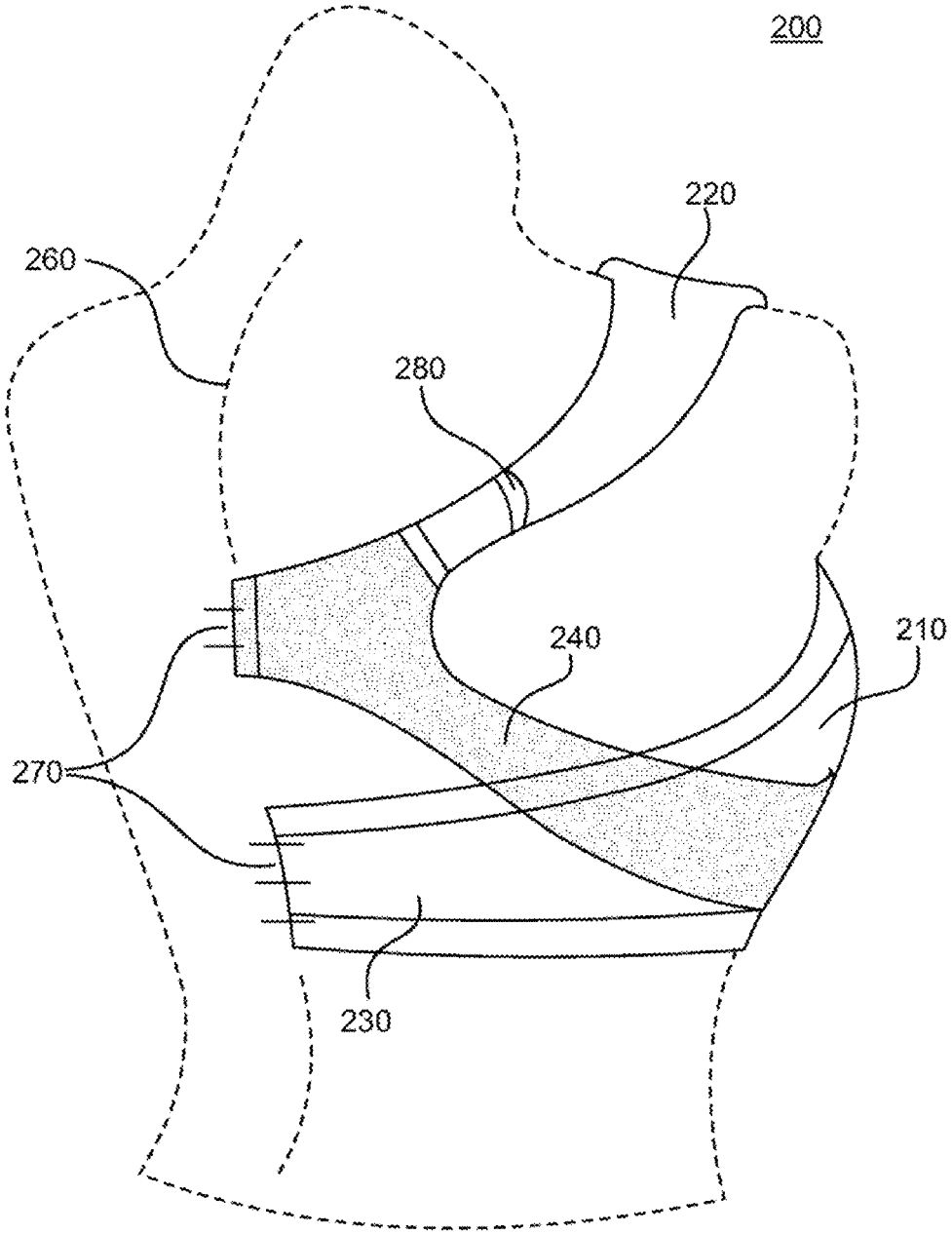
Figure 2D:
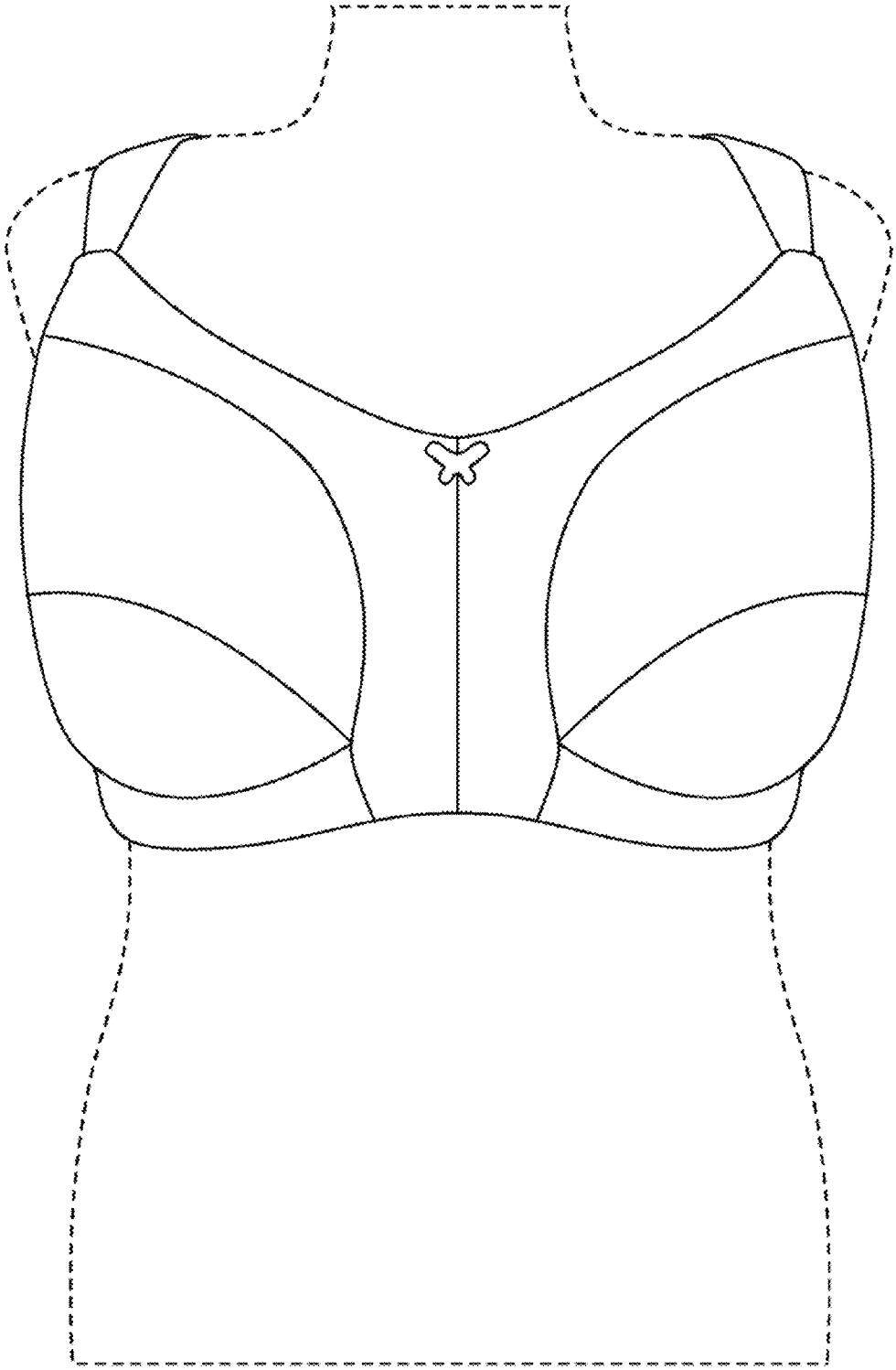
Figure 2E:
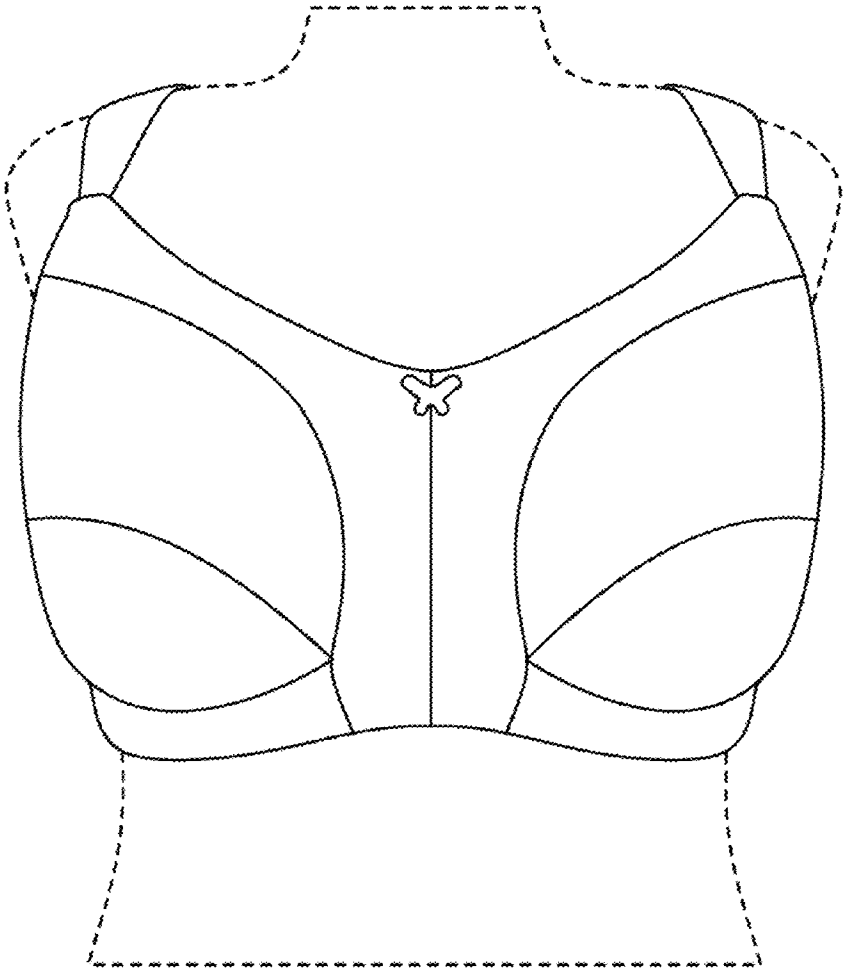
Figure 2F:
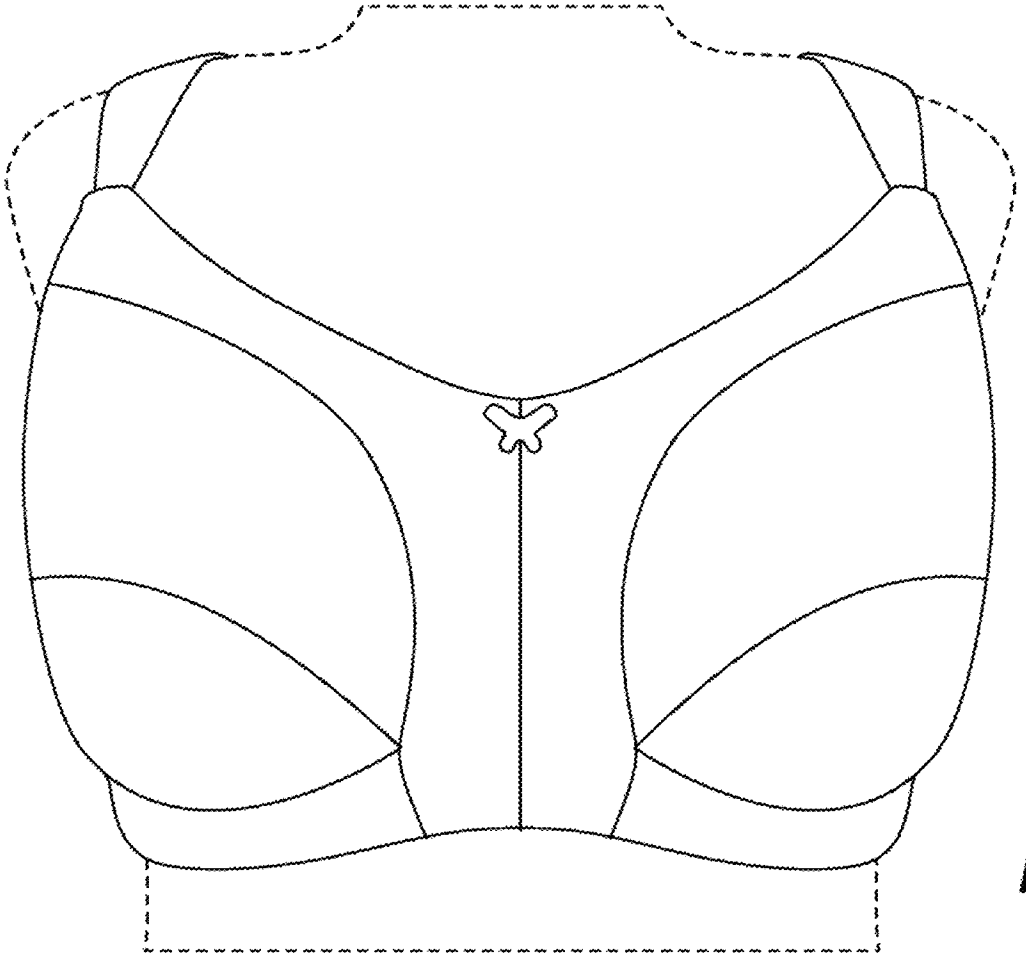
Figure 2G:
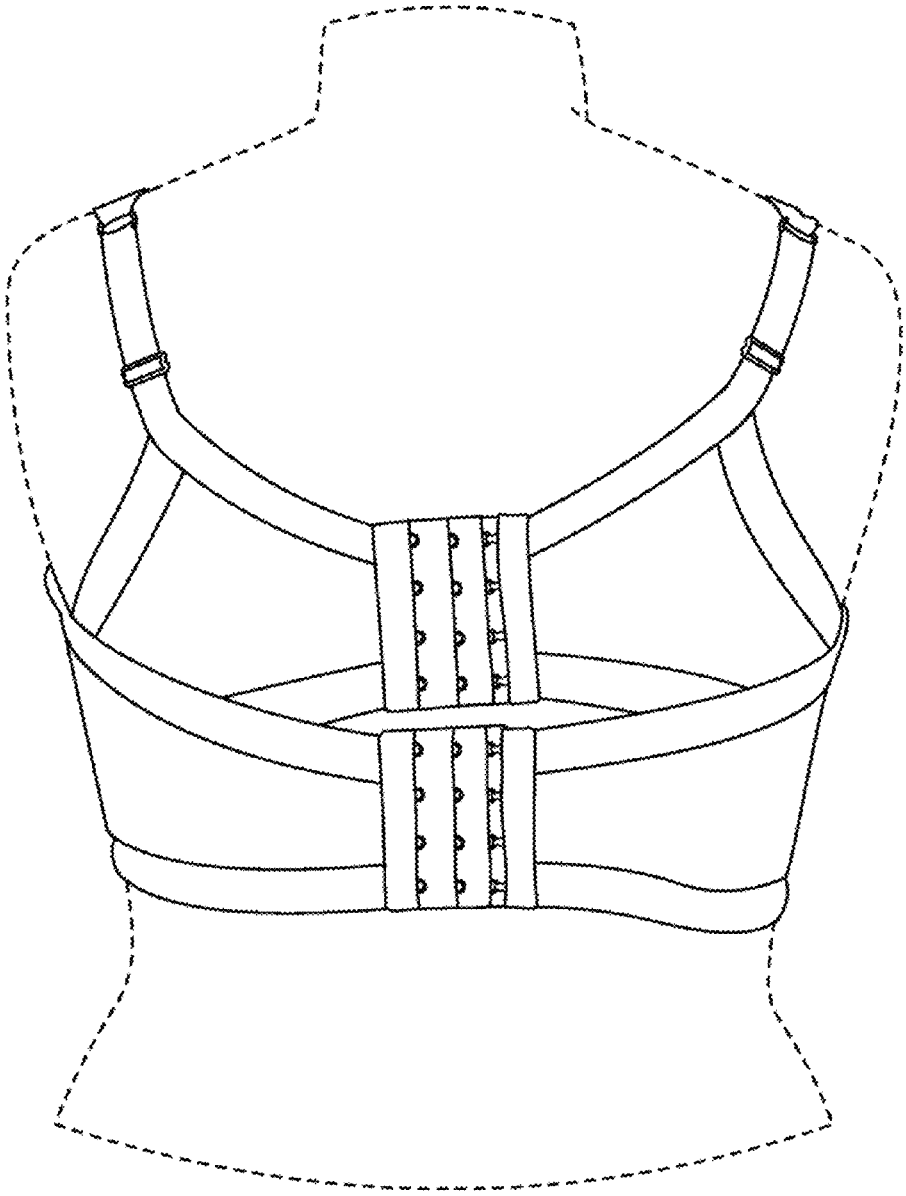
Figure 2H:
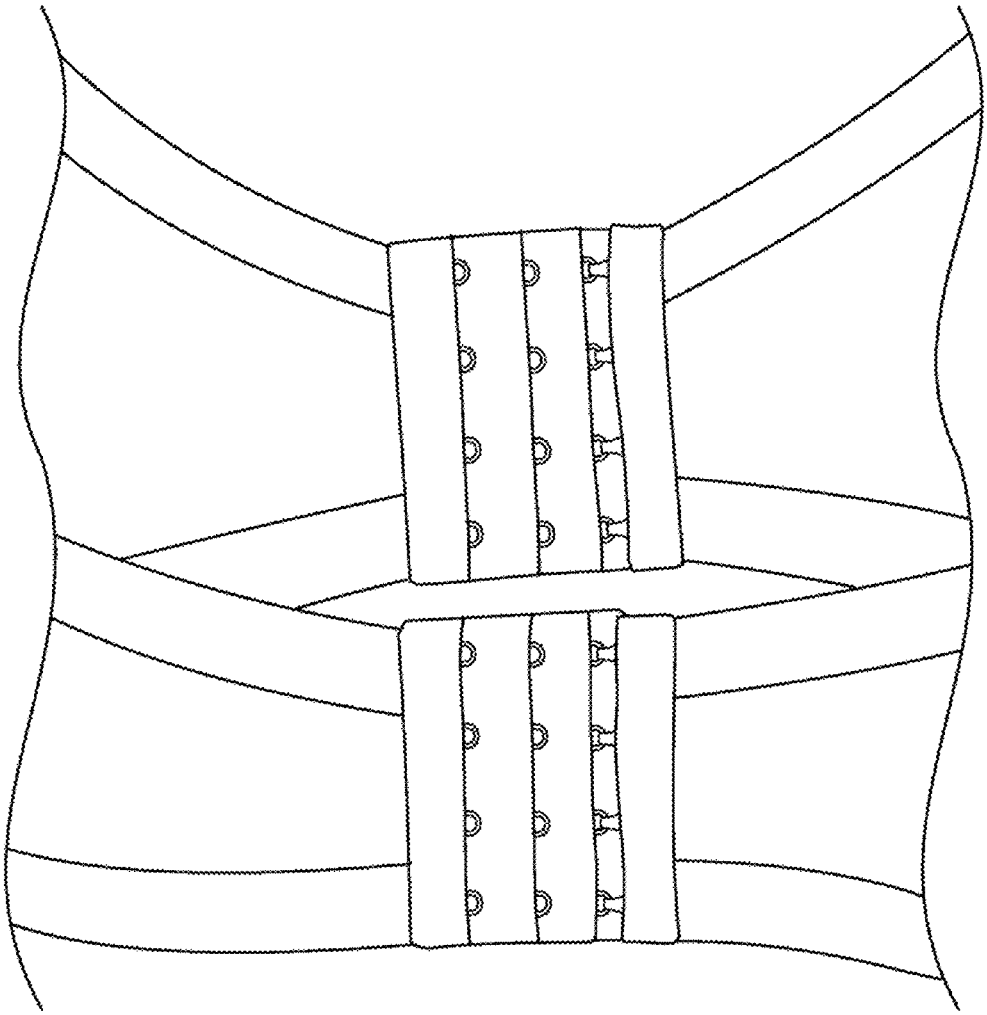
Figure 2I:
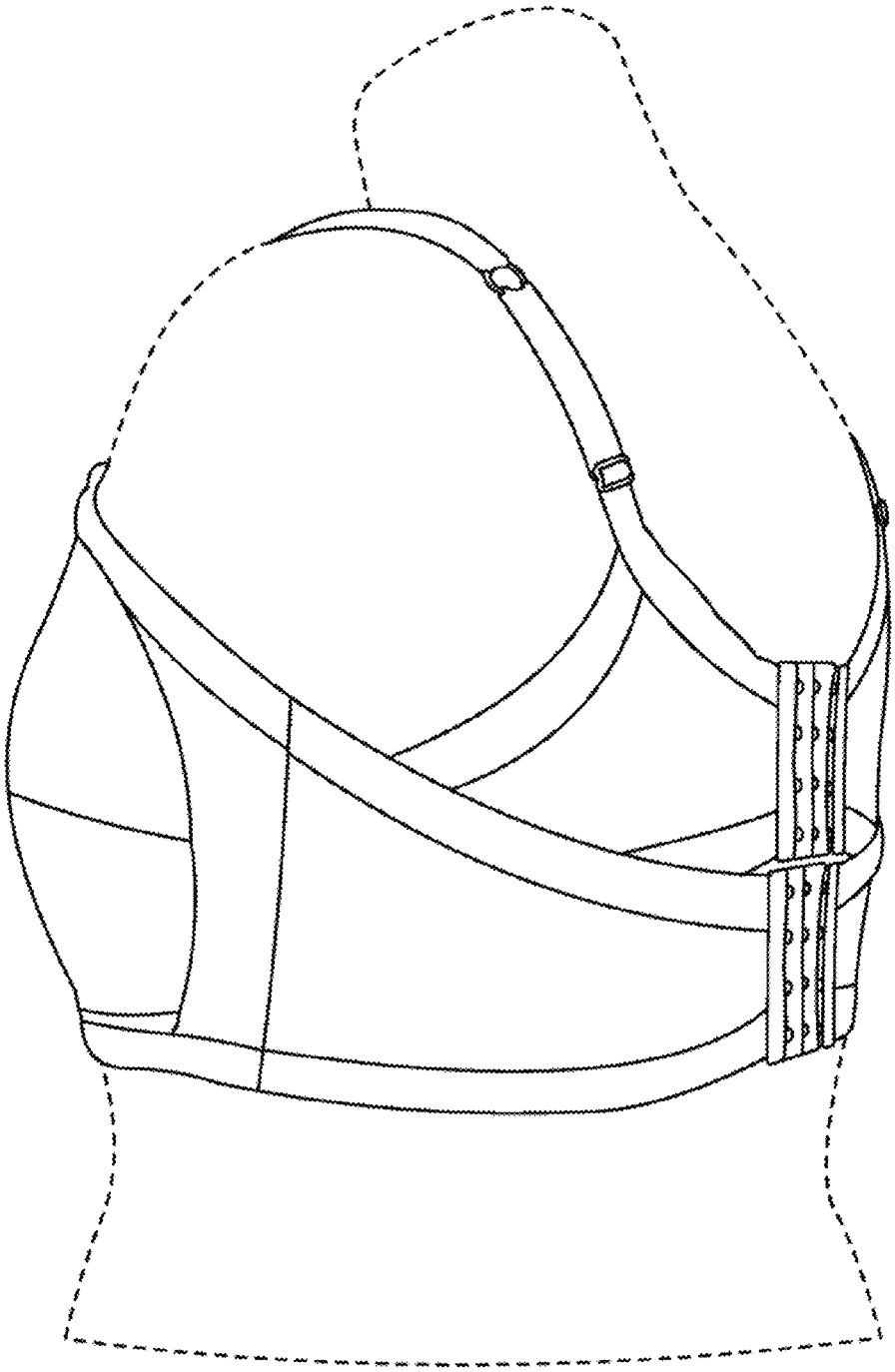
Figure 2J:
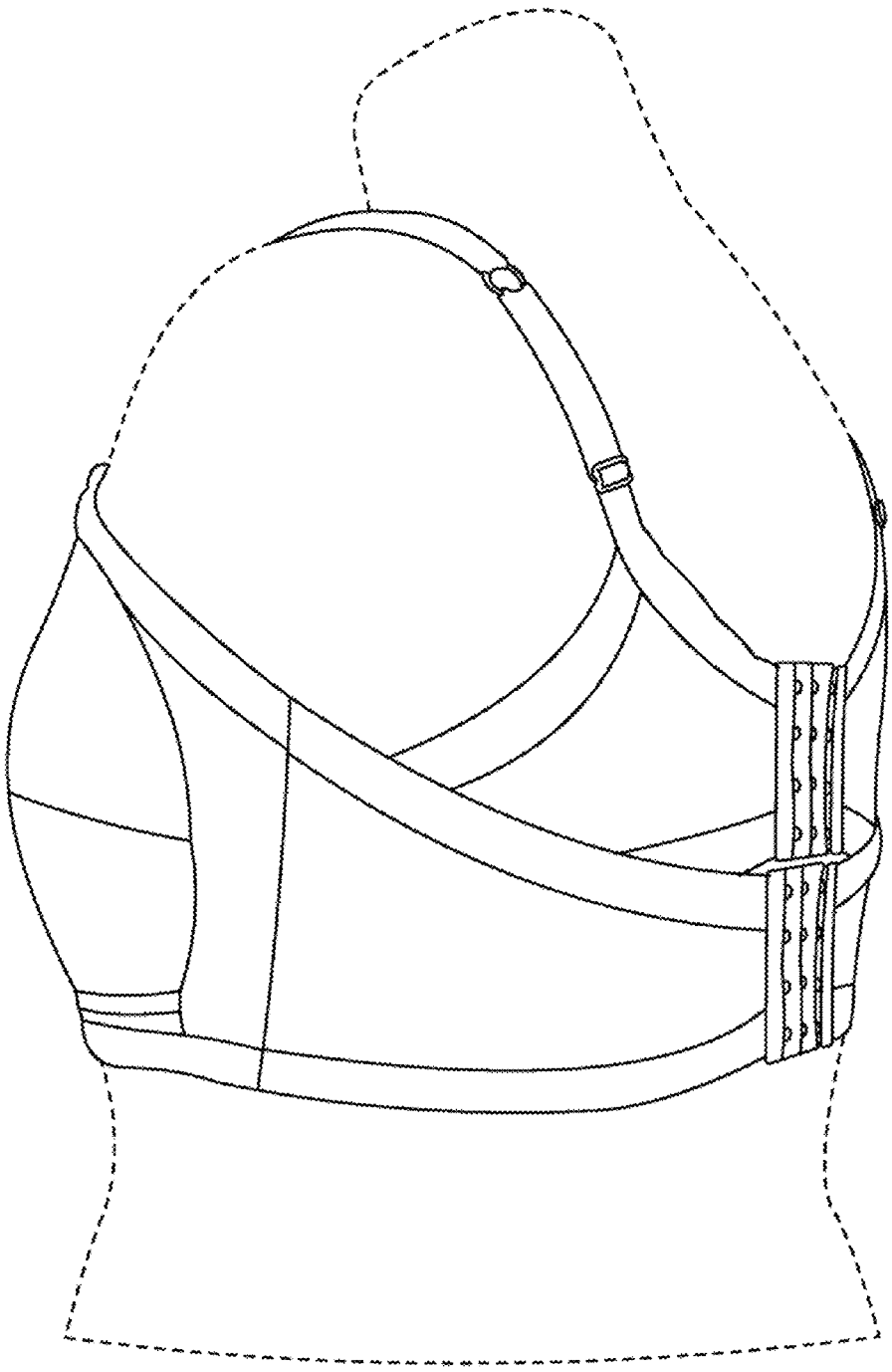
Figure 2K:
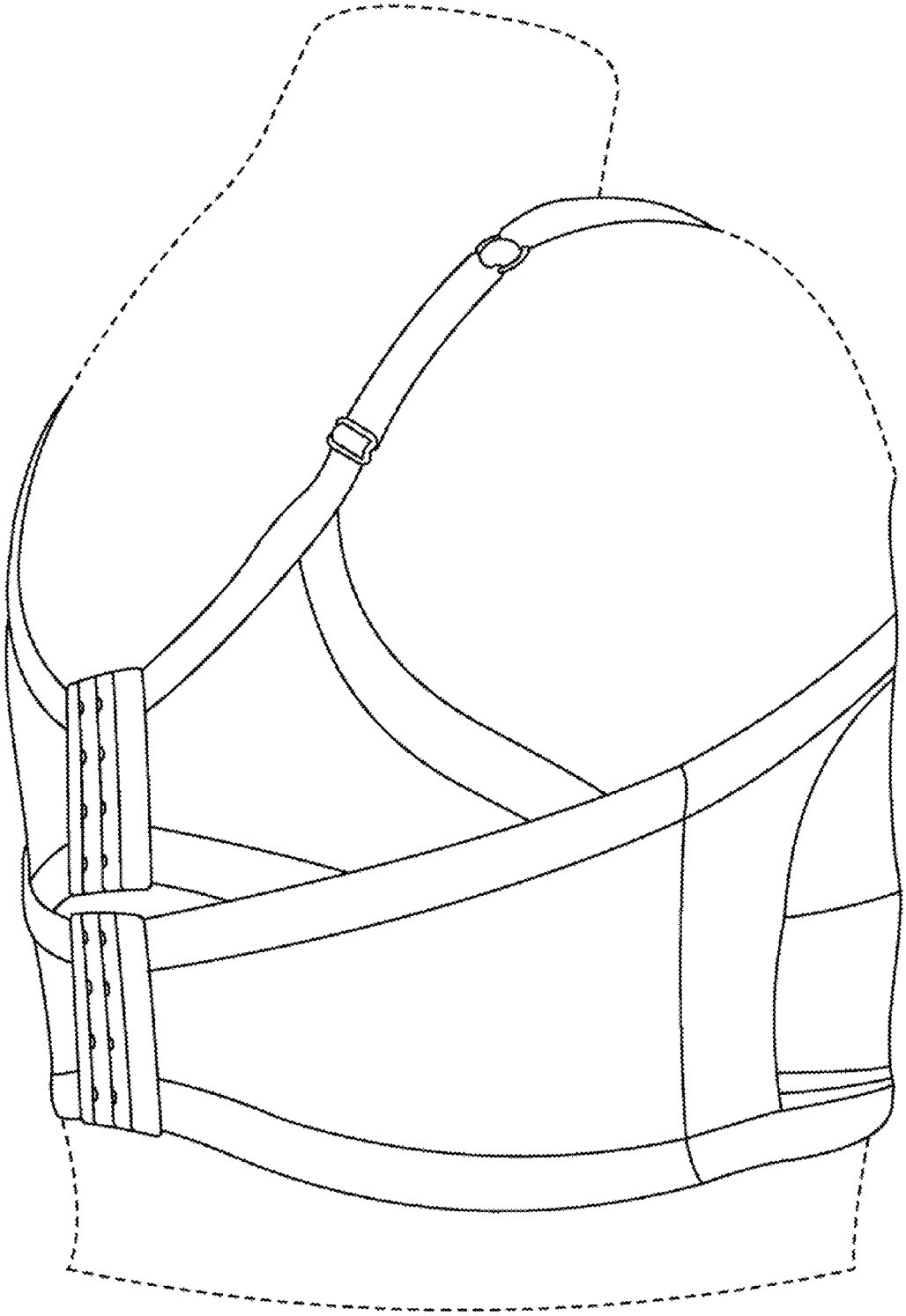
Figure 2I:
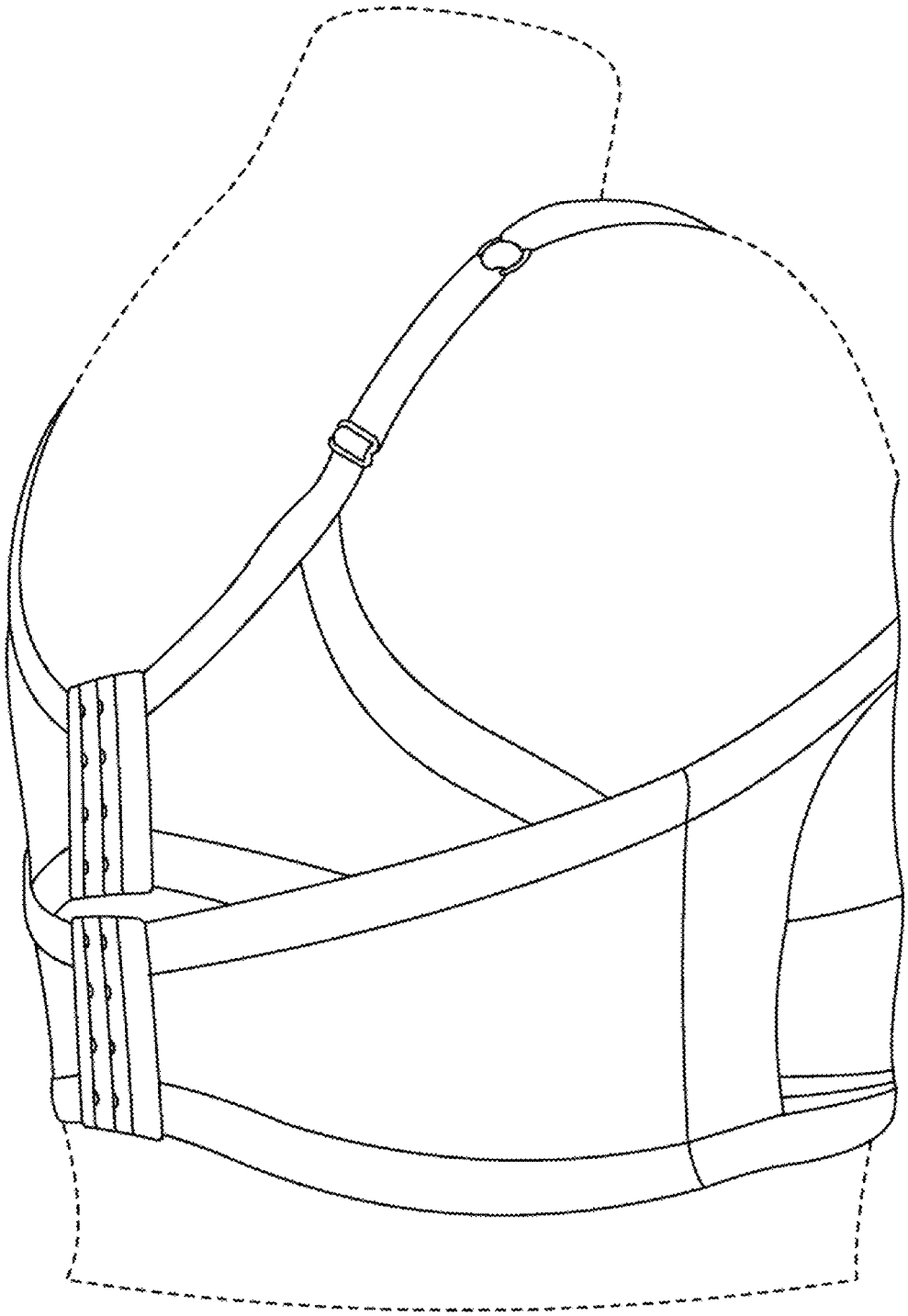
Figure 2M:
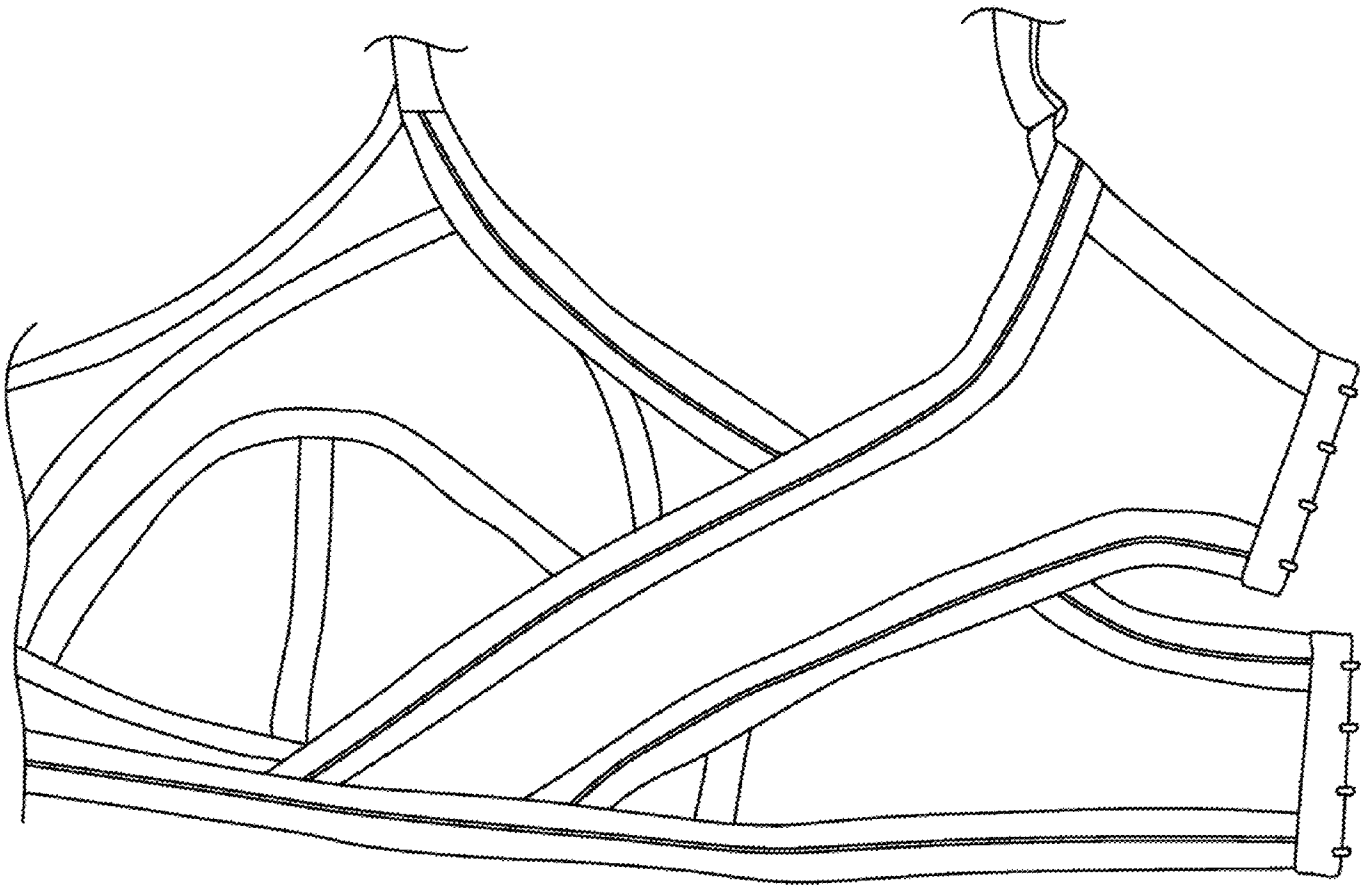
Figure 2N:
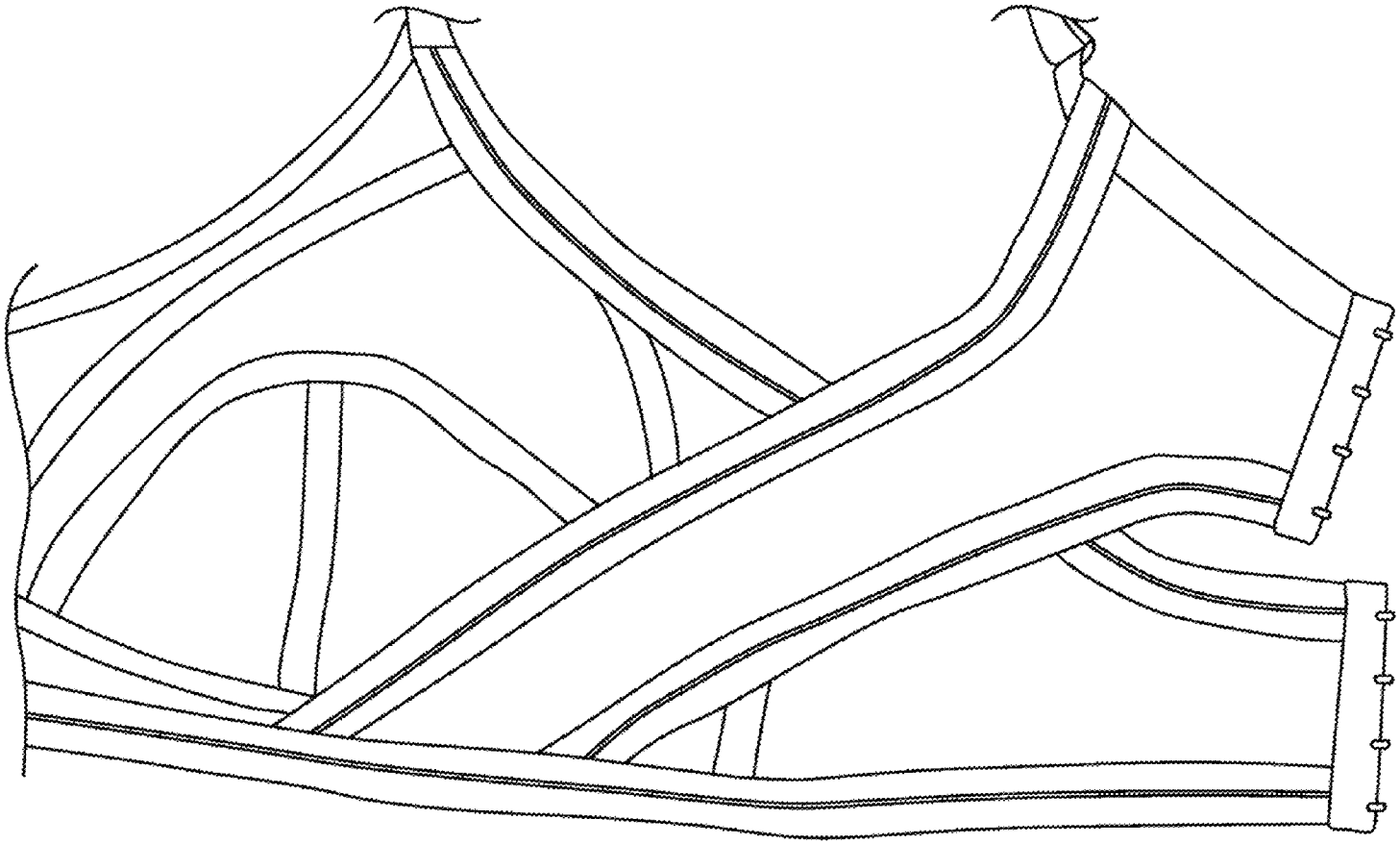
Figure 2O:
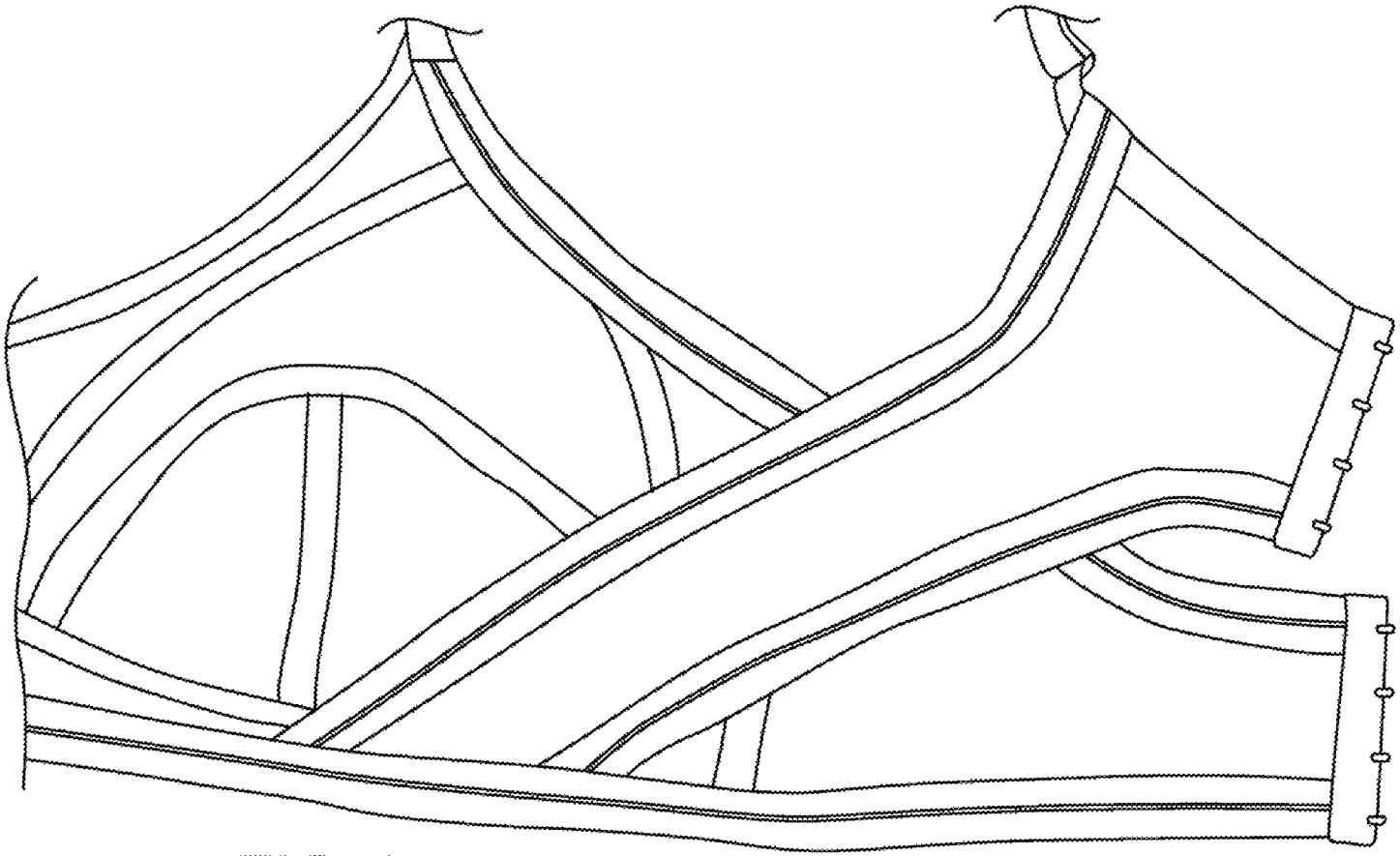
Figure 2P:
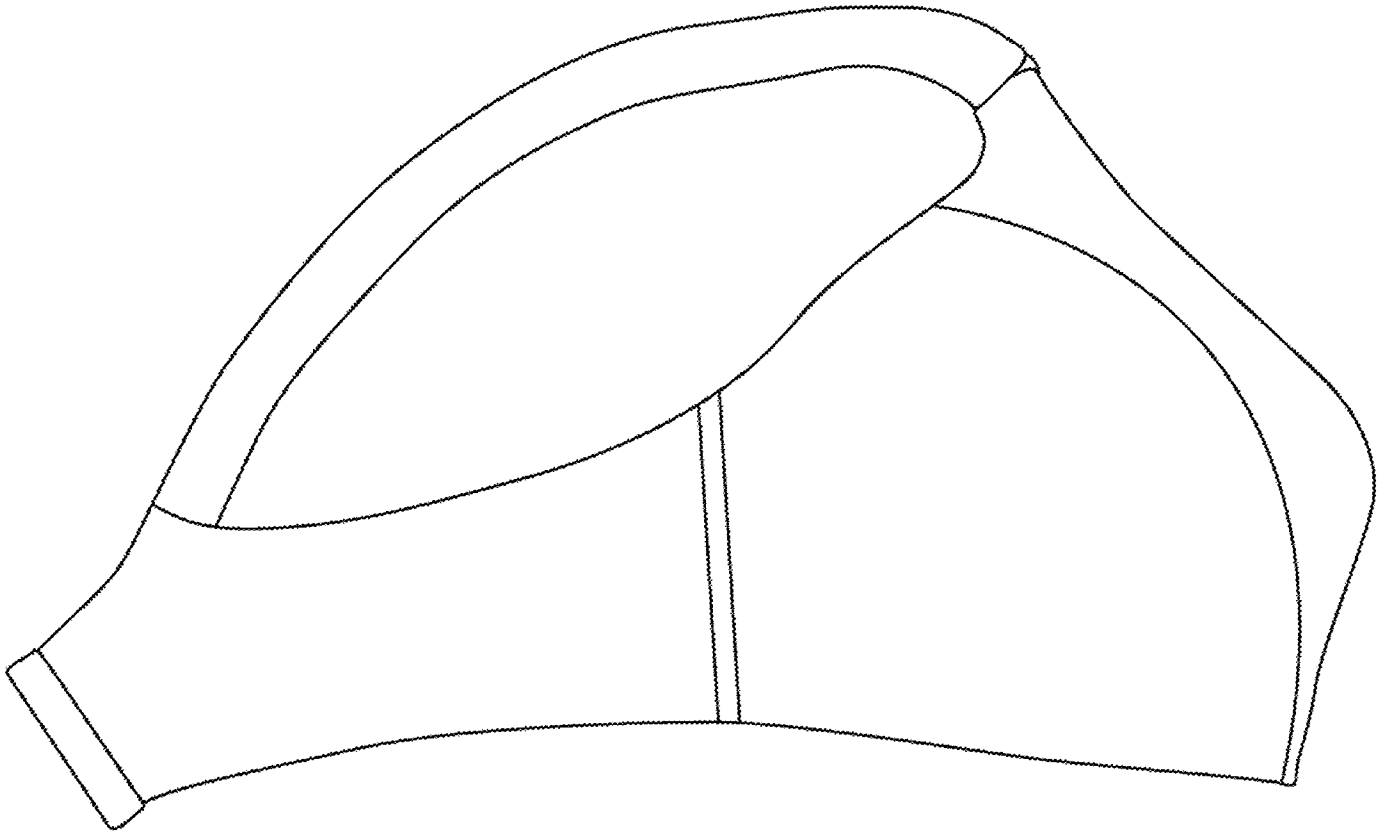
Figure 2Q:
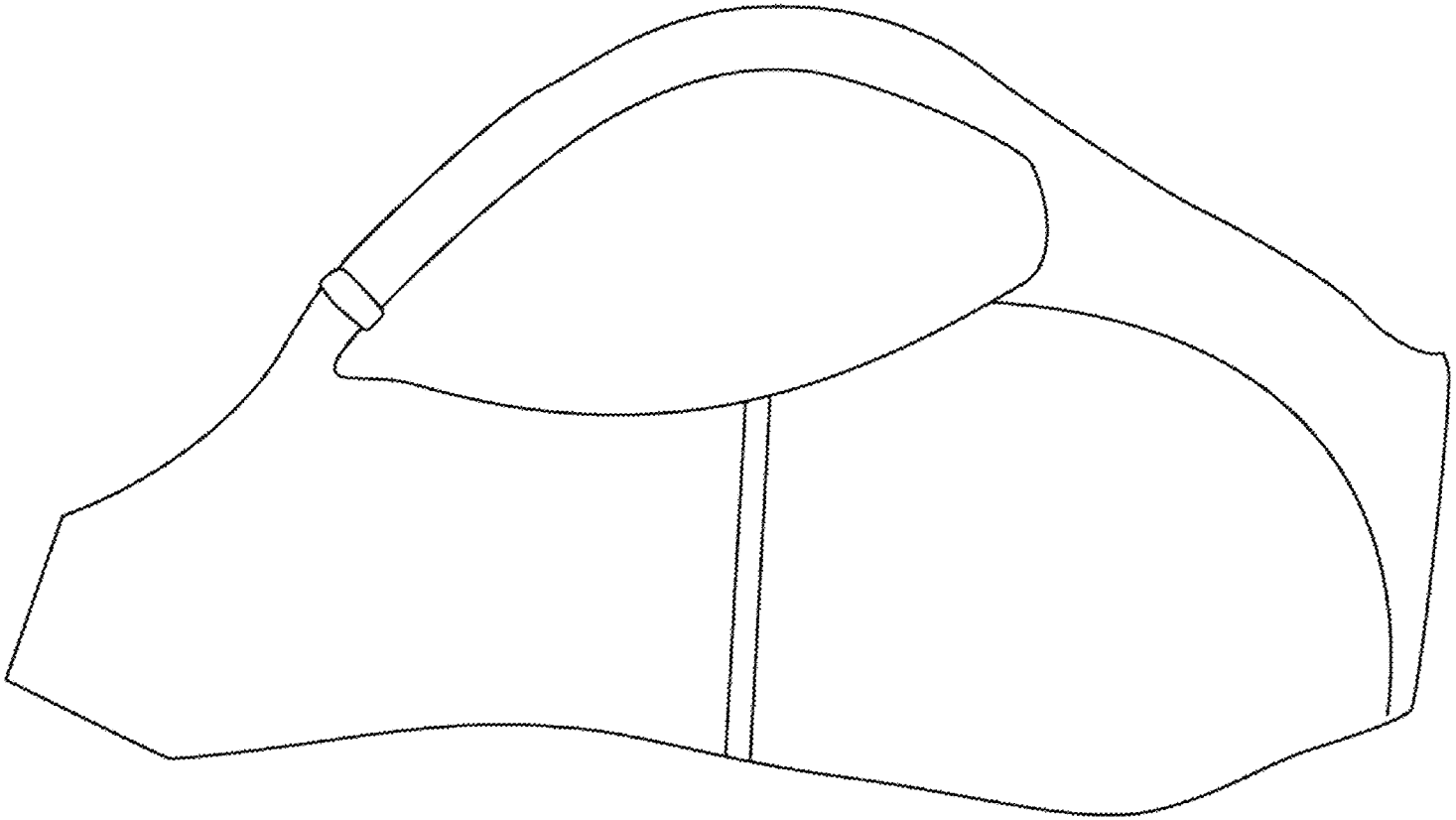
Figure 3A:
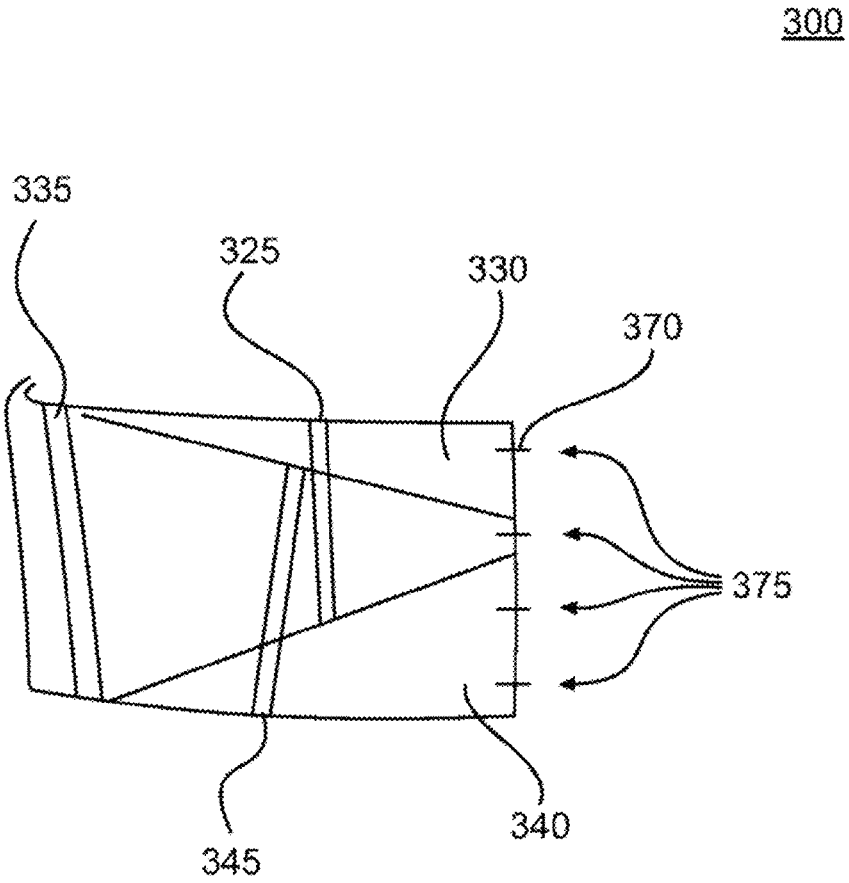
FIGS. 3(*a*)-3(*w*) illustrate a strapless embodiment of the invention.
Figure 3B:
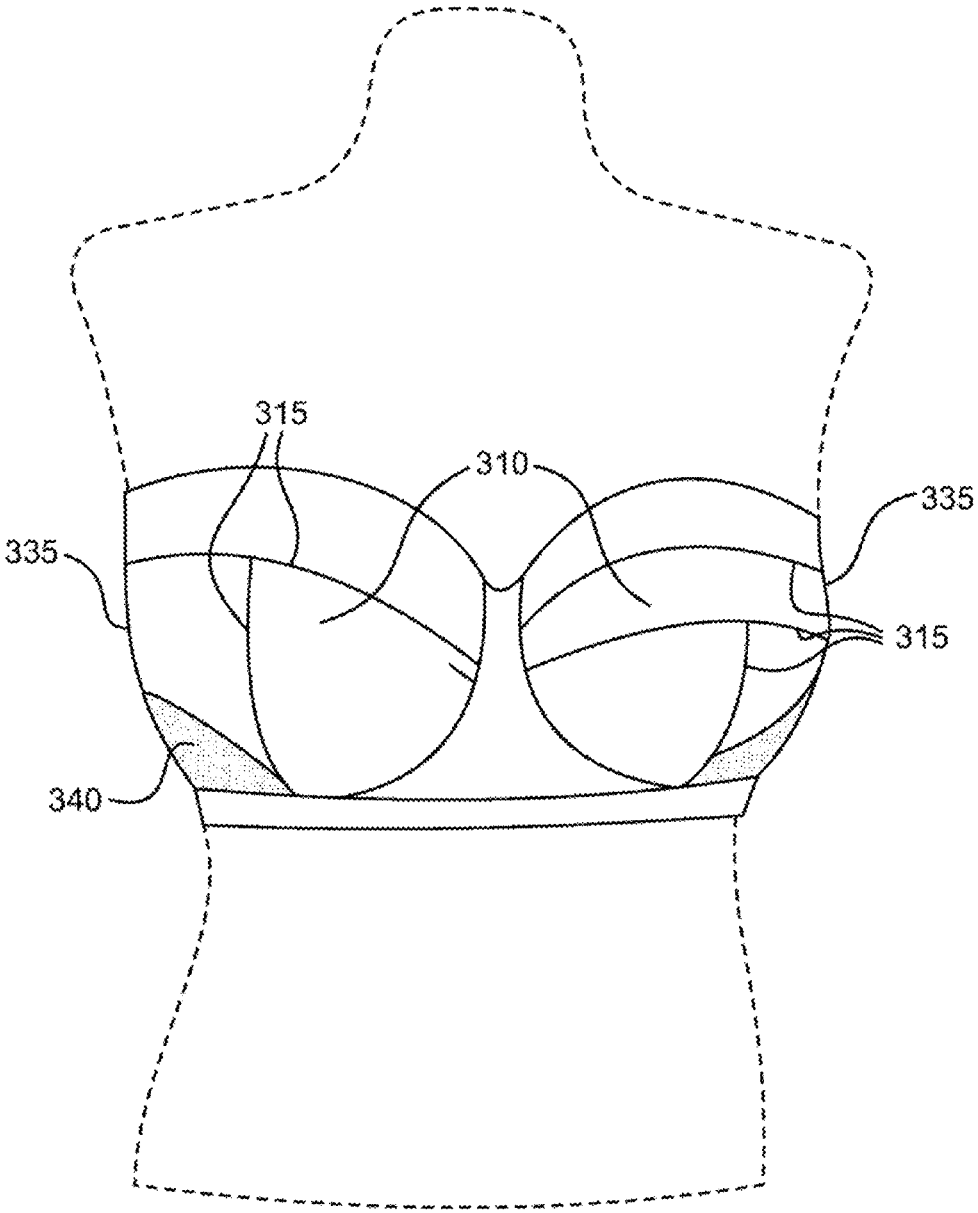
Figure 3C:
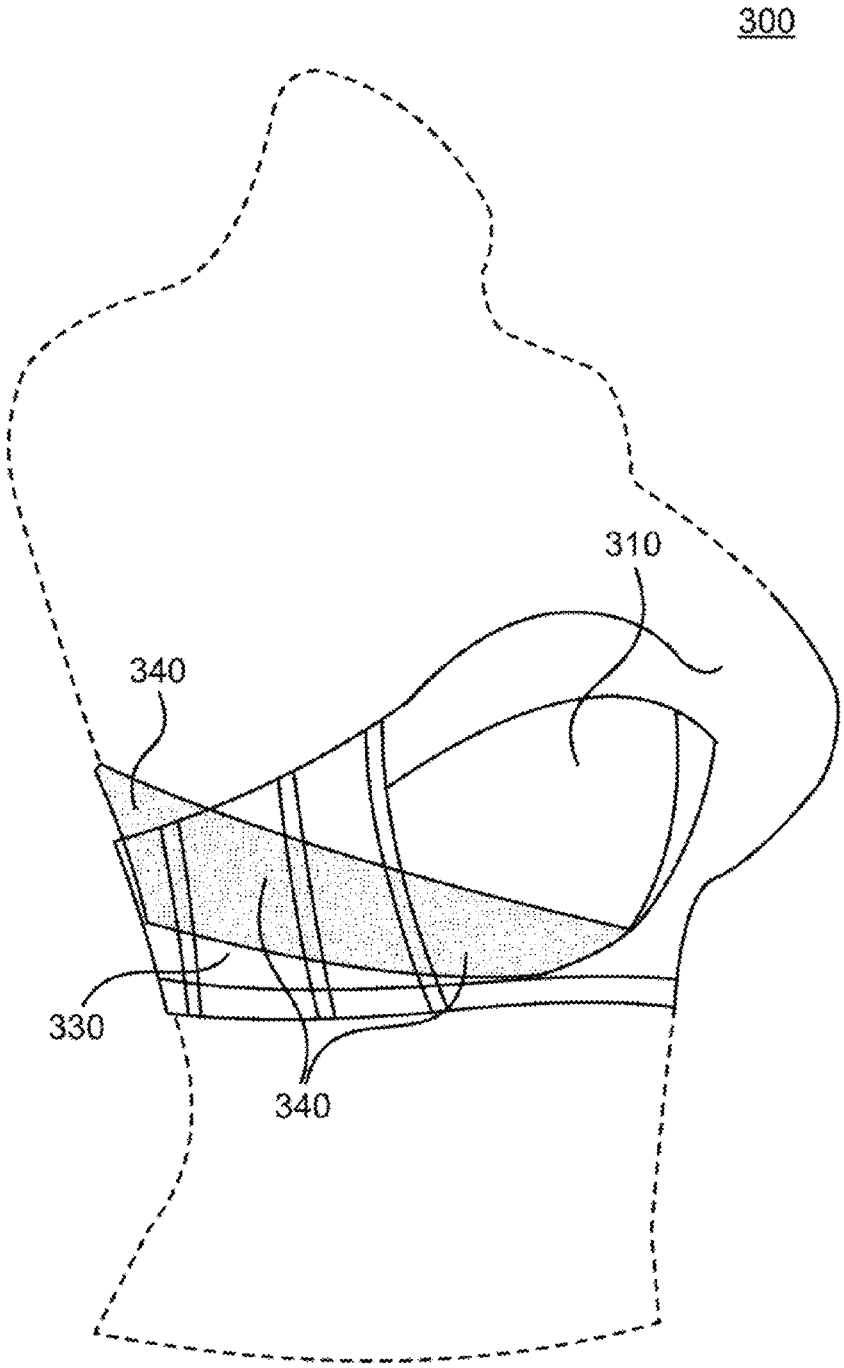
Figure 3D:
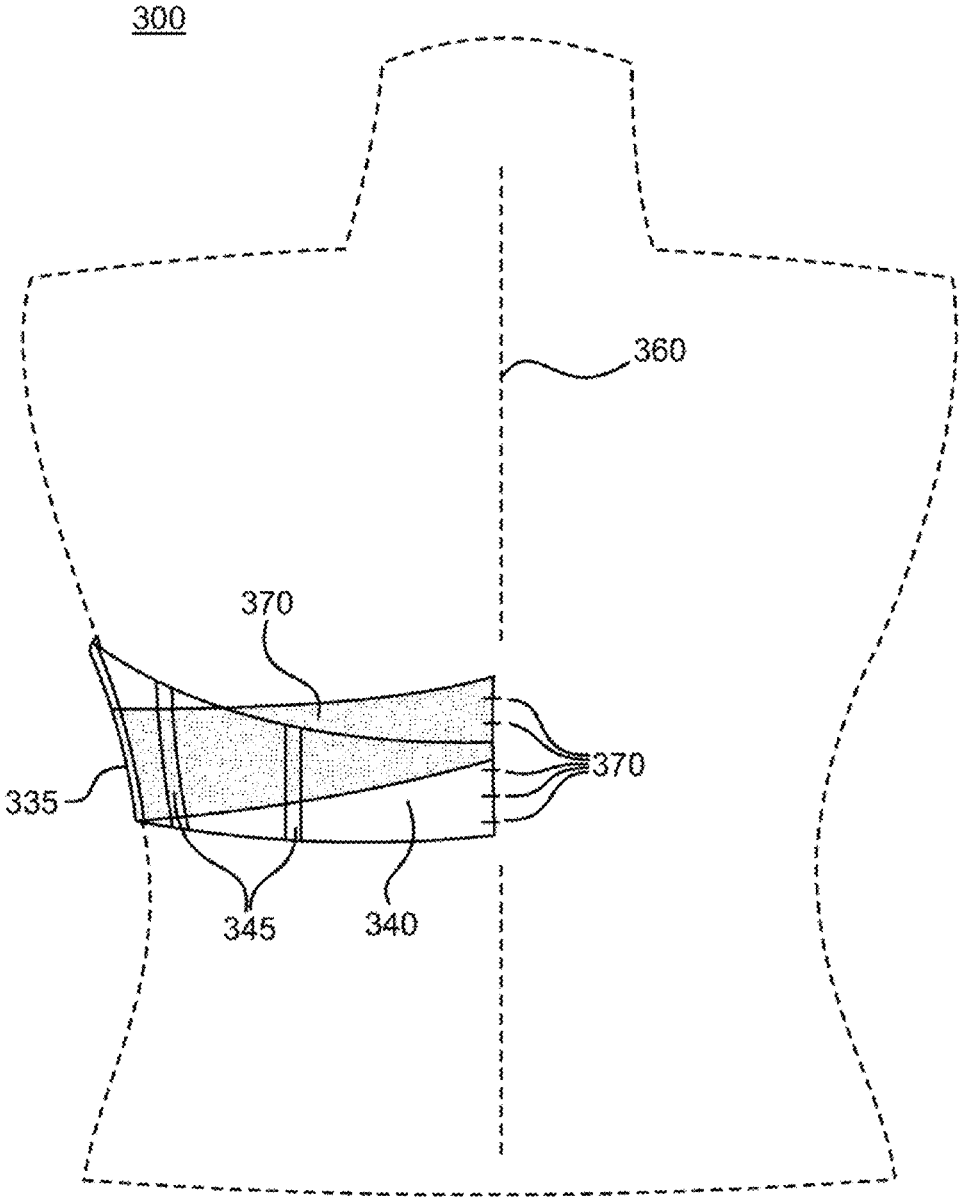
Figure 3E:
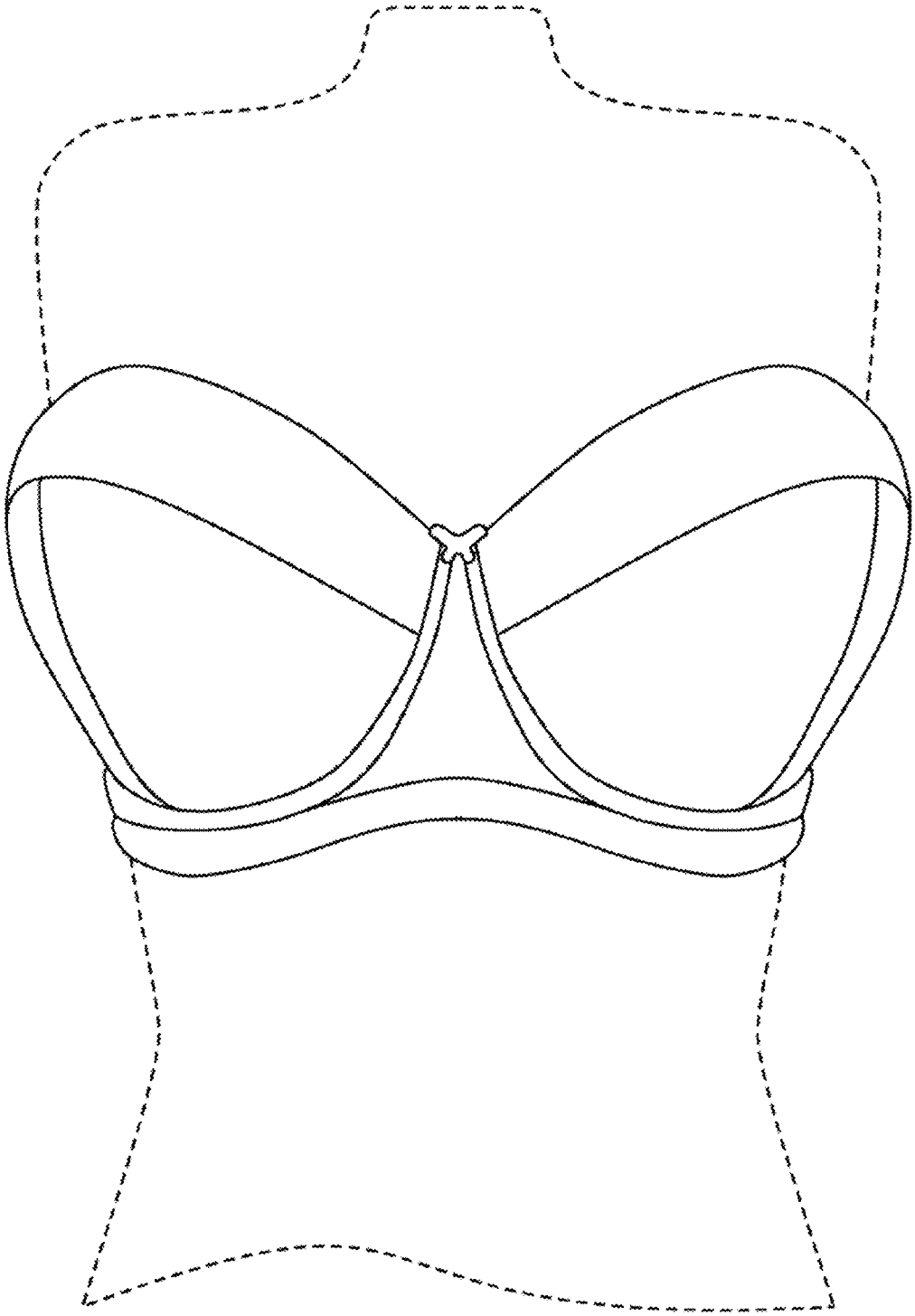
Figure 3F:
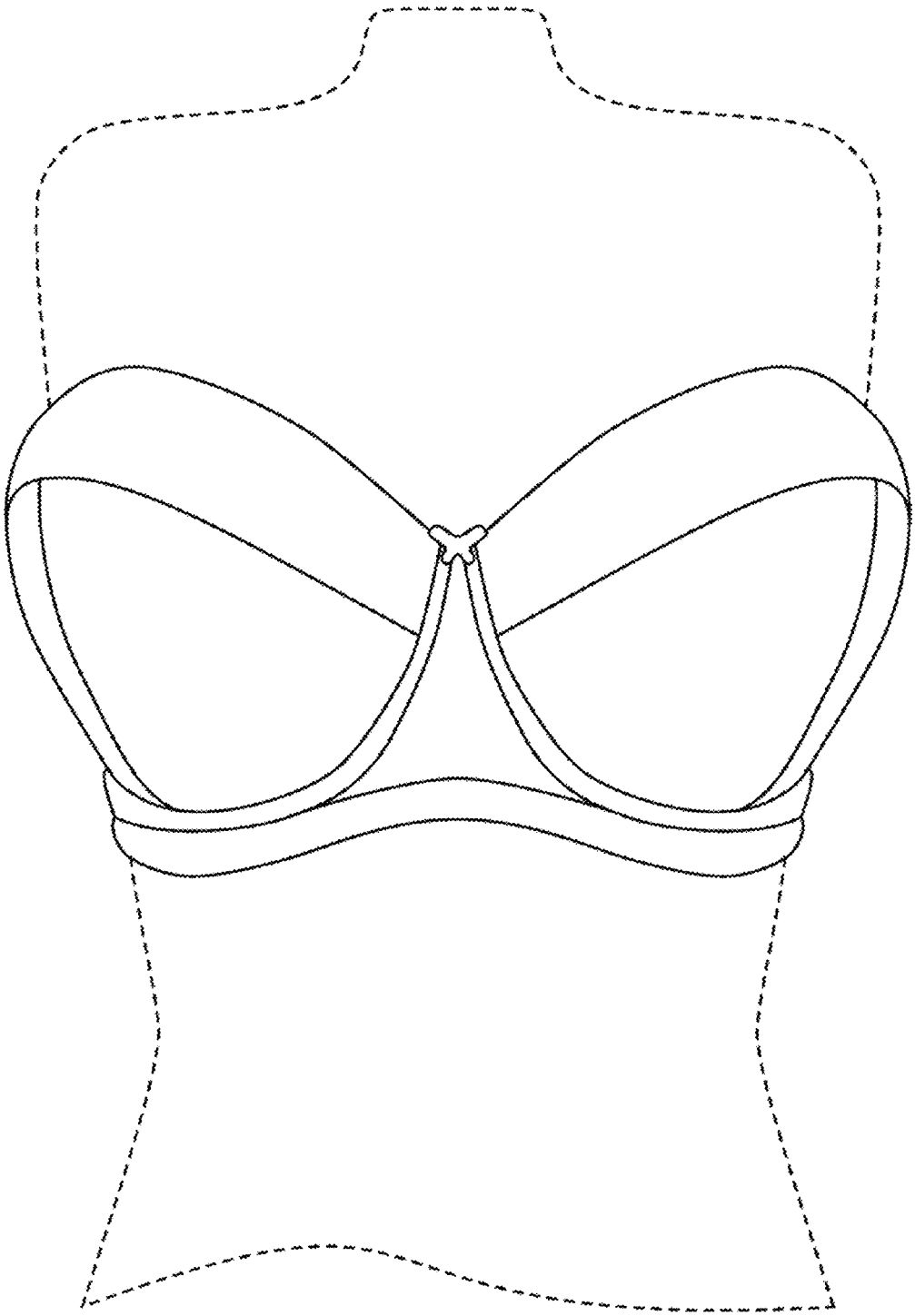
Figure 3G:
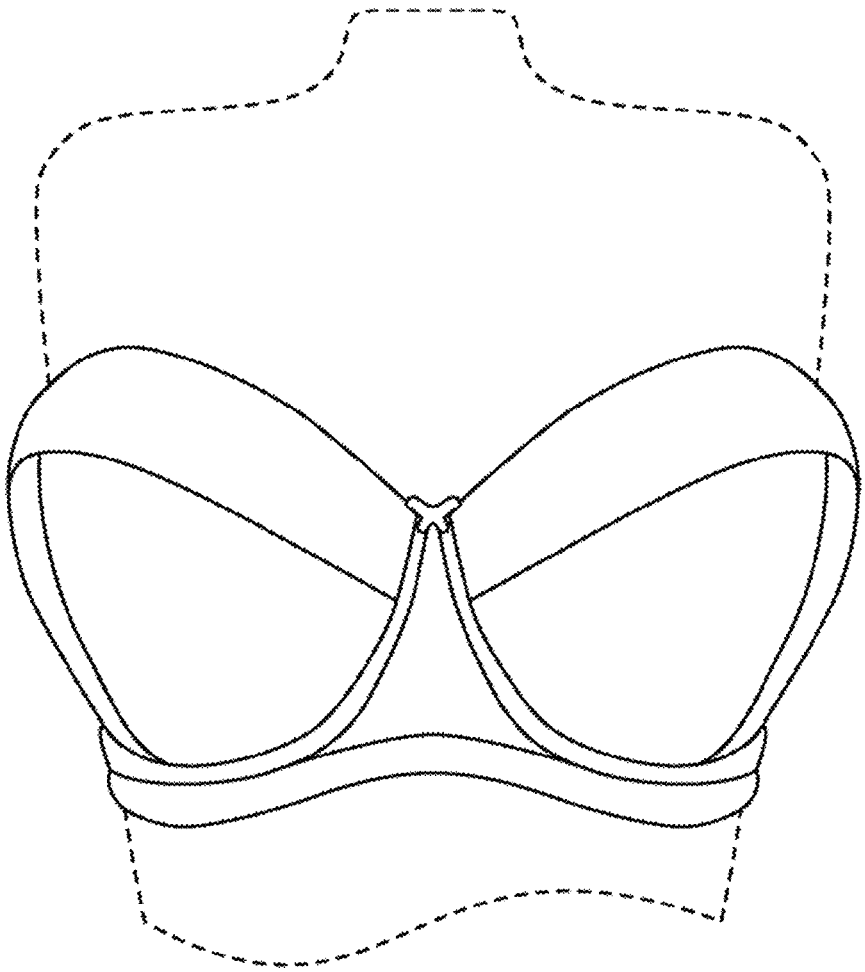
Figure 3H:
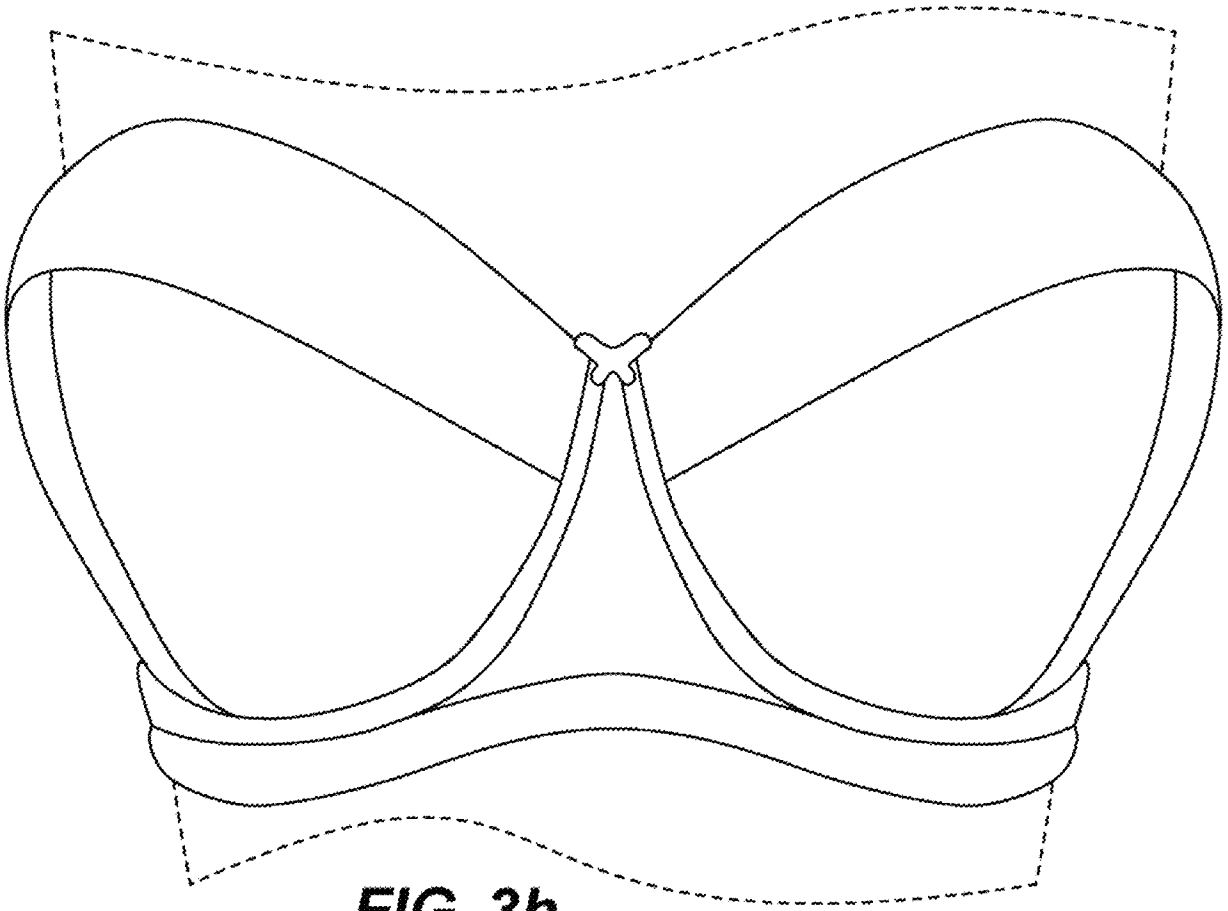
Figure 3I:
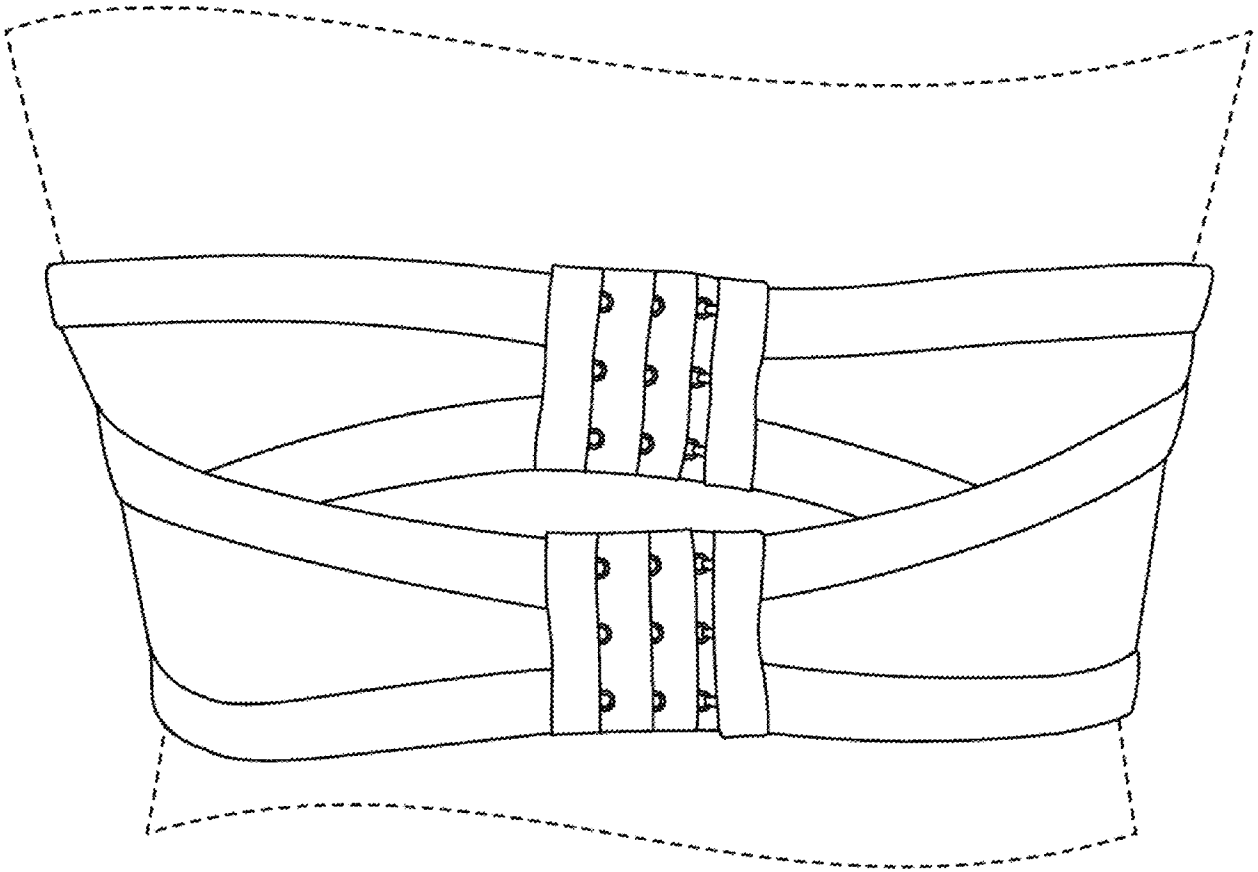
Figure 3J:
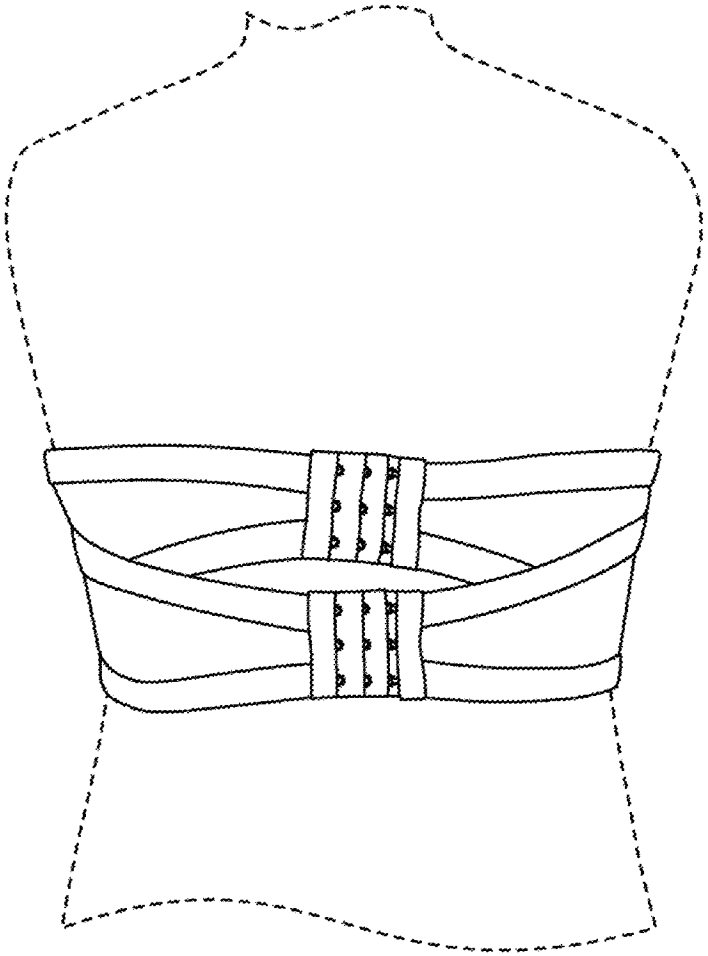
Figure 3K:
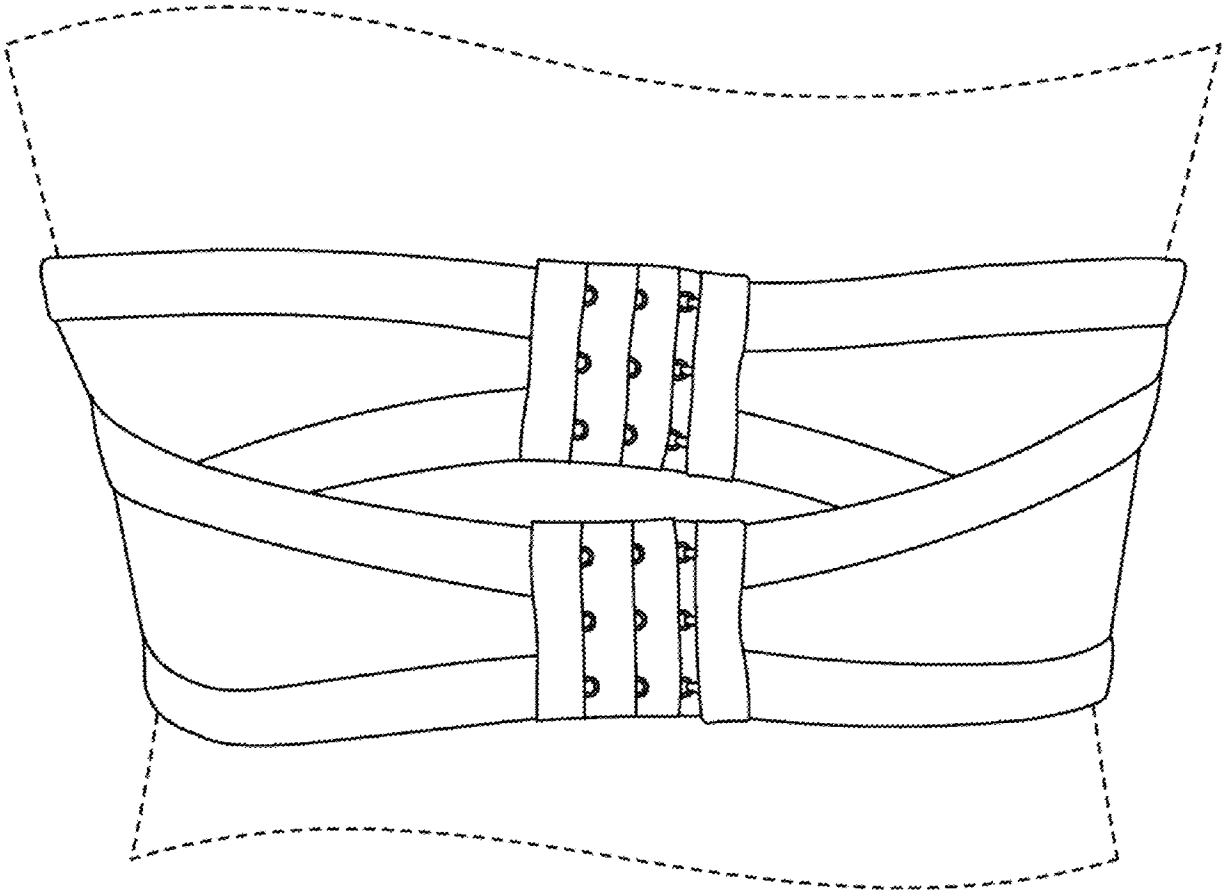
Figure 3I:
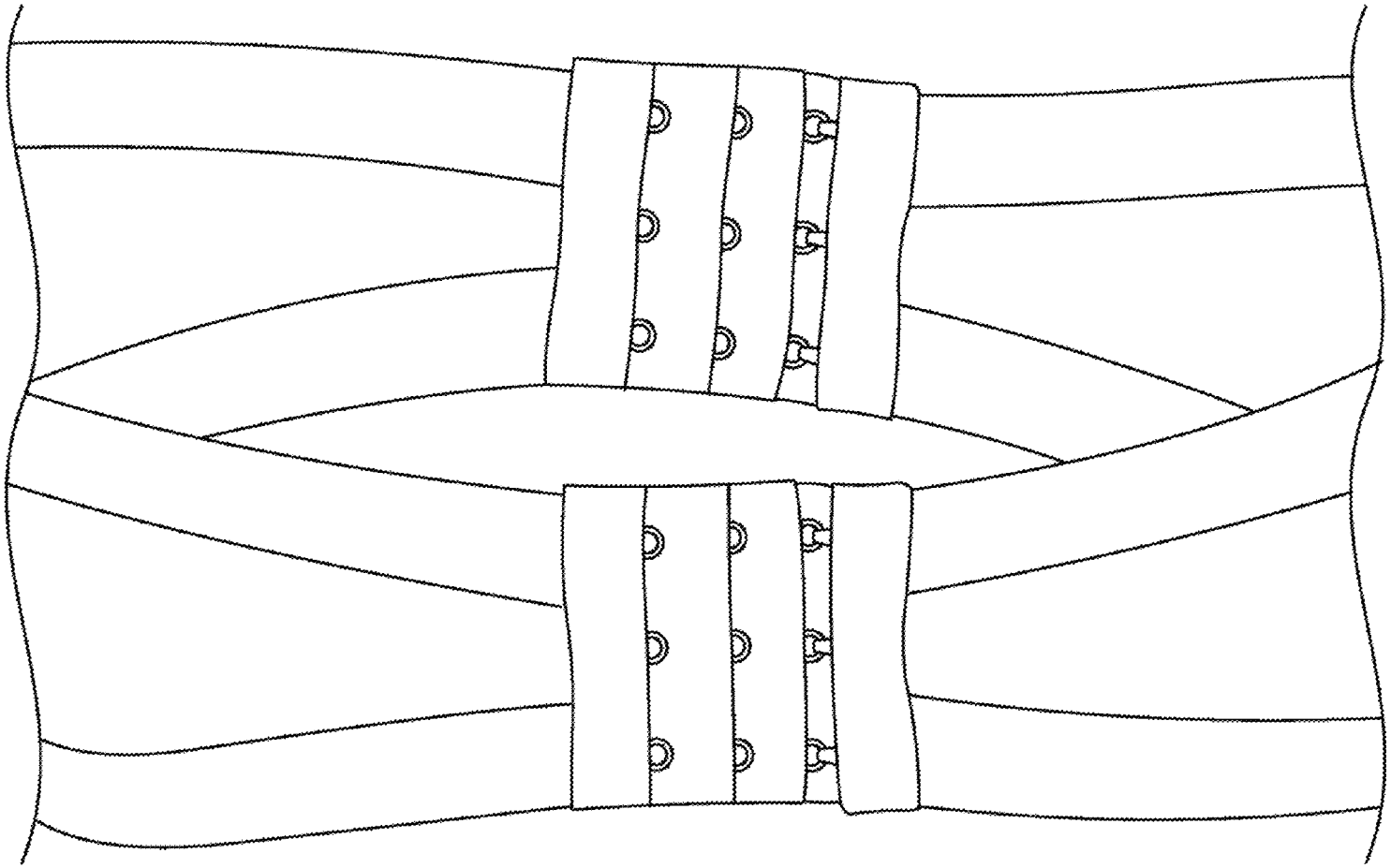
Figure 3M:
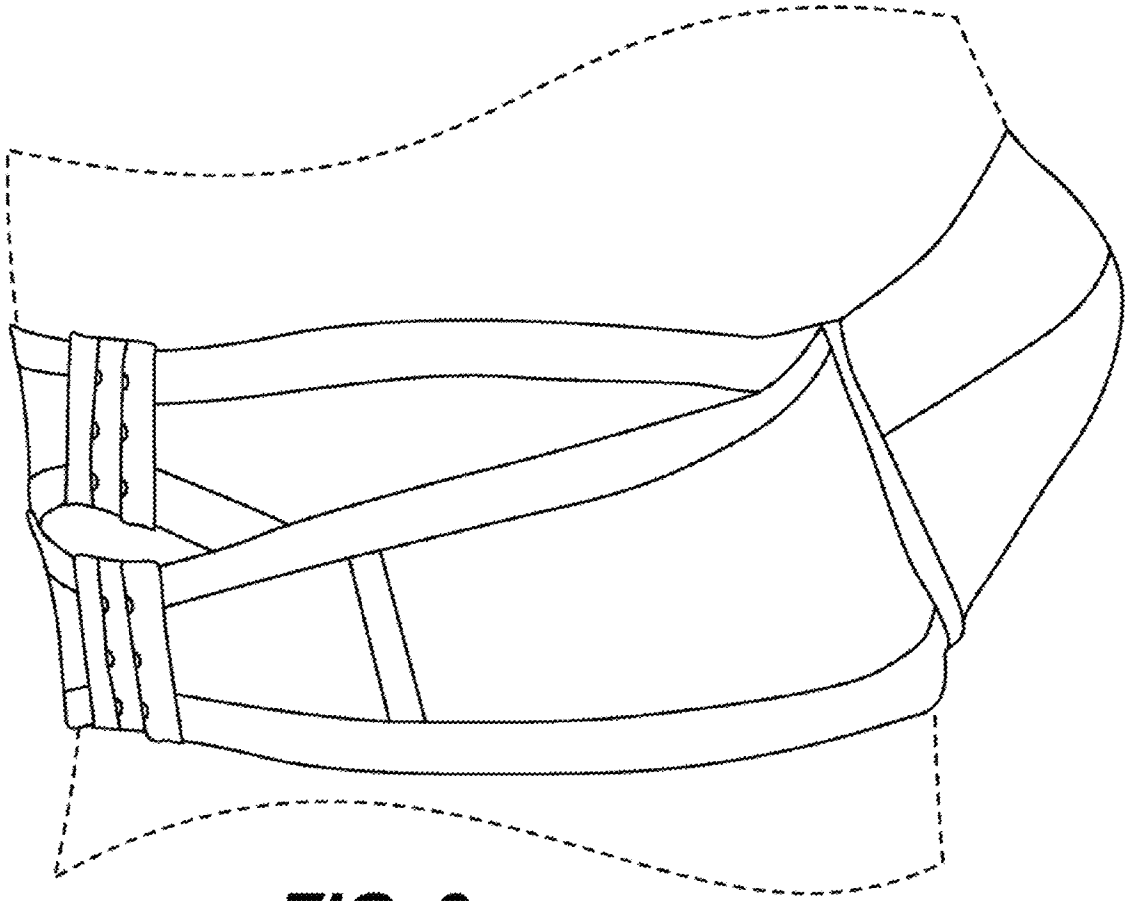
Figure 3N:
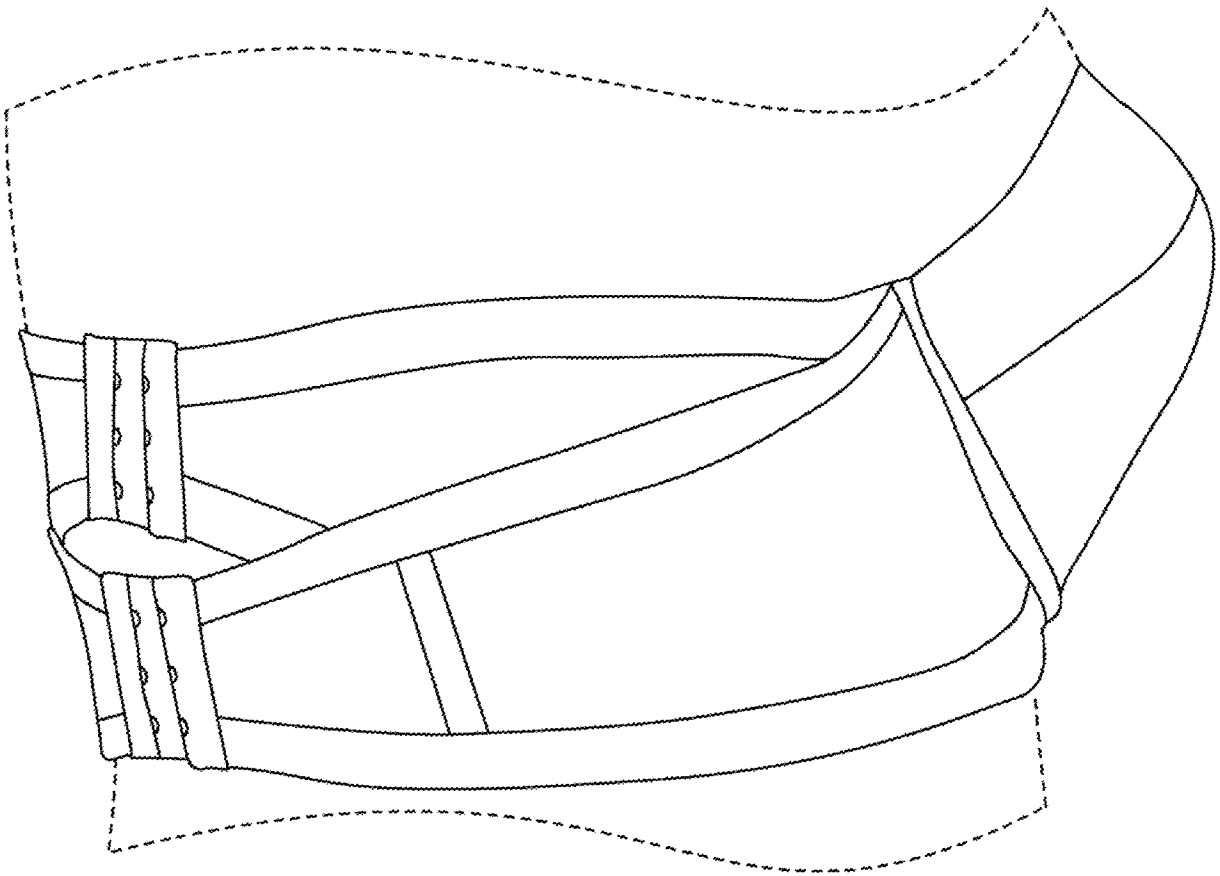
Figure 3O:
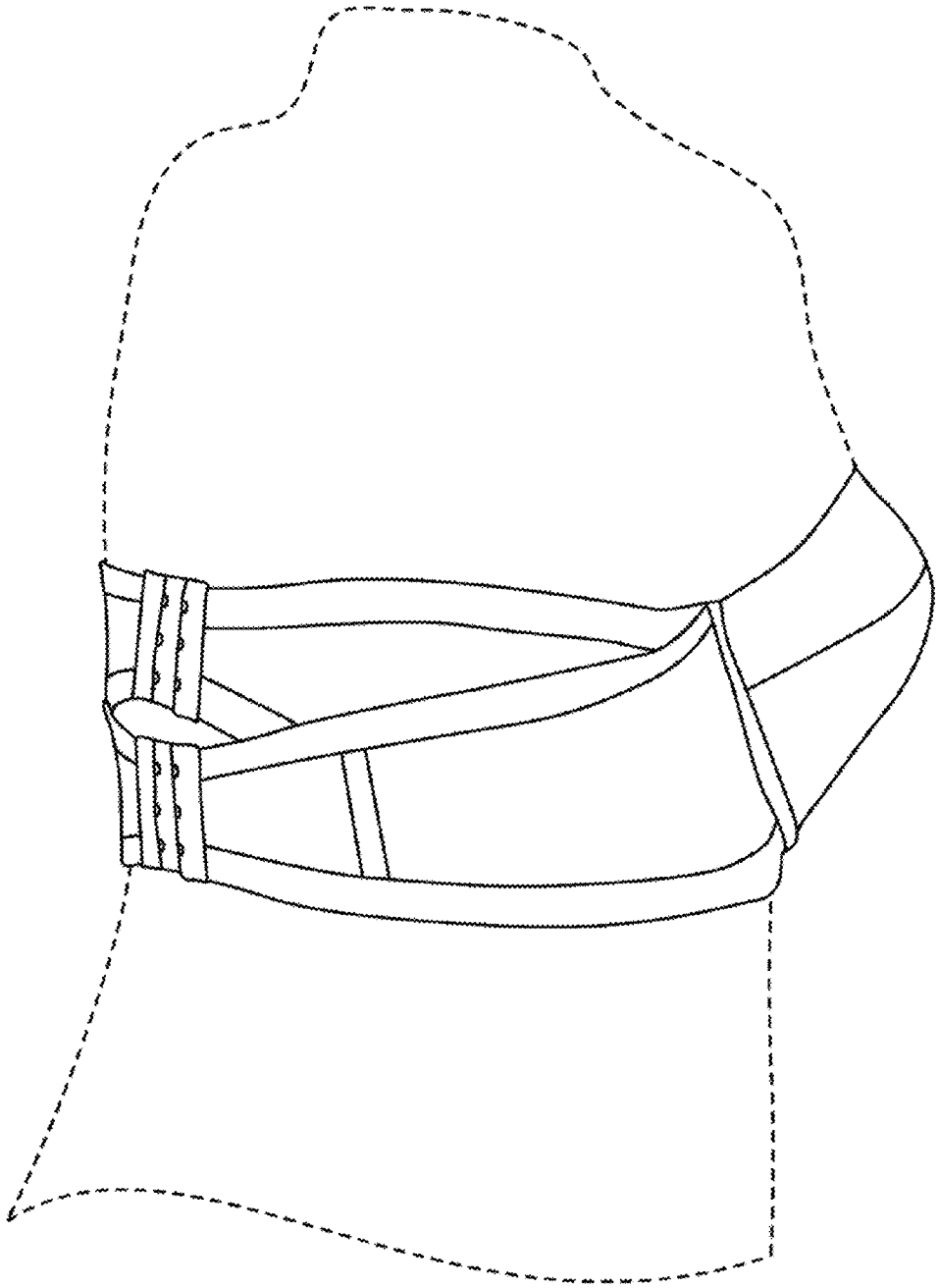
Figure 3P:
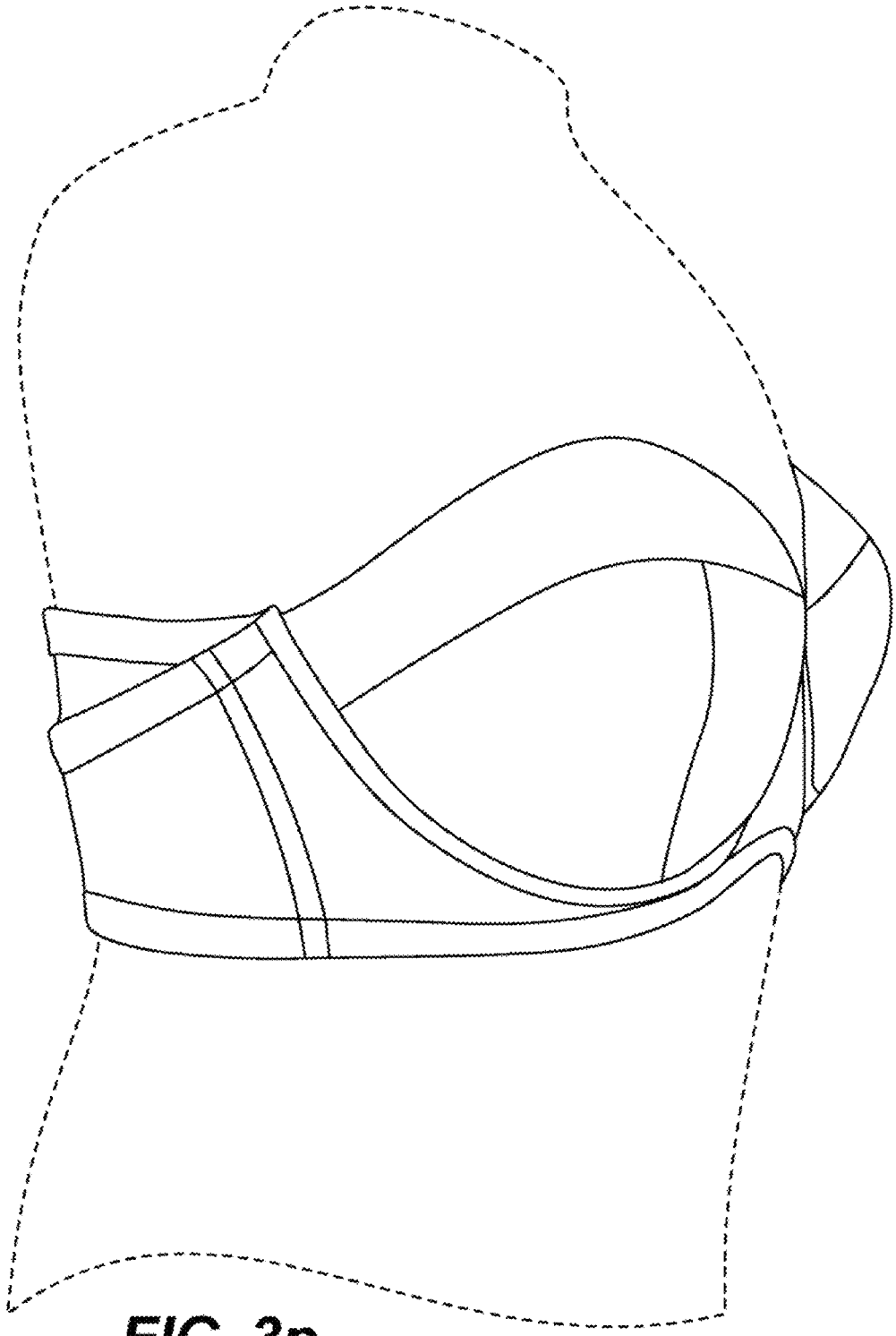
Figure 3Q:
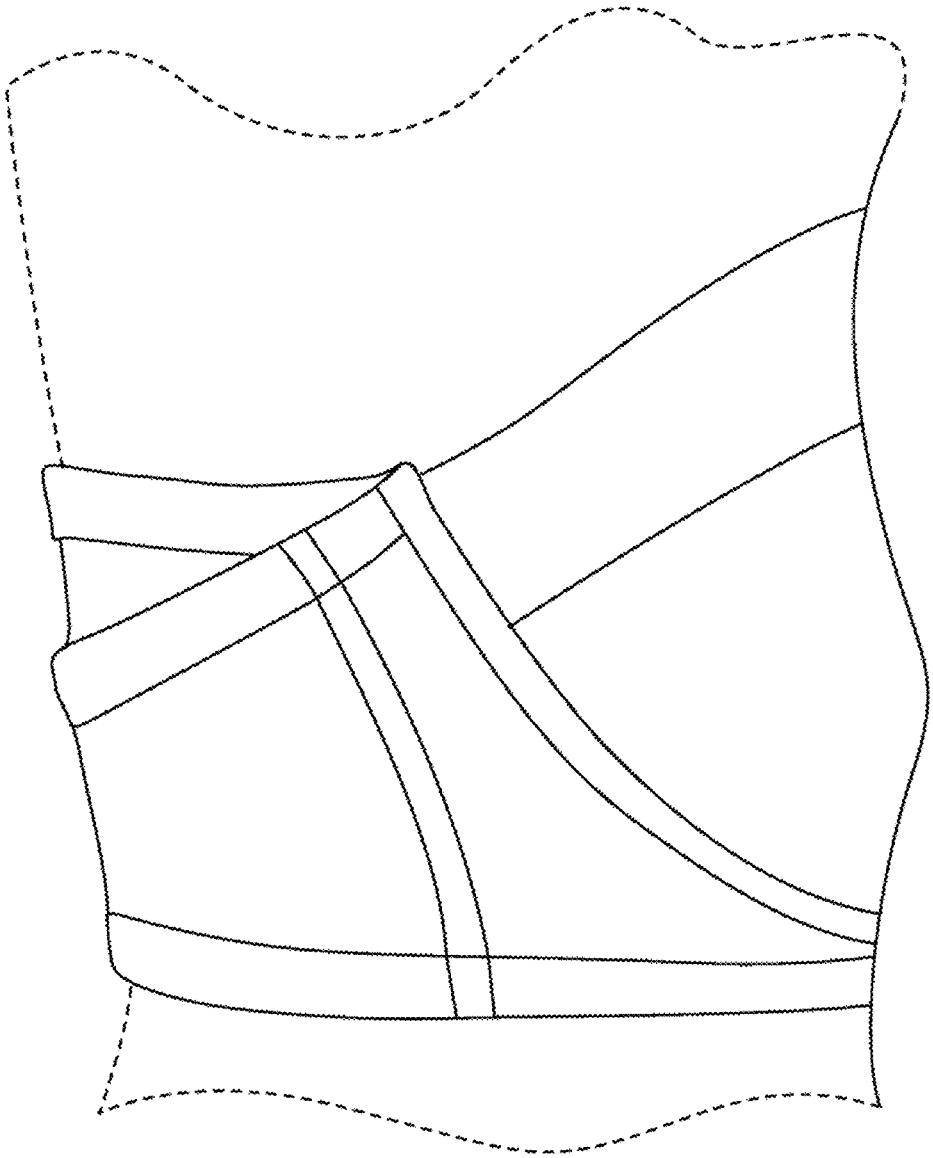
Figure 3R:
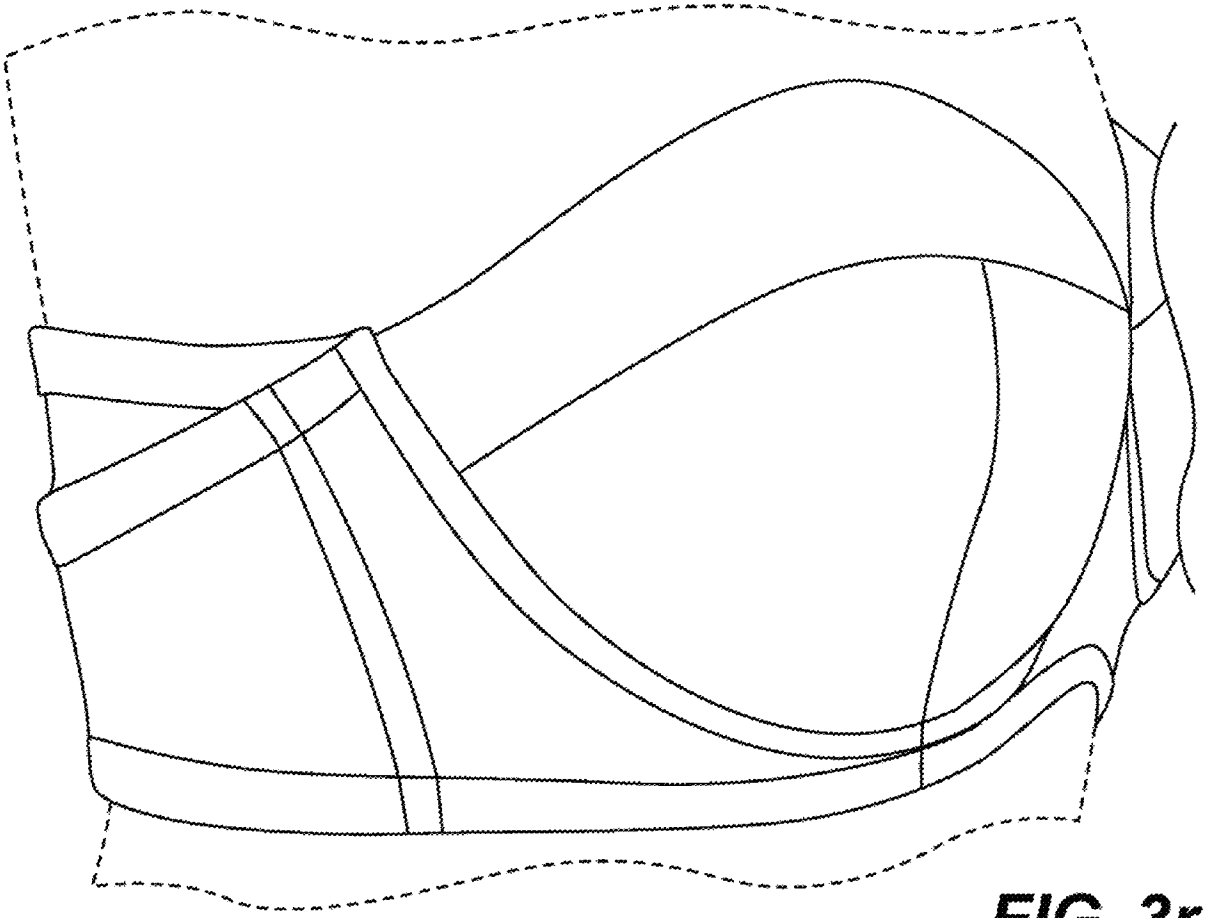
Figure 3S:
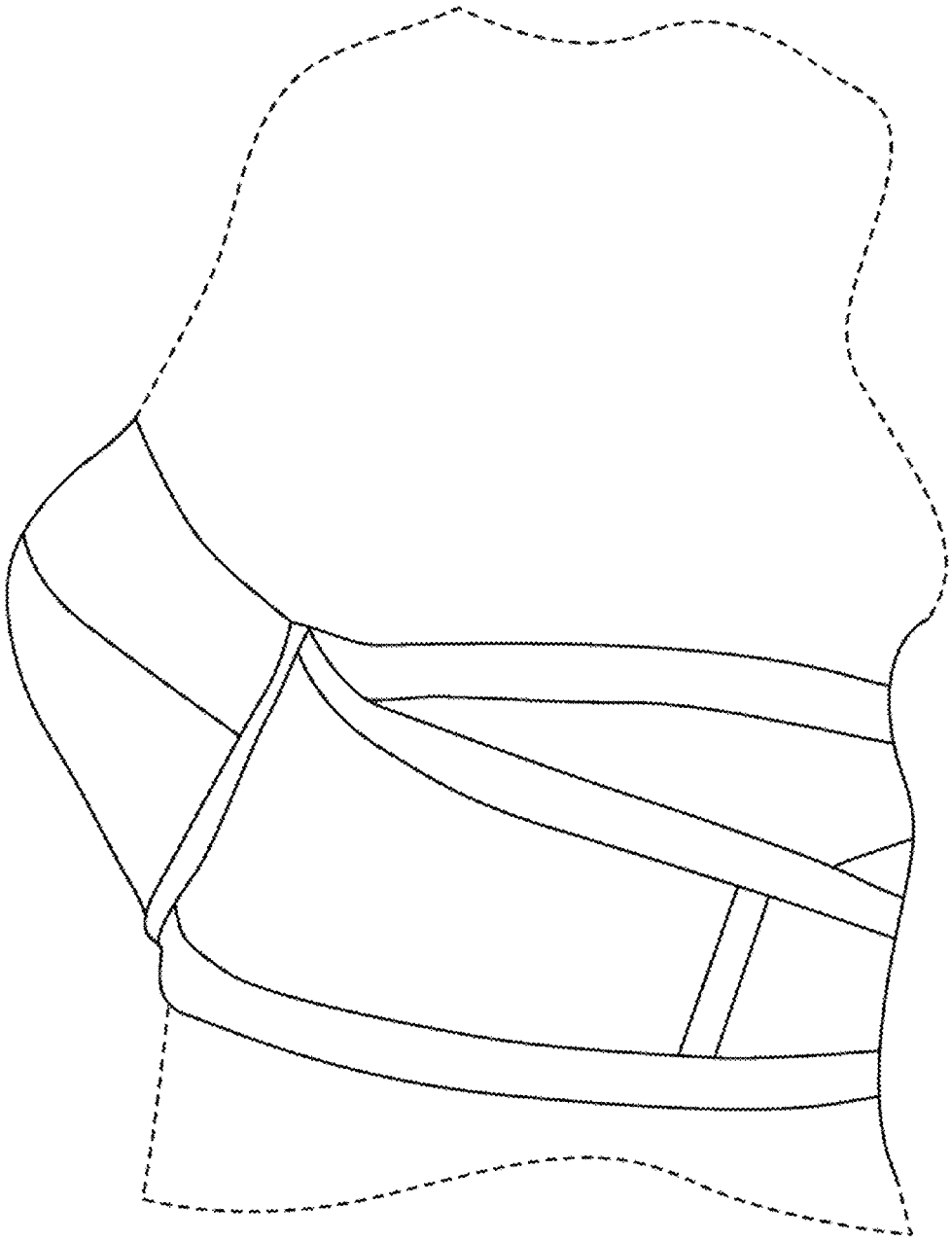
Figure 3T:
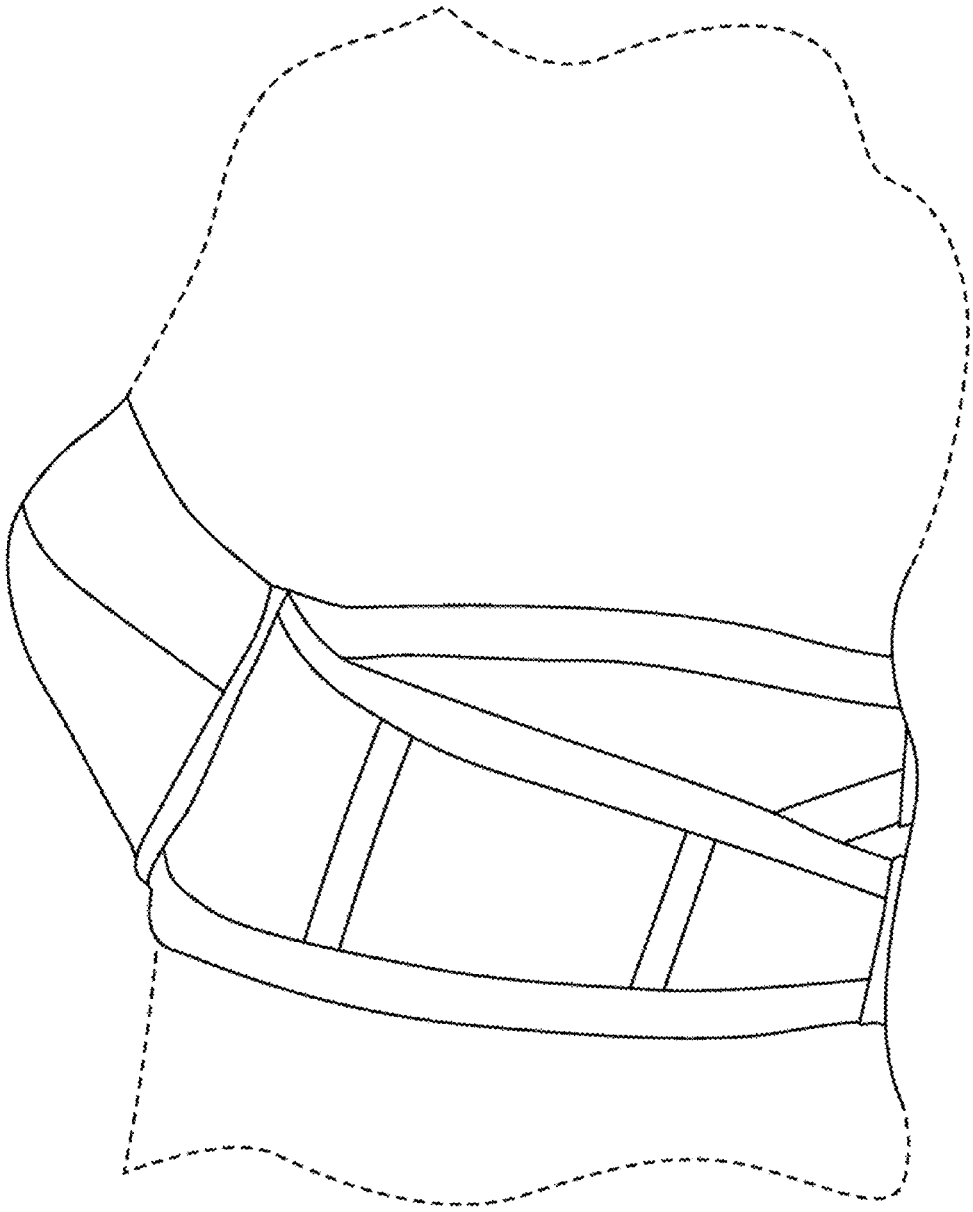
Figure 3U:
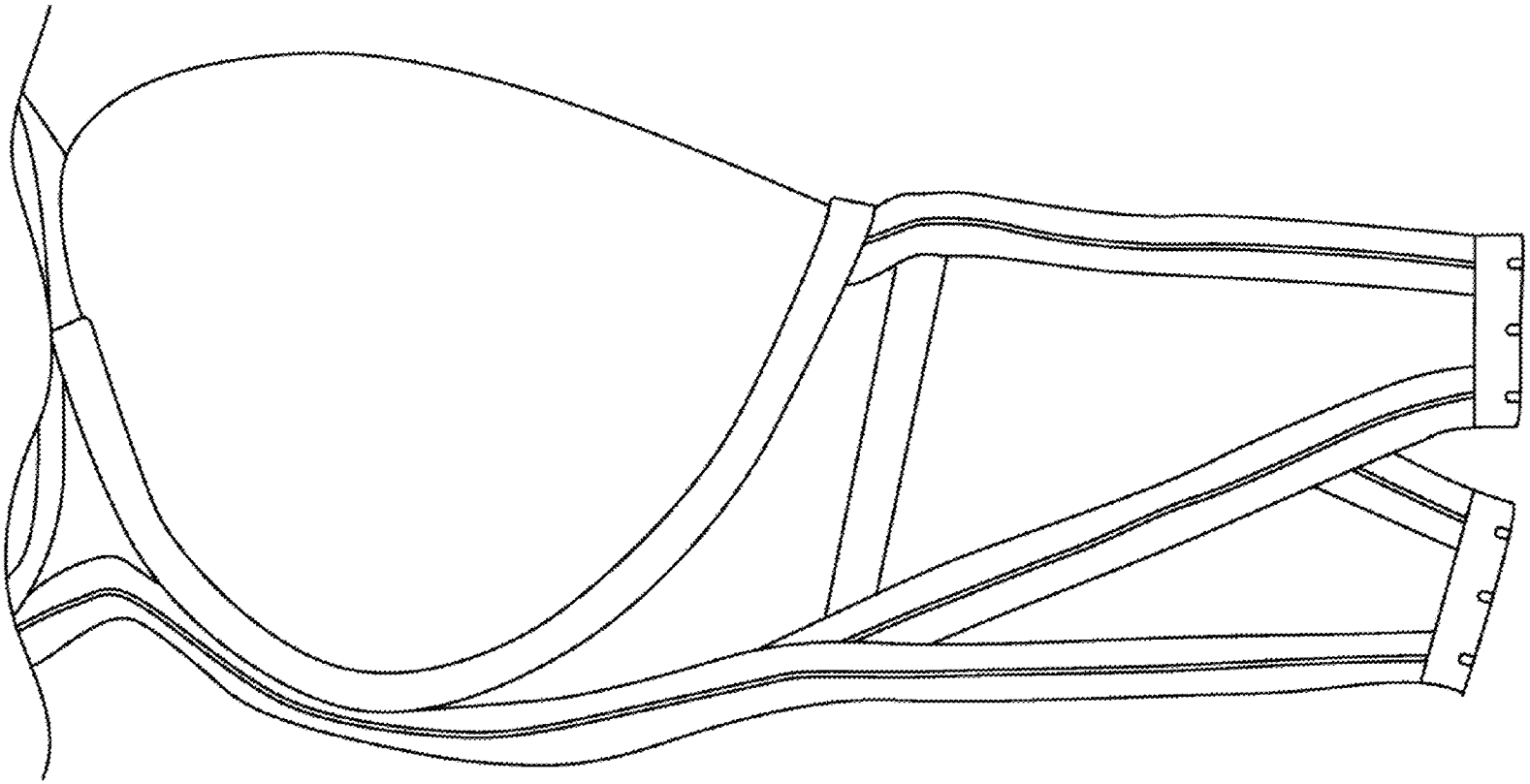
Figure 3V:
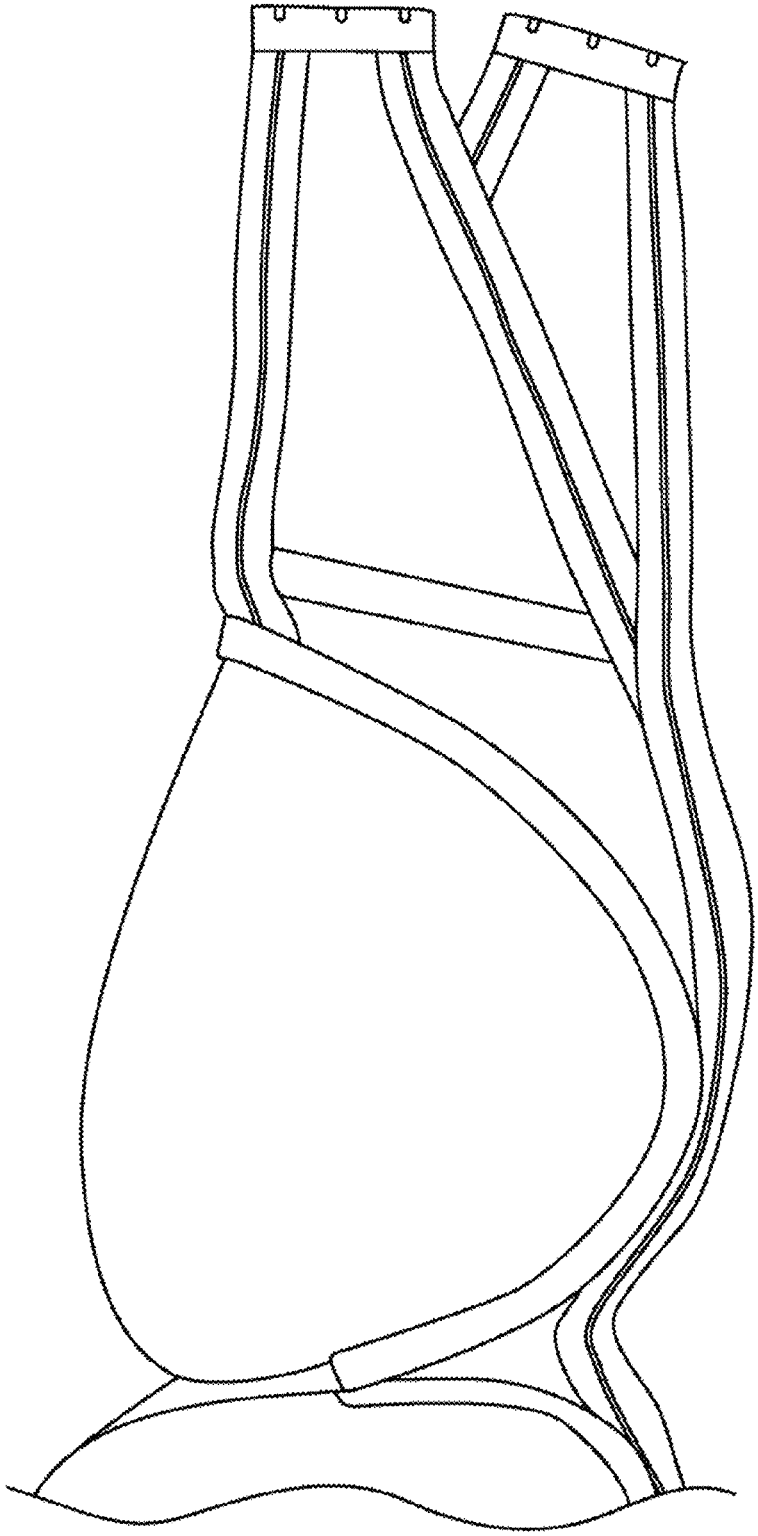
Figure 3W:
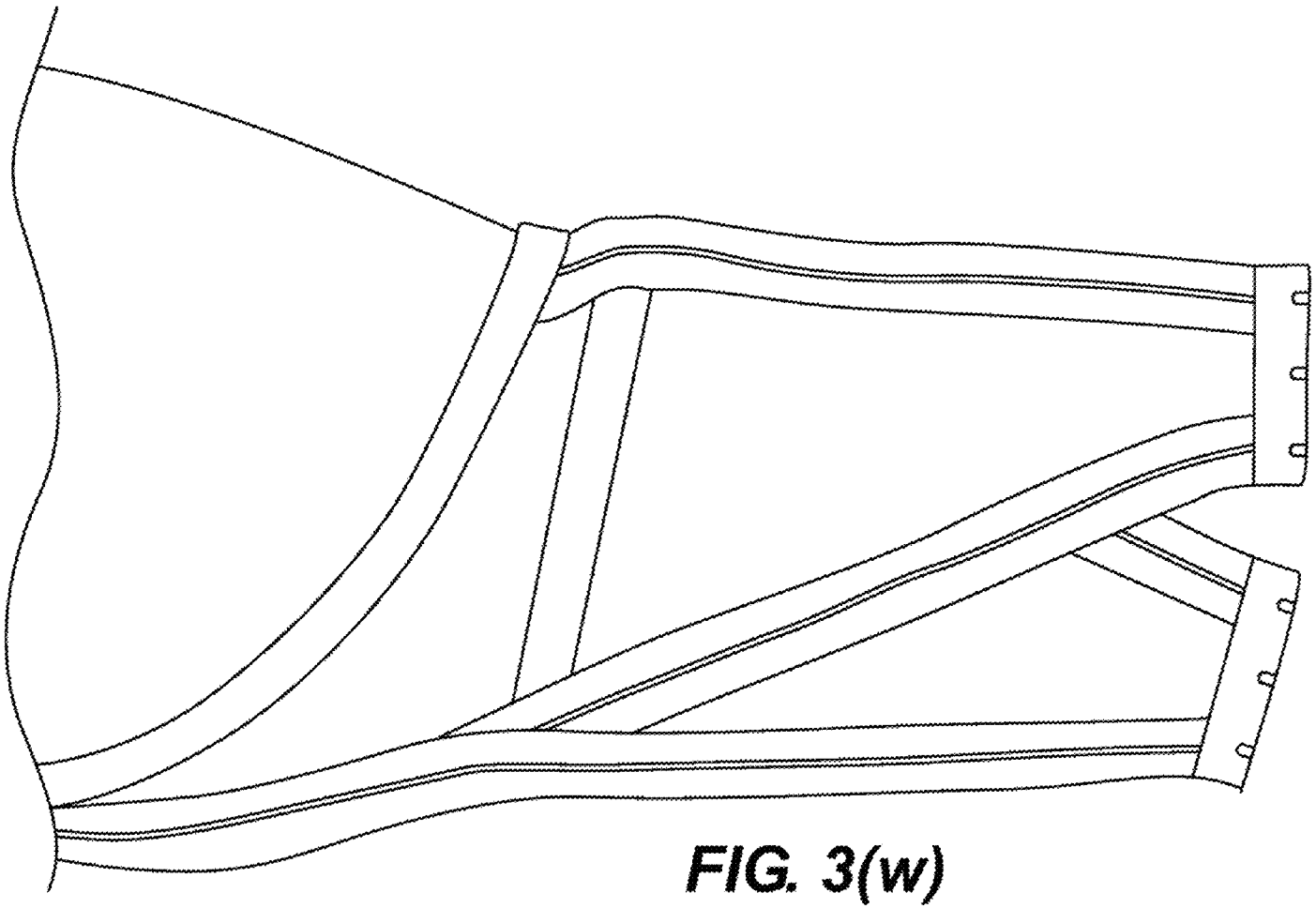
Figure 4A:
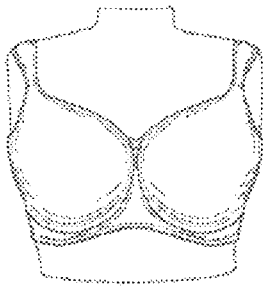
FIGS. 4(*a*)-4(*f*) are sketches illustrating an exemplary embodiment of the invention.
Figure 4B:
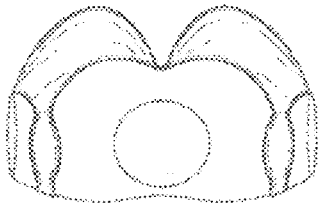
Figure 4C:
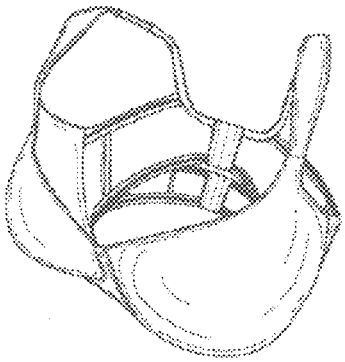
Figure 4D:
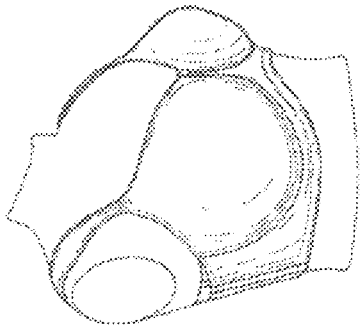
Figure 4E:
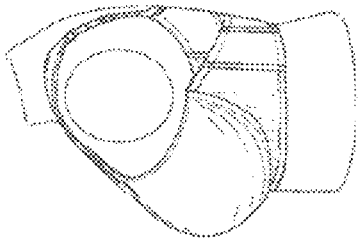
Figure 4F:
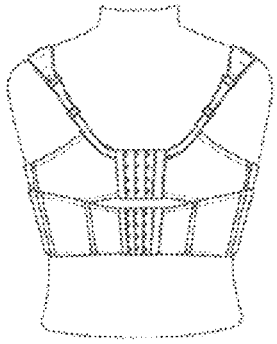

The invention relates to a bra that provides support and comfort to wearers, especially larger wearers. While bras can be worn by either males or females, and by either children or adults, they are generally worn by adult females. Thus, in the following description, the terms "women," "woman," "her," and "she" may be used to describe the wearer of the bra. This is meant for simplicity and clarity and is not intended to exclude men, girls, or boys, or to limit the scope of the invention in any way.

As used herein, the term "cups" refers to the two portions of the bra that cover and hold the breasts. A cup may cover the entire breast or only a portion of the breast.

As used herein "bra bands" refers to the portion of the bra that extend from the outer base of the cups, around the woman, and secure in the back, usually along the spine. Bra bands may be distinct from the cups or they may be an extension of the cups.

As used herein the term "inner bra band" refers to the bra band that originates at a point closer to the woman than the outer bra band.

As used herein the term "outer bra band" refers to the bra band that originates as a point further from the woman than the inner bra band.

As used herein, the term "shoulder straps" refers to straps that are coupled to the upper portion of the cups and extend over the shoulders. The other ends of the shoulder straps may attach to the bra bands in the back or to each other behind the neck.

As used herein, the terms "closure" and "clasp" refer to the device or mechanism used to couple the bra bands to each other or the shoulder straps to each other, usually along the spine of a woman.

As used herein the term "underwire" refers to a "wire" which runs under the lower portion of the cup to provide additional support and shape. The "wire" can be made out of a variety of materials including, but not limited to metals, plastic, or a combination thereof. The wires may be flexible or they may be rigid.

As used herein the term "frame" refers to material surrounding other components of the bra that offer stability or support.

As used herein the term "bone" refers to a support structure inserted into the material of a bra to provide stability, maintain rigidity, and/or maintain the width of the material into which it is inserted.

As used herein, when referring to a bra, the terms "right or right side" refer to the right side of the garment as worn. For example, the right cup would cover a woman's right breast.

As used herein, when referring to a bra, the terms "left or left side" refer to the left side of the garment as worn. For example, the left cup would cover a woman's left breast.

As used herein, when referring to a bra, the term "front" refers to the portion of the bra that would be covering the front of a woman. For example, the cups are at the front of the bra.

As used herein, when referring to a bra, the term "back" refers to the portion of the bra that would be covering the back of a woman. For example, the "closure" is generally located at the back of a bra.

As used herein, when referring to a bra, the term "side" refers to the portion of the bra that would be covering the side of woman, such as the area under the arm. For example, at least a portion of the bra band is generally at the side of the bra. Thus, the right side of a bra covers the right side of a woman and the left side of a bra covers the left side of a woman.

The bra of the present invention includes two cups and two bra bands, including an inner bra band and an outer bra band. Each bra band is generally made up of two panels, a right bra band panel and a left bra band panel. Each inner bra band panel is attached to the corresponding cup, preferably originating at the bottom center of the cup, and continues in an upward and outward direction around the side of a woman. The inner bra band provides support and lifts the breasts and also reduces the amount of bulging that occurs with a bra with only a single bra band.

Each outer bra band panel is coupled to the side portion of the corresponding cup and continues in a horizontal direction around the woman. The outer bra bands can be directly or indirectly attached to the corresponding cup or they can be extensions of the corresponding cup.

The inner bra band and the outer bra band may be coupled to each other at the point where the outer bra band is coupled to the cup. In one embodiment, this attachment may continue until the point where the inner bra band is no longer covered by the outer bra band. In another embodiment, this coupling may terminate at a point prior to the point where the inner bra band is no longer covered by the outer bra band. The outer bra band panels "hug" a woman around the sides of her upper rib cage and attach to each other at her spine.

In one embodiment, the inner bra band panels may attach to each other. In one embodiment, the attachment is at a woman's spine, preferably above the point of attachment of the outer bra band panels. A bra may or may not have shoulder straps. If a bra has shoulder straps, in one embodiment the shoulder straps may attach to each other at the woman's spine and the inner bra band panels may attach to the shoulder straps on each side of the woman's spine. In another embodiment, the shoulder straps may attach to the inner bra bands and the inner bra bands may attach to each other at a point along the woman's spine.

In other embodiments, the inner bra bands, the outer bra bands, and/or the shoulder straps may be single continuous pieces of material that are coupled to the right cup at one end and to the left cup at the other end. In other words, they may be single panels rather than a combination of right and left panels. In still other embodiments, the inner bra band panels, the outer bra band panels, and/or the shoulder straps may attach at a point other than the woman's spine.

The following figures and description are intended to illustrate preferred embodiments of the invention. It should be noted that such figures and description are not intended in any way to limit the scope of the invention. Further, it will be apparent that the invention may be implemented in other bra styles as well as in swim suits, gym apparel, evening wear, and other garments capable of accommodating a built-in bra.

FIGS. 1(*a*)-1(*cc*) illustrate one embodiment of the invention. FIG. 1(*a*) illustrates the front/right portion of a bra 100. The left side of the bra will be a mirror image of the right side. Illustrated in FIG. 1(*a*) is a right cup 110, a right shoulder strap 120, a right outer bra band panel 130, and a right inner bra band panel 140. The cup 110 may be made of any material suitable for a bra cup and may be of any style. The cup may or may not be molded. In a preferred embodiment, the cup is molded. In one embodiment, the cup has a push up insert. The cup may or may not contain an under wire. In a preferred embodiment, the cup contains an under wire.

Attached to the upper portion of the cup 110 is a shoulder strap 120. The shoulder strap 120 may be attached to any portion of the cup that allows the strap to sit over the woman's shoulder 150. Alternatively, the shoulder strap 120 may be coupled to the cup 110 via another portion or portions of the bra 100 that are attached to the cup 110. In other words, the shoulder strap 120 need not be attached directly to the cup 110. The shoulder strap 120 may be permanently affixed to the bra 100 or it may be removable. In a preferred embodiment, the shoulder strap 120 is removable from the bra 100. The shoulder strap 120 may be made of any material suitable for a shoulder strap. In a preferred embodiment, the shoulder strap 120 is made of a gel material.

Also attached to the cup 110 is the outer bra band panel 130. The outer bra band panel 130 may be attached to any portion of the cup 110 that allows the bra to be held in place. Alternatively, the outer bra band panel 130 may be coupled to the cup with another portion or portions of the bra 100 that are attached to the cup 100. In other words, the outer bra band panel 130 need not be attached directly to the cup 110. In a preferred embodiment, as shown in FIG. 1(*a*) the outer bra band 130 is an extension of the cup 110. In another preferred embodiment, the outer bra band panel 130 originates at the bottom center of the inside of the cup 110. In a most preferred embodiment, the outer bra band panel 130 originates at the bottom center front of the inside of the cup 110. The outer bra band panel 130 may be made of any material suitable for an outer bra band. In a preferred embodiment, the outer bra band panels 130 are made of micro-fiber. In a most preferred embodiment, the micro-fiber is a double microfiber material.

Attached to the bottom center of the inside of the cup 110 is the inner bra band panel 140. In a preferred embodiment, the inner bra band panel 140 originates at the bottom center front of the inside of the cup 110. The inner bra band panel 140 lifts and supports the breast and holds the flesh and skin under a woman's arm in place. The inner bra band 140 may be attached to any portion of the cup 110 that allows the inner bra band panel 140 to support the breast. Alternatively, the inner bra band panel 140 may be coupled to the cup 110 with another portion or portions of the bra 100 that are attached to the cup 110. In other words, the inner bra band panel 140 need not be attached directly to the cup 110. In a preferred embodiment, however, the inner bra band panel 140 is attached to the cup 110. In a most preferred embodiment, the inner bra band panel 140 is attached to the cup 110 from the point of initial attachment at the bottom of the cup all the way out to the end of the cup. At this point, the inner bra band panel 140 may separate from the bra 100 or, in a preferred embodiment, may be attached to the corresponding outer bra band panel 130. The inner bra band panel 140 may be made of any material suitable for an inner bra band. In a preferred embodiment, the inner bra band panels 140 are made of micro-fiber. In a most preferred embodiment, the micro-fiber is a double microfiber material.

FIG. (*b*) illustrates the back right portion of the bra illustrated in FIG. 1(*a*). The back left side of the bra will be a mirror image of the right side. In this embodiment, the right outer bra band panel 130 attaches to the left outer bra band panel (not shown) at a point along the spine 160 of the woman. The right and left outer bra band panels may be attached with any mechanism capable of attaching two panels. In a preferred embodiment, the attachment mechanism is a hook 170 and eye (not shown) mechanism. In another embodiment, the outer bra band may be a single panel with no point of attachment.

The shoulder straps 120 attach to each other at a point along the spine 160 of the woman above the point of attachment of the outer bra band panels. The right and left shoulder straps may be attached with any mechanism capable of attaching two shoulder straps. In a preferred embodiment, the attachment mechanism is a hook 170 and eye (not shown) mechanism. In another embodiment, the shoulder strap may be a single strap with no point of attachment. The mechanism of attachment may be the same mechanism used to attach the outer bra band panels or it may be a different mechanism. In one embodiment, the shoulder straps contain one or more bones 180 which, among other things, provide rigidity to the shoulder straps 120.

In this embodiment, the inner bra band panel 140 is attached to the outer bra band panel 130 until a portion somewhere between the woman's spine and her side. The inner bra band panel 140 attaches to the shoulder strap 120 at a point of attachment 190 prior to the point at which the right and left shoulder straps attach to each other. The inner bra band panel 140 may be attached to the shoulder strap 120 by any mechanism capable of attaching them. The attachment may be permanent or it may be removable.

FIG. 1(*c*) illustrates the back portion, including the right and left sides, of the bra shown in FIGS. 1(*a*) and 1(*b*).

FIGS. 1(*d*)-1(*cc*) illustrate additional views and/or variations of the bra shown in FIGS. 1(*a*)-1(*c*).

FIGS. 2(*a*)-2(*q*) illustrate another embodiment of the invention. FIG. 2(*a*) illustrates the front, right portion of a bra 200. The left side of the bra will be a mirror image of the right side. Illustrated in FIG. 2(*a*) is a frame 205, a cup 210, optional seams 215, a shoulder strap 220, a side panel 235, an inner bra band panel 240.

The frame 205 may surround the cup 210 and other portions of the bra and provide extra support and comfort. The frame 205 may be made of any material capable of providing support and comfort.

The cup 210 may be made of any material suitable for a bra cup and may be of any style. The cup may or may not be molded. In one embodiment, the cup has a push up insert. The push up insert can be made of any material capable of pushing up the breast. In a preferred embodiment, the bra does not have a push up insert. The cup may or may not contain an under wire. In a preferred embodiment, the cup does not contain an under wire. The cup may or may not contain one or more seams 215. In a preferred embodiment the cup contains seams 215. In a most preferred embodiment, the cup 210 contains a first seam positioned horizontally across the middle of the cup and a second seam positioned vertically from the horizontal seam to the bottom of the cup 210.

Coupled to the upper portion of the cup 210 is a shoulder strap 220. The shoulder strap 220 may be attached to any portion of the cup that allows the strap to sit over the wearer's shoulder 250. Alternatively, the shoulder strap 220 may be coupled to the cup 210 with another portion or portions of the bra that is attached to the cup. In a preferred embodiment, shoulder strap is attached to the frame 205 located at the upper portion of the cup 210. The shoulder strap 220 may be permanently affixed to the bra 200 or it may be removable. In a preferred embodiment, the shoulder strap 220 is permanently affixed to the bra 200. The shoulder strap 220 may be made of any material suitable for a shoulder strap 220. In a preferred embodiment, the shoulder strap 220 is made of a gel material.

Also coupled to the cup is the outer bra band panel 230. The outer bra band panel 230 may be attached to any portion of the cup 210 that allows the bra 200 to be held in place. Alternatively, the outer bra band panel 230 may be coupled to the cup with another portion or portions of the bra 200 that are attached to the cup 210. In other words, the outer bra band panel 230 need not be attached directly to the cup 210. In a preferred embodiment, the outer bra band panel 130 originates at the bottom center of the inside of the cup 110. In a most preferred embodiment, the outer bra band panel 130 originates at the bottom center front of the inside of the cup 110. In a preferred embodiment, there is a side bone 235 where the cup 210 and the outer bra band panel 230 meet. The side bone 235 helps to keep the width of the bra in place. The size of the side bone 235 may vary depending on the size of a bra 200. In a preferred embodiment, the side bone is 5 inches long. The outer bra band panel 230 may be made of any material suitable for an outer bra band. In a preferred embodiment, the outer bra band panels 130 are made of micro-fiber. In a most preferred embodiment, the micro-fiber is a double microfiber material.

Attached to the bottom center of the inside of the cup is the inner bra band panel 240. In a preferred embodiment, the inner bra band panel 140 originates at the bottom center front of the inside of the cup 110. The inner bra band lifts and supports the breast and holds the flesh and skin under the woman's arm in place. The inner bra band panel 240 may be attached to any portion of the cup that allows the inner bra band panel 240 to support the breast. Alternatively, the inner bra band panel 240 may be coupled to the cup 210 with another portion or portions of the bra 200 that are attached to the cup 210. In other words, the inner bra band panel 240 need not be attached directly to the cup 210. In a preferred embodiment, however, the inner bra band panel 240 is attached directly to the cup 210. In a most preferred embodiment, the inner bra band panel 240 is attached to the cup 210 starting at the bottom of the cup and remaining attached to the cup all the way out to the end of the cup. At this point, the inner bra band may separate from the bra 200 or, in a preferred embodiment, may be attached to the outer bra band. In one embodiment, the inner bra band panel 240 remains attached to the cup 210 and/or the outer bra band panel 230 until it reaches the side bone 235. The inner bra band panel 240 may be made of any material suitable for an inner bra band. In a preferred embodiment, the inner bra band panel 240 is made of micro-fiber. In a most preferred embodiment, the micro-fiber is a double micro-fiber material.

FIG. 2(*b*) illustrates the right side portion of the bra 200 illustrated in FIG. 2(*a*). The left side of the bra will be a mirror image of the right side. In this embodiment, the outer bra band panel 230 attaches to the bone 230 which is located at the side of the woman.

The inner bra band panel 240 may be attached to the cup until it reaches the bone 235. The inner bra band panel 240 cradles the breast providing lift and support. The inner bra band panel 240 travels up the back and away from the outer bra band 230.

FIG. 2(*c*) illustrates the back right portion of the bra shown in FIGS. 2(*a*) and 2(*b*). The back left side of the bra will be a mirror image of the right side. In this embodiment, the right outer bra band panel 230 attaches to the left outer bra band panel (not shown) at a point along the woman's spine 260. The right and left outer bra band panels may be attached with any mechanism capable of attaching bra band panels In a preferred embodiment, the attachment mechanism is a hook 270 and eye (not shown) mechanism. In another embodiment, the outer bra band may be a single panel with no point of attachment.

The inner bra band panels 240 attach to each other at the spine 260 of the woman at a point above the point of above the point of attachment of the outer bra band panels. In this embodiment, the inner bra band panel 240 travels up the woman's back and is combined with the corresponding shoulder strap 220 prior to the point where the inner bra band panels attach to each other. The inner bra band panels 240 may be attached to each other by any mechanism capable of attaching them. In a preferred embodiment, the mechanism is a hook 270 and eye (not shown) mechanism. In an alternative embodiment, the inner bra band may be a single panel with no point of attachment. In one embodiment, the shoulder straps contain one or more bones 280 which provide rigidity to the shoulder straps.

FIGS. 2(*d*)-2(*q*) illustrate additional views and/or variations of the bra shown in FIGS. 2(*a*)-2(*c*).

FIGS. 3(*a*)-3(*w*) illustrate a strapless embodiment of the invention. FIG. 3(*a*) illustrates the left "butterfly" component of the strapless embodiment 300 including the inside bra band panel 330, an inside bra band panel bone 325, a side bone 335, the outside bra band panel 340, an outside bra band panel bone 345, and hooks 370 and eyes 375. The size of the side bone may vary depending on the size of the bra, but in a preferred embodiment the side bone is 5 inches long.

FIG. 3(*b*) illustrates the front portion of two alternative versions of the strapless embodiment. One version is shown covering the right breast and another version is shown covering the left breast. The differences between the version shown on the right side and the left side are for illustration only of two alternative versions. In an actual garment, the right and left sides would be mirror images of each other. FIG. 3(*b*) illustrates cups 310, an inner bra band panels 340, a side bone 335, and optional seams 315.

The cups 310 may be made of any material suitable for a bra cup. The cups may or may not be molded. In one embodiment, the cup has a push up insert. The push up insert can be made of any material capable of pushing up the breast. The cup may or may not contain an under wire.

Attached to the bottom center of the cups are the inner bra band panels 340. The inner bra band panels 340 lift and supports the breasts and hold the flesh and skin under the woman's arm in place. The inner bra band panels 340 may be attached to any portion of the cup 310 that allow the inner bra band panels 340 to support the breasts. Alternatively, the inner bra band panels 340 may be coupled to the cups 310 with another portion or portions of the bra 300 that is attached to the cup 310. In other words, the inner bra band panels 340 need not be attached directly to the cups 310. In a preferred embodiment, however, the inner bra band panels 340 are attached to the cups 310. In a preferred embodiment, the inner bra band panels 340 are attached to the cups 310 starting at the bottom center of the inside of the cups and remain attached to the cups all the way out to the end of the cups. In another preferred embodiment, the inner bra band panels 340 are attached to the cups 310 starting at the bottom center front of the inside of the cups and remain attached to the cups all the way out to the end of the cups. The inner bra band panels 340 may be made of any material suitable for an inner bra band panel. In a preferred embodiment, the inner bra band panels 340 are made of micro-fiber. In a most preferred embodiment, the micro-fiber is a double micro-fiber material.

FIG. 3(*c*) illustrates the right side portion of the bra illustrated in FIG. 3(*b*). FIG. 3(*c*) shows the relationship among the cup 310, the outer inner bra band panel 330, and the outer bra band panel 340.

FIG. 3(*d*) illustrates the back left portion of bra shown in FIGS. 3(*b*) and 3(*c*). In this embodiment, the left and right outer bra band panels attach to each other at a point along the woman's spine 260. The left and right outer bra band panels 340 can be attached with any mechanism capable of attaching bra band panels. In a preferred embodiment, the attachment mechanism is a hook 370 and eye (not shown) mechanism. In another embodiment, the outer bra band may be a single panel with no point of attachment.

The right and left inner bra band panels attach to each other at the woman's spine 260 at a point above the point of attachment of the left and right outer bra band panels. The point of attachment of the outer bra band and the point of the attachment of the inner bra band may overlap. The inner bra band panels may be attached to each other by any mechanism capable of attaching them. In a preferred embodiment, the mechanism is a hook 340 and eye (not shown) mechanism. In an alternative embodiment, the inner bra band may be a single panel with no point of attachment.

The side of the bra may contain a side bone 335 for additional support and structure. The size of the side bone may vary depending on the size of the bra. In a preferred embodiment, the side bone is 5 inches long. In addition, the outer bra band may contain bones 345 for additional support and structure. In addition, the inner bra band may contain bones 325 for additional support and structure.

FIGS. 3(*e*)-1(*w*) illustrate additional views and/or variations of the bra shown in FIGS. 3(*a*)-3(*d*).

FIGS. 4(*a*)-4(*f*) are sketches illustrating an exemplary embodiment of the invention.

Figure 5A:
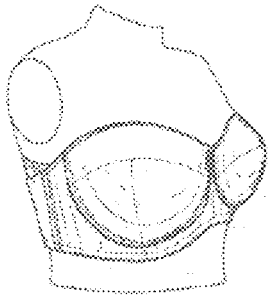
FIGS. 5(*a*)-5(*lll*) are sketches illustrating a strapless embodiment of the invention.
Figure 5B:
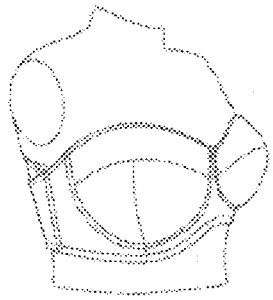
Figure 5C:
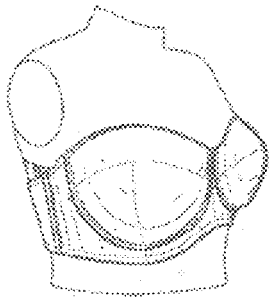
Figure 5D:
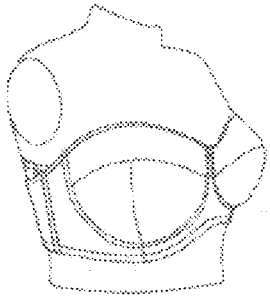
Figure 5E:
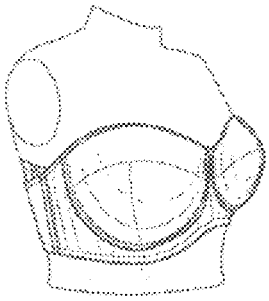
Figure 5F:
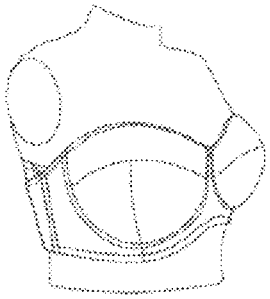
Figure 5G:
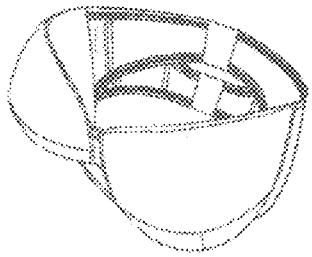
Figure 5H:
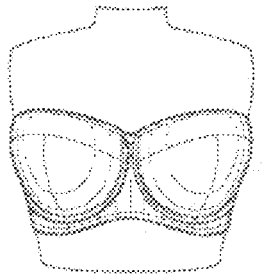
Figure 5I:
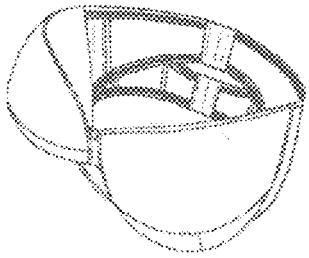
Figure 5J:
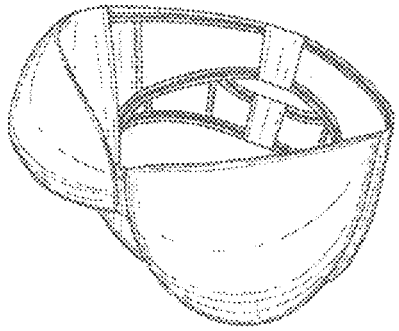
Figure 5K:
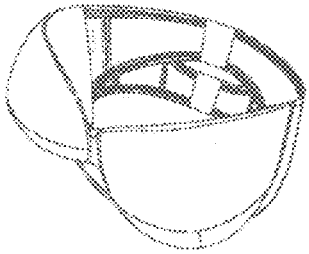
Figure 5L:
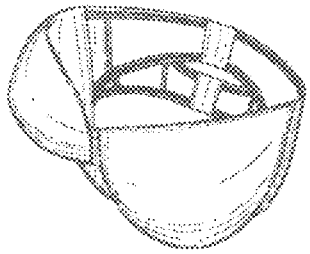
Figure 5M:
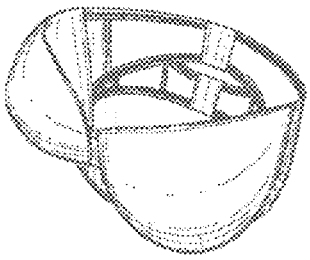
Figure 5N:
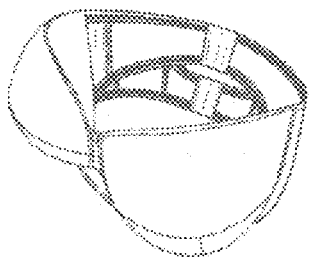
Figure 5O:
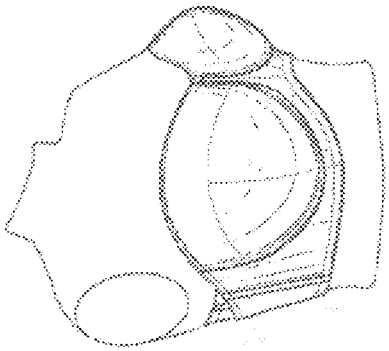
Figure 5P:
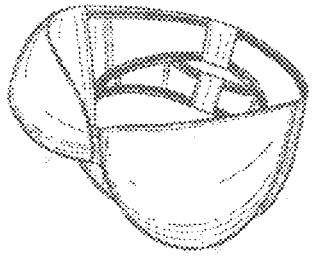
Figure 5Q:
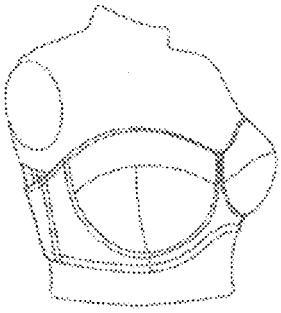
Figure 5R:
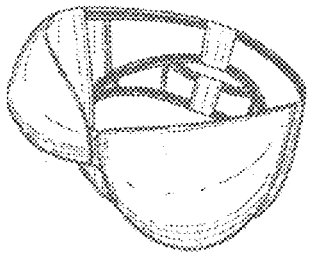
Figure 5S:
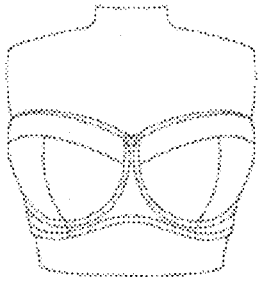
Figure 5T:
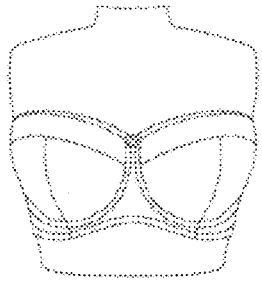
Figure 5U:
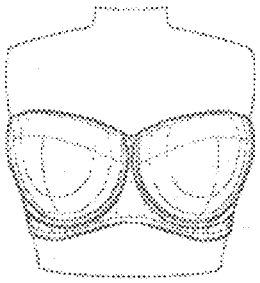
Figure 5V:
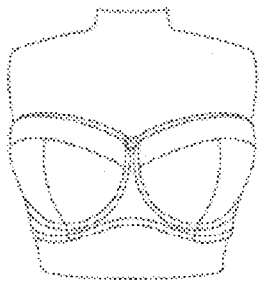
Figure 5W:
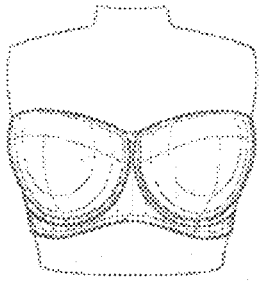
Figure 5X:
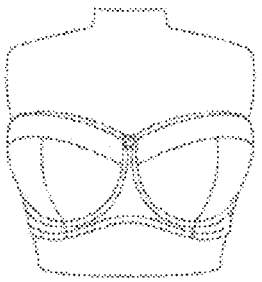
Figure 5Y:
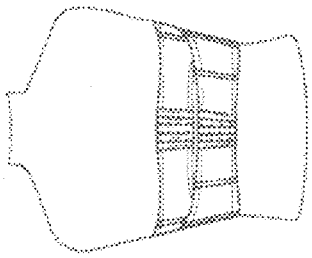
Figure 5Z:
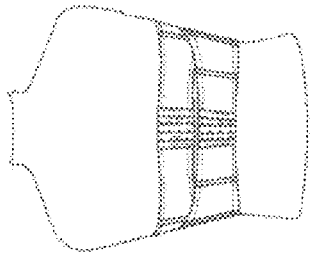
Figure 5:
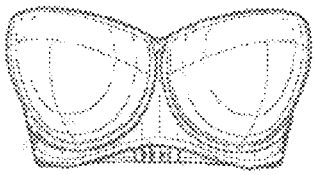
Figure 5:
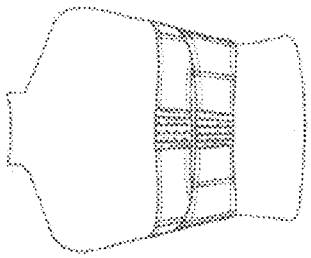
Figure 5:
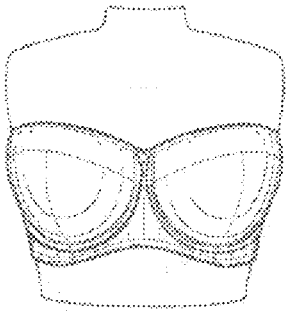
Figure 5:
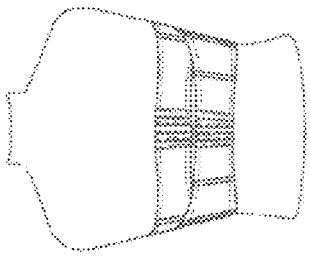
Figure 5:
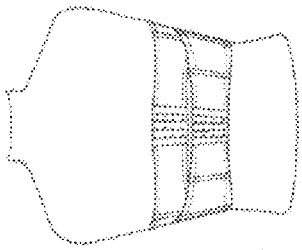
Figure 5:
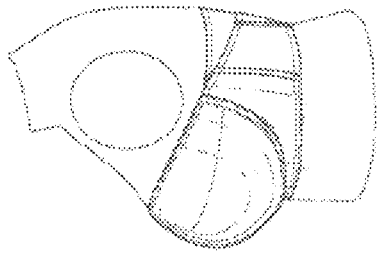
Figure 5:
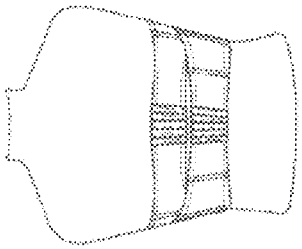
Figure 5:
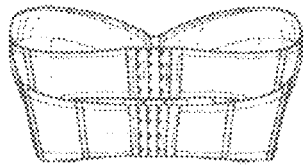
Figure 5:
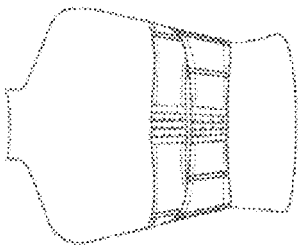
Figure 5:
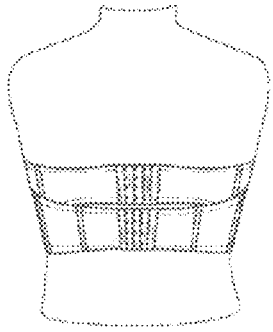
Figure 5:
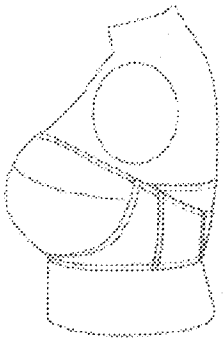
Figure 5:
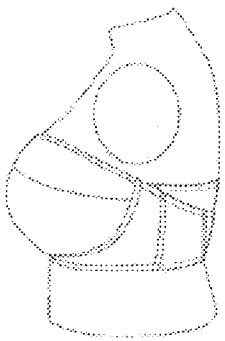
Figure 5:
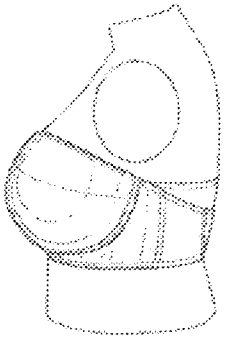
Figure 5:
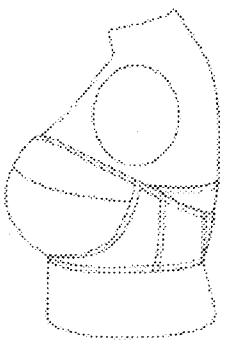
Figure 5:
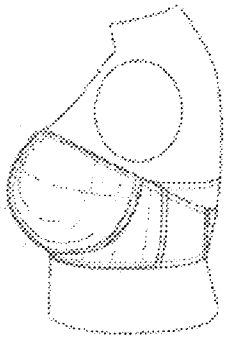
Figure 5:
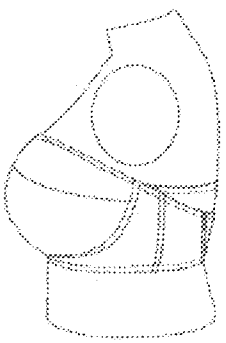
Figure 5:
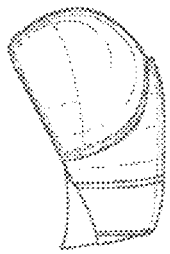
Figure 5:
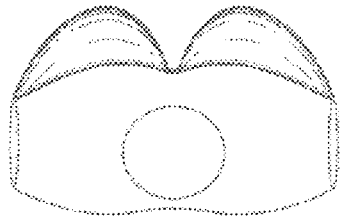
Figure 5:
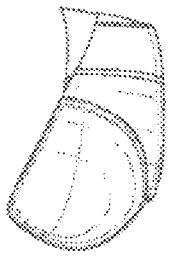
Figure 5:
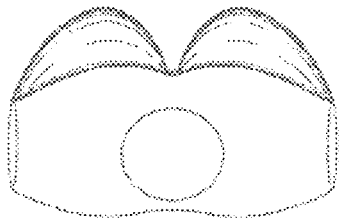
Figure 5:
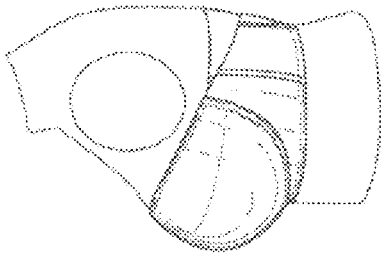
Figure 5:
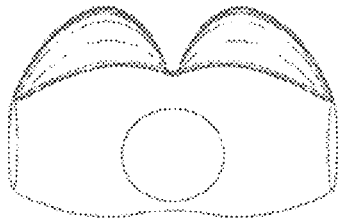
Figure 5:
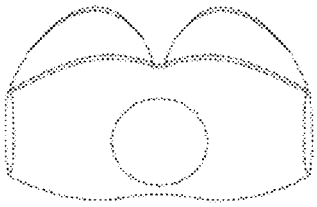
Figure 5:
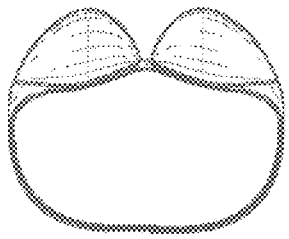
Figure 5:
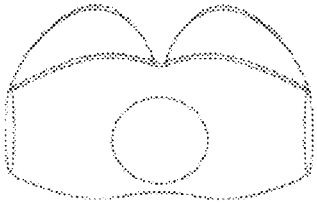
Figure 5:
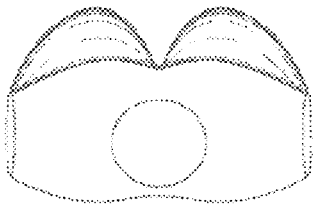

FIGS. 5(*a*)-5(*lll*) are sketches illustrating a strapless embodiment of the invention.

What is claimed is:

1. A bra, comprising:

a right cup and a left cup connected to each other;

an inner bra band fixedly connected to the right cup and fixedly connected to the left cup, and having a middle region fully extending across a first portion of a wearer's back when the bra is worn in an intended manner, said middle region comprising a left inner bra panel, and a right inner bra panel releasably securable to the left inner bra panel, to releasably secure the inner bra band across the wearer's back at the first portion; and an outer bra band fixedly connected to the right cup and fixedly connected to the left cup, and having a middle region separate from the middle region of the inner bra band and fully extending across a second portion of the wearer's back when the bra is worn in an intended manner, said middle region of the second band comprising a left outer bra panel, and a right outer bra panel releasably securable to the left outer bra panel of the outer bra band, to releasably secure the outer bra band across the wearer's back at the second portion;

wherein the first portion and the second portion of the wearer's back do not include the wearer's shoulders, and wherein the second portion of the wearer's back does not include the first portion of the wearer's back.

2. The bra of claim 1, further comprising a frame.

3. The bra of claim 1, further comprising seams.

4. The bra of claim 1, further comprising side panels.

5. The bra of claim 1, wherein said inner bra band contains bones.

6. The bra of claim 1, wherein said outer bra band contains bones.

7. The bra of claim 1, wherein said inner bra band is comprised of a micro-fiber material.

8. The bra of claim 1, wherein said outer bra band is comprised of a micro-fiber material.

9. The bra of claim 1, wherein said inner bra band and said outer bra band are comprised of a micro-fiber material.

10. The bra of claim 1, wherein said inner bra band and the outer bra band are fixedly attached to the right cup and left cup in an overlying configuration.

11. The bra of claim 1, wherein said cups are molded.

12. The bra of claim 1, wherein said cups include a push up insert.

13. The bra of claim 1, wherein said cups include an under wire.

14. The bra of claim 1, wherein said right inner bra band panel is releasably securable to said left inner bra band panel at the spine of the wearer.

15. The bra of claim 14, wherein said right inner bra band panel attaches is releasably securable to said left inner bra band panel with a hook and eye mechanism.

16. The bra of claim 1, wherein said right inner bra band panel originates at the bottom center of said right cup, and continues in an upward and outward direction around the side of the wearer and said left inner bra band panel originates at the bottom center of said left cup, and continues in an upward and outward direction around the side of the wearer.

17. The bra of claim 16, wherein said right inner bra band panel originates at the bottom center front of said right cup and said left inner bra band panel originates at the bottom center front of said left cup.

18. The bra of claim 1, further comprising one or more shoulder straps extending from one or more of the right cup and left cup to one or more of the inner band and outer band.

19. The bra of claim 18, wherein said one or more shoulder straps are permanently affixed to said bra.

20. The bra of claim 18, wherein said one or more shoulder straps are removable from the bra.

21. The bra of claim 18, wherein said one or more shoulder straps comprise a gel material.

22. The bra of claim 18, further comprising a right shoulder strap and a left shoulder strap.

23. The bra of claim 22, wherein said right shoulder strap attaches to said right inner bra band, said left shoulder strap attaches to said left inner bra band, and said right inner bra band attaches to said left inner bra band at a point along the spine of the wearer.

* * * * *